US010772384B2

(12) United States Patent
Whewell et al.

(10) Patent No.: US 10,772,384 B2
(45) Date of Patent: Sep. 15, 2020

(54) SYSTEM AND METHODS FOR MINIMIZING DYNAMIC LACE MOVEMENT

(71) Applicant: Boa Technology Inc., Denver, CO (US)

(72) Inventors: Eric Whewell, Denver, CO (US); Alessandro Manzato, Denver, CO (US); Kristopher Lovett, Denver, CO (US); Tamara White, Denver, CO (US); Michael Friton, Denver, CO (US); Luke Scotton, Denver, CO (US); Benjamin Sample, Denver, CO (US); Mark Kerns, Denver, CO (US); Robert Dickensheets, Denver, CO (US)

(73) Assignee: BOA TECHNOLOGY INC., Denver, CO (US)

( * ) Notice: Subject to any disclaimer, the term of this patent is extended or adjusted under 35 U.S.C. 154(b) by 12 days.

(21) Appl. No.: 16/038,940

(22) Filed: Jul. 18, 2018

(65) Prior Publication Data

US 2019/0021447 A1 Jan. 24, 2019

Related U.S. Application Data

(60) Provisional application No. 62/622,719, filed on Jan. 26, 2018, provisional application No. 62/534,105, (Continued)

(51) Int. Cl.
*A43C 11/16* (2006.01)
*A43C 11/00* (2006.01)
(Continued)

(52) U.S. Cl.
CPC ..... *A43C 11/165* (2013.01); *A43B 1/0081* (2013.01); *A43B 3/0078* (2013.01);
(Continued)

(58) Field of Classification Search
CPC . A43C 11/165; A43C 11/004; A43C 11/1493; A43C 11/20; A43C 11/04; A43B 3/0078; A43B 23/0235; A43B 23/024
See application file for complete search history.

(56) References Cited

U.S. PATENT DOCUMENTS 59,332 A 10/1866 White et al.
80,834 A 8/1868 Prussia
(Continued)

FOREIGN PATENT DOCUMENTS

CA 2112789 8/1994
CA 2114387 8/1994
(Continued)

OTHER PUBLICATIONS

U.S. Appl. No. 09/956,601 Including its prosecution history, filed Sep. 18, 2001, Hammerslag.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

A reel based closure device includes a housing component, a spool that is rotatably positioned within an interior region of the housing component, and a tightening component that is coupled with the housing component. The tightening component is operably coupled with the spool so that an operation of the tightening component causes the spool to rotate within the interior region of the housing component to wind a tension member about the spool. The housing component is configured so that the tension member is routed axially below the housing component's interior region and to one or more guides that are positioned along a lace path of an article, such as a shoe.

14 Claims, 53 Drawing Sheets

Related U.S. Application Data filed on Jul. 18, 2017, provisional application No. 62/562,161, filed on Sep. 22, 2017.

(51) Int. Cl.

| | |
|---|---|
| ***A43C 11/20*** | (2006.01) |
| ***A43B 3/00*** | (2006.01) |
| ***A43B 23/02*** | (2006.01) |
| ***A43B 1/00*** | (2006.01) |
| ***A43C 11/14*** | (2006.01) |
| *B65H 75/44* | (2006.01) |
| *A43C 1/04* | (2006.01) |

(52) U.S. Cl.

CPC ..... *A43B 23/024* (2013.01); *A43B 23/0235* (2013.01); *A43C 11/004* (2013.01); *A43C 11/1493* (2013.01); *A43C 11/20* (2013.01); *A43C 1/04* (2013.01); *B65H 75/4428* (2013.01)

(56) References Cited

U.S. PATENT DOCUMENTS

| | | | |
|---|---|---|---|
| 117,530 | A | 8/1871 | Foote |
| 228,946 | A | 6/1880 | Schulz |
| 230,759 | A | 8/1880 | Drummond |
| 379,113 | A | 3/1888 | Hibberd |
| 568,056 | A | 9/1896 | Vail, Jr. |
| 746,563 | A | 12/1903 | McMahon |
| 819,993 | A | 5/1906 | Haws et al. |
| 908,704 | A | 1/1909 | Sprinkle |
| 1,060,422 | A | 4/1913 | Bowdish |
| 1,062,511 | A | 5/1913 | Short |
| 1,083,775 | A | 1/1914 | Thomas |
| 1,090,438 | A | 3/1914 | Worth et al. |
| 1,170,472 | A | 2/1916 | Barber |
| 1,288,859 | A | 12/1918 | Feller et al. |
| 1,390,991 | A | 9/1921 | Fotchuk |
| 1,393,188 | A | 10/1921 | Whiteman |
| 1,469,661 | A | 2/1922 | Migita |
| 1,412,486 | A | 4/1922 | Paine |
| 1,416,203 | A | 5/1922 | Hobson |
| 1,429,657 | A | 9/1922 | Trawinski |
| 1,481,903 | A | 4/1923 | Hart |
| 1,466,673 | A | 9/1923 | Solomon et al. |
| 1,530,713 | A | 2/1924 | Clark |
| 1,502,919 | A | 7/1924 | Seib |
| 1,862,047 | A | 6/1932 | Boulet et al. |
| 1,995,243 | A | 6/1934 | Clarke |
| 2,088,851 | A | 8/1937 | Gantenbein |
| 2,109,751 | A | 3/1938 | Matthias et al. |
| 2,124,310 | A | 9/1938 | Murr, Jr. |
| 2,316,102 | A | 4/1943 | Preston |
| 2,539,026 | A | 1/1951 | Mangold |
| 2,611,940 | A | 9/1952 | Cairns |
| 2,673,381 | A | 3/1954 | Dueker |
| 2,907,086 | A | 10/1959 | Ord |
| 2,926,406 | A | 3/1960 | Zahnor |
| 2,991,523 | A | 7/1961 | Del Conte |
| 3,028,602 | A | 4/1962 | Miller |
| 3,035,319 | A | 5/1962 | Wolff |
| 3,106,003 | A | 10/1963 | Herdman |
| 3,112,545 | A | 12/1963 | Williams |
| 3,122,810 | A | 3/1964 | Lawrence et al. |
| 3,163,900 | A | 1/1965 | Martin |
| D200,394 | S | 2/1965 | Hakim |
| 3,169,325 | A | 2/1965 | Fesl |
| 3,193,950 | A | 7/1965 | Liou |
| 3,197,155 | A | 7/1965 | Chow |
| 3,214,809 | A | 11/1965 | Zahnor |
| 3,221,384 | A | 12/1965 | Aufenacker |
| 3,276,090 | A | 10/1966 | Nigon |
| D206,146 | S | 11/1966 | Hendershot |
| 3,345,707 | A | 10/1967 | Rita |
| D210,649 | S | 4/1968 | Getgay |
| 3,401,437 | A | 9/1968 | Christpohersen |
| 3,430,303 | A | 3/1969 | Perrin et al. |
| 3,491,465 | A | 1/1970 | Martin |
| 3,545,106 | A | 12/1970 | Martin |
| 3,618,232 | A | 11/1971 | Shnuriwsky |
| 3,668,791 | A | 6/1972 | Salzman et al. |
| 3,678,539 | A | 7/1972 | Graup |
| 3,703,775 | A | 11/1972 | Gatti |
| 3,729,779 | A | 5/1973 | Porth |
| 3,738,027 | A | 6/1973 | Schoch |
| 3,793,749 | A | 2/1974 | Gertsch et al. |
| 3,808,644 | A | 5/1974 | Schoch |
| 3,934,346 | A | 1/1976 | Sasaki et al. |
| 3,975,838 | A | 8/1976 | Martin |
| 4,084,267 | A | 4/1978 | Zadina |
| 4,095,354 | A | 6/1978 | Annovi |
| 4,130,949 | A | 12/1978 | Seidel |
| 4,142,307 | A | 3/1979 | Martin |
| 4,227,322 | A | 10/1980 | Annovi |
| 4,261,081 | A | 4/1981 | Lott |
| 4,267,622 | A | 5/1981 | Burnett-Johnston |
| 4,408,403 | A | 10/1983 | Martin |
| 4,417,703 | A | 11/1983 | Weinhold |
| 4,433,456 | A | 2/1984 | Baggio |
| 4,452,405 | A | 6/1984 | Adomeit |
| 4,463,761 | A | 8/1984 | Pols et al. |
| 4,480,395 | A | 11/1984 | Schoch |
| 4,507,878 | A | 4/1985 | Semouha |
| 4,516,576 | A | 5/1985 | Kirchner |
| 4,551,932 | A | 11/1985 | Schoch |
| 4,555,830 | A | 12/1985 | Petrini et al. |
| 4,574,500 | A | 3/1986 | Aldinio et al. |
| 4,616,432 | A | 10/1986 | Bunch et al. |
| 4,616,524 | A | 10/1986 | Biodia |
| 4,619,057 | A | 10/1986 | Sartor et al. |
| 4,620,378 | A | 11/1986 | Sartor |
| 4,631,839 | A | 12/1986 | Bonetti et al. |
| 4,631,840 | A | 12/1986 | Gamm |
| 4,633,599 | A | 1/1987 | Morell et al. |
| 4,644,938 | A | 2/1987 | Yates et al. |
| 4,654,985 | A | 4/1987 | Chalmers |
| 4,660,300 | A | 4/1987 | Morell et al. |
| 4,660,302 | A | 4/1987 | Arieh et al. |
| 4,680,878 | A | 7/1987 | Pozzobon et al. |
| 4,719,670 | A | 1/1988 | Kurt |
| 4,719,709 | A | 1/1988 | Vaccari |
| 4,719,710 | A | 1/1988 | Pozzobon |
| 4,722,477 | A | 2/1988 | Floyd |
| 4,741,115 | A | 5/1988 | Pozzobon |
| 4,748,726 | A | 6/1988 | Schoch |
| 4,760,653 | A | 8/1988 | Baggio |
| 4,780,969 | A | 11/1988 | White, Jr. |
| 4,787,124 | A | 11/1988 | Pozzobon et al. |
| 4,790,081 | A | 12/1988 | Benoit et al. |
| 4,796,829 | A | 1/1989 | Pozzobon et al. |
| 4,799,297 | A | 1/1989 | Baggio et al. |
| 4,802,291 | A | 2/1989 | Sartor |
| 4,811,503 | A | 3/1989 | Iwama |
| 4,826,098 | A | 5/1989 | Pozzobon et al. |
| 4,841,649 | A | 6/1989 | Baggio et al. |
| 4,856,207 | A | 8/1989 | Datson |
| 4,862,878 | A | 9/1989 | Davison |
| 4,870,723 | A | 10/1989 | Pozzobon et al. |
| 4,870,761 | A | 10/1989 | Tracy |
| 4,884,760 | A | 12/1989 | Baggio et al. |
| 4,901,938 | A | 2/1990 | Cantley et al. |
| 4,924,605 | A | 5/1990 | Spademan |
| D308,282 | S | 6/1990 | Bergman et al. |
| 4,937,953 | A | 7/1990 | Walkhoff |
| 4,961,544 | A | 10/1990 | Biodia |
| 4,979,953 | A | 12/1990 | Spence |
| 4,989,805 | A | 2/1991 | Burke |
| 5,001,817 | A | 3/1991 | De Bortoli et al. |
| 5,016,327 | A | 5/1991 | Klausner |
| 5,042,177 | A | 8/1991 | Schoch |
| 5,062,225 | A | 11/1991 | Gorza |
| 5,065,480 | A | 11/1991 | DeBortoli |
| 5,065,481 | A | 11/1991 | Walkhoff |

(56) References Cited

U.S. PATENT DOCUMENTS 5,108,216 A 4/1992 Geyer et al.
5,117,567 A 6/1992 Berger
5,129,130 A 7/1992 Lecouturier
5,152,038 A 10/1992 Schoch
5,157,813 A 10/1992 Carroll
5,158,428 A 10/1992 Gessner et al.
5,177,882 A 1/1993 Berger
5,181,331 A 1/1993 Berger
5,184,378 A 2/1993 Batra
D333,552 S 3/1993 Berger et al.
5,205,055 A 4/1993 Harrell
5,233,767 A 8/1993 Kramer
5,249,377 A 10/1993 Walkhoff
5,259,094 A 11/1993 Zepeda
5,315,741 A 5/1994 Debberke
5,319,868 A 6/1994 Hallenbeck
5,319,869 A 6/1994 McDonald et al.
5,325,613 A 7/1994 Sussmann
5,327,662 A 7/1994 Hallenbeck
5,335,401 A 8/1994 Hanson
5,341,583 A 8/1994 Hallenbeck
5,345,697 A 9/1994 Quellais
5,355,596 A 10/1994 Sussmann
5,357,654 A 10/1994 Hsing-Chi
5,371,957 A 12/1994 Gaudio
5,381,609 A 1/1995 Hieblinger
5,392,535 A 2/1995 Van Noy et al.
D357,576 S 4/1995 Steinweis
5,425,161 A 6/1995 Schoch
5,425,185 A 6/1995 Gansler
5,430,960 A 7/1995 Richardson
5,433,648 A 7/1995 Frydman
5,463,822 A 11/1995 Miller
5,477,593 A 12/1995 Leick
D367,755 S 3/1996 Jones
D367,954 S 3/1996 Dion
5,502,902 A 4/1996 Sussmann
5,511,325 A 4/1996 Hieblinger
5,526,585 A 6/1996 Brown et al.
5,535,531 A 7/1996 Karabed et al.
5,537,763 A 7/1996 Donnadieu et al.
5,557,864 A 9/1996 Marks
5,566,474 A 10/1996 Leick et al.
D375,831 S 11/1996 Perry
5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
5,607,448 A 3/1997 Stahl et al.
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,692,319 A 12/1997 Parker et al.
5,718,021 A 2/1998 Tatum
5,718,065 A 2/1998 Locker
5,720,084 A 2/1998 Chen
5,732,483 A 3/1998 Cagliari
5,732,648 A 3/1998 Aragon
5,736,696 A 4/1998 Del Rosso
5,737,854 A 4/1998 Sussmann
5,755,044 A 5/1998 Veylupek
5,756,298 A 5/1998 Burczak
5,761,777 A 6/1998 Leick
5,772,146 A 6/1998 Kawamoto et al.
5,784,809 A 7/1998 McDonald
5,791,068 A 8/1998 Bernier et al.
5,819,378 A 10/1998 Doyle
5,833,640 A 11/1998 Vazquez, Jr. et al.
5,839,210 A 11/1998 Bernier et al.
5,845,371 A 12/1998 Chen
5,909,946 A 6/1999 Okajima
D413,197 S 8/1999 Faye
5,934,599 A 8/1999 Hammerslag
5,937,542 A 8/1999 Bourdeau
5,956,823 A 9/1999 Borel
5,971,946 A 10/1999 Quinn et al.
6,015,110 A 1/2000 Lai
6,038,791 A 3/2000 Cornelius et al.
6,052,921 A 4/2000 Oreck
6,070,886 A 6/2000 Cornelius et al.
6,070,887 A 6/2000 Cornelius et al.
6,083,857 A 7/2000 Bottger
6,088,936 A 7/2000 Bahl
6,102,412 A 8/2000 Staffaroni
D430,724 S 9/2000 Matis et al.
6,119,318 A 9/2000 Maurer
6,119,372 A 9/2000 Okajima
6,128,835 A 10/2000 Ritter et al.
6,128,836 A 10/2000 Barret
6,148,489 A 11/2000 Dickie et al.
6,202,953 B1 3/2001 Hammerslag
6,219,891 B1 4/2001 Maurer et al.
6,240,657 B1 6/2001 Weber et al.
6,256,798 B1 7/2001 Egolf et al.
6,267,390 B1 7/2001 Maravetz et al.
6,286,233 B1 9/2001 Gaither
6,289,558 B1 9/2001 Hammerslag
6,311,633 B1 11/2001 Keire
D456,130 S 4/2002 Towns
6,370,743 B2 4/2002 Choe
6,401,364 B1 6/2002 Burt
6,416,074 B1 7/2002 Maravetz et al.
6,467,195 B2 10/2002 Pierre et al.
6,477,793 B1 11/2002 Pruitt et al.
6,502,286 B1 * 1/2003 Dubberke ..... A43C 7/00 24/712.1
6,543,159 B1 4/2003 Carpenter
6,568,103 B2 5/2003 Durocher
6,606,804 B2 8/2003 Kaneko et al.
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 8/2004 Grande et al.
6,792,702 B2 9/2004 Borsoi et al.
6,802,439 B2 10/2004 Azam et al.
6,823,610 B1 11/2004 Ashley
6,871,812 B1 3/2005 Chang
6,877,256 B2 4/2005 Martin et al.
6,899,720 B1 5/2005 McMillan
6,922,917 B2 8/2005 Kerns et al.
6,938,913 B2 9/2005 Elkington
6,945,543 B2 9/2005 De Bertoli et al.
D510,183 S 10/2005 Tresser
6,976,972 B2 12/2005 Bradshaw
6,993,859 B2 2/2006 Martin et al.
D521,226 S 5/2006 Douglas et al.
7,073,279 B2 7/2006 Min
7,076,843 B2 7/2006 Sakabayashi
7,082,701 B2 8/2006 Dalgaard et al.
7,096,559 B2 8/2006 Johnson et al.
7,134,224 B2 11/2006 Elkington et al.
7,266,911 B2 9/2007 Holzer et al.
7,281,341 B2 10/2007 Reagan et al.
7,293,373 B2 11/2007 Reagan et al.
7,331,126 B2 2/2008 Johnson
7,343,701 B2 3/2008 Pare et al.
7,367,522 B2 5/2008 Chen
7,386,947 B2 6/2008 Martin et al.
7,392,602 B2 7/2008 Reagan et al.
7,401,423 B2 7/2008 Reagan et al.
7,490,458 B2 2/2009 Ford
7,516,914 B2 4/2009 Hyun
7,568,298 B2 8/2009 Kerns
7,582,102 B2 9/2009 Heinz et al.
7,584,528 B2 9/2009 Hu
7,591,050 B2 9/2009 Hammerslag
7,597,675 B2 10/2009 Ingimundarson et al.
7,600,660 B2 10/2009 Kasper et al.

(56) References Cited

U.S. PATENT DOCUMENTS 7,617,573 B2 11/2009 Chen
7,618,389 B2 11/2009 Nordt, III et al.
7,624,517 B2 12/2009 Smith
7,648,404 B1 1/2010 Martin
7,650,705 B2 1/2010 Donnadieu et al.
7,694,354 B2 4/2010 Philpott et al.
7,752,774 B2 7/2010 Ussher
7,757,412 B2 7/2010 Farys
7,774,956 B2 8/2010 Dua et al.
D626,322 S 11/2010 Servettaz
7,841,106 B2 11/2010 Farys
7,871,334 B2 1/2011 Young et al.
7,877,845 B2 2/2011 Signori
7,900,378 B1 3/2011 Busse
7,908,769 B2 3/2011 Pellegrini
7,947,061 B1 5/2011 Reis
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
D646,790 S 10/2011 Castillo et al.
8,056,150 B2 11/2011 Stokes et al.
8,074,379 B2 12/2011 Robinson, Jr. et al.
8,091,182 B2 1/2012 Hammerslag et al.
8,109,015 B2 2/2012 Signori
D663,850 S 7/2012 Joseph
D663,851 S 7/2012 Joseph
8,215,033 B2 7/2012 Carboy et al.
8,231,074 B2 7/2012 Hu et al.
8,231,560 B2 7/2012 Ingimundarson et al.
D665,088 S 8/2012 Joseph
8,235,321 B2 8/2012 Chen
8,245,371 B2 8/2012 Chen
8,257,293 B2 9/2012 Ingimundarson et al.
8,266,827 B2 9/2012 Dojan et al.
8,277,401 B2 10/2012 Hammerslag et al.
8,302,329 B2 11/2012 Hurd et al.
8,303,527 B2 11/2012 Joseph
8,308,098 B2 11/2012 Chen
8,353,087 B2 1/2013 Chen
8,353,088 B2 1/2013 Ha
D677,045 S 3/2013 Voskuil
D679,019 S 3/2013 Siddle et al.
8,434,200 B2 5/2013 Chen
8,490,299 B2 7/2013 Dua et al.
8,516,662 B2 8/2013 Goodman et al.
8,578,632 B2 11/2013 Bell et al.
8,652,164 B1 2/2014 Aston
8,713,820 B2 5/2014 Kerns et al.
8,984,719 B2 3/2015 Soderberg et al.
9,072,341 B2 7/2015 Jungkind
D735,987 S 8/2015 Hsu
9,101,181 B2 8/2015 Soderberg et al.
9,125,455 B2 9/2015 Kerns et al.
9,138,030 B2 9/2015 Soderberg et al.
2002/0050076 A1 5/2002 Borsoi et al.
2002/0062579 A1 5/2002 Caeran
2002/0095750 A1 7/2002 Hammerslag
2002/0129518 A1 9/2002 Borsoi et al.
2002/0148142 A1 10/2002 Oorei et al.
2002/0166260 A1 11/2002 Borsoi
2002/0178548 A1 12/2002 Freed
2003/0079376 A1 5/2003 Oorei et al.
2003/0144620 A1 7/2003 Sieller
2003/0150135 A1 8/2003 Liu
2003/0177662 A1 9/2003 Elkington et al.
2003/0204938 A1 11/2003 Hammerslag
2004/0041452 A1 3/2004 Williams
2004/0211039 A1 10/2004 Livingston
2005/0054962 A1 3/2005 Bradshaw
2005/0060912 A1 3/2005 Holzer et al.
2005/0081339 A1 4/2005 Sakabayashi
2005/0081403 A1 4/2005 Mathieu
2005/0087115 A1 4/2005 Martin
2005/0098673 A1 5/2005 Huang
2005/0102861 A1 5/2005 Martin
2005/0126043 A1 6/2005 Reagan et al.
2005/0172463 A1 8/2005 Rolla
2005/0178872 A1 8/2005 Hyun
2005/0184186 A1 8/2005 Tsoi et al.
2005/0198866 A1 9/2005 Wiper et al.
2006/0015988 A1 1/2006 Philpott et al.
2006/0135901 A1 6/2006 Ingimundarson et al.
2006/0156517 A1 7/2006 Hammerslag et al.
2006/0179685 A1 8/2006 Borel et al.
2006/0185193 A1 8/2006 Pellegrini
2006/0287627 A1 12/2006 Johnson
2007/0006489 A1 1/2007 Case, Jr. et al.
2007/0063459 A1 3/2007 Kavarsky
2007/0068040 A1 3/2007 Farys
2007/0084956 A1 4/2007 Chen
2007/0113524 A1 5/2007 Lander
2007/0128959 A1 6/2007 Cooke
2007/0169378 A1 7/2007 Sodeberg et al.
2008/0016717 A1 1/2008 Ruban
2008/0060167 A1 3/2008 Hammerslag et al.
2008/0060168 A1 3/2008 Hammerslag et al.
2008/0066272 A1 3/2008 Hammerslag et al.
2008/0066345 A1 3/2008 Hammerslag et al.
2008/0066346 A1 3/2008 Hammerslag et al.
2008/0068204 A1 3/2008 Carmen et al.
2008/0083135 A1 4/2008 Hammerslag et al.
2008/0092279 A1 4/2008 Chiang
2008/0172848 A1 7/2008 Chen
2008/0196224 A1 8/2008 Hu
2009/0019734 A1 1/2009 Reagan et al.
2009/0071041 A1 3/2009 Hooper
2009/0090029 A1 4/2009 Kishino
2009/0172928 A1 7/2009 Messmer et al.
2009/0184189 A1 7/2009 Soderberg et al.
2009/0272007 A1 11/2009 Beers et al.
2009/0277043 A1 11/2009 Graser et al.
2010/0064547 A1 3/2010 Kaplan
2010/0101061 A1 4/2010 Ha
2010/0139057 A1 6/2010 Soderberg et al.
2010/0154254 A1 6/2010 Fletcher
2010/0175163 A1 7/2010 Litke
2010/0251524 A1 10/2010 Chen
2010/0299959 A1 12/2010 Hammerslag
2010/0319216 A1 12/2010 Grenzke et al.
2011/0000173 A1 1/2011 Lander
2011/0071647 A1 3/2011 Mahon
2011/0162236 A1 7/2011 Voskuil et al.
2011/0167543 A1 7/2011 Kovacevich et al.
2011/0191992 A1 8/2011 Chen
2011/0197362 A1 8/2011 Chella et al.
2011/0225843 A1 9/2011 Kerns et al.
2011/0258876 A1 10/2011 Baker et al.
2011/0266384 A1 11/2011 Goodman et al.
2011/0303782 A1 12/2011 Hu et al.
2012/0000091 A1 1/2012 Cotterman et al.
2012/0004587 A1 1/2012 Nickel et al.
2012/0005995 A1 1/2012 Emery
2012/0023717 A1 2/2012 Chen
2012/0047620 A1 3/2012 Ellis et al.
2012/0101417 A1 4/2012 Joseph
2012/0102783 A1 5/2012 Swigart et al.
2012/0138882 A1 6/2012 Moore et al.
2012/0157902 A1 6/2012 Castillo et al.
2012/0167290 A1 7/2012 Kovacevich et al.
2012/0174437 A1 7/2012 Heard
2012/0228419 A1 9/2012 Chen
2012/0246974 A1 10/2012 Hammerslag et al.
2012/0310273 A1 12/2012 Thorpe
2013/0014359 A1 1/2013 Chen
2013/0019501 A1 1/2013 Gerber
2013/0025100 A1 1/2013 Ha
2013/0091667 A1 4/2013 Chen
2013/0091674 A1 4/2013 Chen
2013/0092780 A1 4/2013 Soderberg et al.
2013/0239303 A1 9/2013 Cotterman
2013/0012856 A1 10/2013 Hammerslag et al.
2013/0269219 A1 10/2013 Burns et al.
2013/0277485 A1 10/2013 Soderberg et al.

(56) References Cited

U.S. PATENT DOCUMENTS

| | | | |
|---|---|---|---|
| 2013/0340283 | A1 | 12/2013 | Bell et al. |
| 2013/0345612 | A1 | 12/2013 | Bannister et al. |
| 2014/0082963 | A1 | 3/2014 | Beers |
| 2014/0094728 | A1 | 4/2014 | Soderberg et al. |
| 2014/0117140 | A1 | 5/2014 | Goodman et al. |
| 2014/0123440 | A1 | 5/2014 | Capra et al. |
| 2014/0123449 | A1 | 5/2014 | Soderberg et al. |
| 2014/0208550 | A1 | 7/2014 | Neiley |
| 2014/0221889 | A1 | 8/2014 | Burns et al. |
| 2014/0257156 | A1 | 9/2014 | Capra et al. |
| 2014/0290016 | A1 | 10/2014 | Lovett et al. |
| 2014/0359981 | A1 | 12/2014 | Cotterman et al. |
| 2015/0007422 | A1 | 1/2015 | Cavanagh et al. |
| 2015/0014463 | A1 | 1/2015 | Converse et al. |
| 2015/0026936 | A1 | 1/2015 | Kerns et al. |
| 2015/0033519 | A1 | 2/2015 | Hammerslag et al. |
| 2015/0059206 | A1 | 3/2015 | Lovett et al. |
| 2015/0076272 | A1 | 3/2015 | Trudel et al. |
| 2015/0089779 | A1 | 4/2015 | Lawrence et al. |
| 2015/0089835 | A1 | 4/2015 | Hammerslag et al. |
| 2015/0101160 | A1 | 4/2015 | Soderberg et al. |
| 2015/0150705 | A1 | 6/2015 | Capra et al. |
| 2015/0151070 | A1 | 6/2015 | Capra et al. |
| 2015/0190262 | A1 | 7/2015 | Capra et al. |
| 2015/0223608 | A1 | 8/2015 | Capra et al. |
| 2015/0237962 | A1 | 8/2015 | Soderberg et al. |
| 2015/0335458 | A1 | 11/2015 | Romo |
| 2016/0120267 | A1 | 5/2016 | Burns et al. |
| 2016/0206047 | A1 | 7/2016 | Hammerslag et al. |

FOREIGN PATENT DOCUMENTS

| | | | |
|---|---|---|---|
| CH | 199766 | | 9/1938 |
| CH | 204 834 | A | 5/1939 |
| CN | 2613167 | | 4/2004 |
| CN | 201015448 | | 2/2008 |
| DE | 515 435 | C | 5/1931 |
| DE | 641976 | | 2/1937 |
| DE | 23 41 658 | | 3/1974 |
| DE | 29 00 077 | A1 | 7/1980 |
| DE | 31 01 952 | A1 | 9/1982 |
| DE | 38 13 470 | | 11/1989 |
| DE | 43 02 401 | A1 | 8/1994 |
| DE | 43 05 671 | A1 | 9/1994 |
| DE | 9308037 | | 10/1994 |
| DE | 43 26 049 | A1 | 2/1995 |
| DE | 9315776 | | 2/1995 |
| DE | 29503552.8 | | 4/1995 |
| DE | 196 24 553 | | 1/1998 |
| DE | 19945045 | A1 | 3/2001 |
| DE | 20 2010 000 354 | U1 | 6/2010 |
| DE | 11 2013 005 273 | T5 | 9/2015 |
| EP | 0 056 953 | | 8/1982 |
| EP | 0 099 504 | | 2/1984 |
| EP | 0 123 050 | | 10/1984 |
| EP | 0 155 596 | | 9/1985 |
| EP | 0 201 051 | | 11/1986 |
| EP | 0 255 869 | | 2/1988 |
| EP | 0 393 380 | | 10/1990 |
| EP | 0 589 232 | A1 | 3/1994 |
| EP | 0 589 233 | A1 | 3/1994 |
| EP | 0 614 625 | A1 | 9/1994 |
| EP | 0 651 954 | A1 | 5/1995 |
| EP | 0 679 346 | | 11/1995 |
| EP | 0 693 260 | B1 | 1/1996 |
| EP | 0 734 662 | A1 | 10/1996 |
| EP | 0 848 917 | | 6/1998 |
| EP | 0 923 965 | | 6/1999 |
| EP | 0 937 467 | | 8/1999 |
| EP | 1163860 | | 12/2001 |
| EP | 1 219 195 | | 7/2002 |
| EP | 1 236 412 | A | 9/2002 |
| EP | 2298107 | B1 | 3/2011 |
| EP | 2359708 | | 8/2011 |
| FR | 610 582 | A | 9/1926 |
| FR | 1 404 799 | | 7/1965 |
| FR | 2 019 991 | A | 7/1970 |
| FR | 2 598 292 | A1 | 11/1987 |
| FR | 2 726 440 | A1 | 5/1996 |
| FR | 2 770 379 | A1 | 5/1999 |
| FR | 2 814 919 | A1 | 4/2002 |
| GB | 189911673 | | 7/1899 |
| GB | 216400 | | 5/1924 |
| GB | 2 449 722 | A | 12/2008 |
| IT | 1220811 | | 6/1990 |
| IT | 2003 A 000197 | | 4/2003 |
| IT | 2003 A 000198 | | 3/2005 |
| JP | 51-121375 | | 10/1976 |
| JP | 53-124987 | | 3/1977 |
| JP | 54-108125 | | 2/1978 |
| JP | H02-236025 | | 9/1990 |
| JP | 6-284906 | | 2/1996 |
| JP | 08-308608 | A | 11/1996 |
| JP | 3030988 | | 11/1996 |
| JP | 3031760 | | 12/1996 |
| JP | 10-199366 | | 7/1998 |
| JP | 2004-016732 | | 1/2004 |
| JP | 2004-041666 | | 2/2004 |
| JP | 2009-504210 | | 2/2009 |
| KR | 20-0367882 | | 11/2004 |
| KR | 20-0400568 | | 8/2005 |
| KR | 10-0598627 | | 7/2006 |
| KR | 10-0953398 | | 4/2010 |
| KR | 10-1025134 | B1 | 3/2011 |
| KR | 10-1028468 | | 4/2011 |
| KR | 10-1053551 | | 7/2011 |
| WO | 94/27456 | | 12/1994 |
| WO | 95/11602 | | 5/1995 |
| WO | 1995/03720 | | 9/1995 |
| WO | 98/33408 | | 8/1998 |
| WO | 98/37782 | | 9/1998 |
| WO | 99/09850 | | 3/1999 |
| WO | 99/15043 | | 4/1999 |
| WO | 99/43231 | | 9/1999 |
| WO | 00/53045 | | 9/2000 |
| WO | 2000/76337 | A1 | 12/2000 |
| WO | 01/08525 | | 2/2001 |
| WO | 01/15559 | | 3/2001 |
| WO | 02/051511 | | 7/2002 |
| WO | 2004/093569 | | 11/2004 |
| WO | 2005/013748 | A1 | 2/2005 |
| WO | 2007/016983 | | 2/2007 |
| WO | 2008/015214 | | 2/2008 |
| WO | 2008/033963 | | 3/2008 |
| WO | 2009/134858 | | 11/2009 |
| WO | 2010/059989 | A2 | 5/2010 |
| WO | 2012/165803 | A2 | 12/2012 |
| WO | 2015/035885 | | 3/2015 |
| WO | 2015/179332 | A1 | 11/2015 |
| WO | 2015/181928 | A1 | 12/2015 |

OTHER PUBLICATIONS

ASOLO® Boot Brochure Catalog upon information and belief date is as early as Aug. 22, 1997, 12 pages.

La Sportiva, A Technical Lightweight Double Boot for Cold Environments, 1 page. Accessed on May 27, 2015. Retrieved from http://www.sportiva.com/products/footwear/mountain/spantik.

"Strength of materials used to make my Safety Harnesses," Elaine, Inc. Jul. 9, 2012. Retrieved from <https://web.archive.org/web/20120709002720/http://www.childharness.ca/strength_data.html> on Mar. 17, 2014, 2 pages.

International Search Report and Written Opinion for PCT/US2013/032326 dated Jun. 14, 2013, 27 pages.

International Preliminary Report on Patentability for PCT/US2013/032326 dated Sep. 16, 2014, 6 pages.

International Search Report and Written Opinion for PCT/US2013/057637 dated Apr. 7, 2014, 34 pages.

International Preliminary Report on Patentability for PCT/US2013/057637 dated Mar. 3, 2015, 9 pages.

International Search Report and Written Opinion for PCT/US2013/068342 dated Apr. 7, 2014, 29 pages.

(56) References Cited

OTHER PUBLICATIONS

International Preliminary Report on Patentability for PCT/US2013/068342 dated May 5, 2015, 9 pages.
International Search Report and Written Opinion for PCT/US2014/014952 dated Apr. 25, 2014, 17 pages.
International Preliminary Report on Patentability for PCT/US2014/014952 dated Aug. 11, 2015, 9 pages.
International Search Report and Written Opinion for PCT/US2014/066212 dated Apr. 22, 2015, 16 pages.
International Search Report and Written Opinion for PCT/US2014/032574 dated Oct. 31, 2014, 19 pages.
International Search Report and Written Opinion for PCT/US2014/045291 dated Nov. 6, 2014, 12 pages.
International Search Report and Written Opinion for PCT/US2014/013458 dated May 19, 2014, 12 pages.
International Preliminary Report on Patentability for PCT/US2014/013458 dated Jul. 28, 2015, 7 pages.
International Search Report and Written Opinion for PCT/US2013/068814 dated Jun. 9, 2014, 18 pages.
International Preliminary Report on Patentability for PCT/US2013/068814 dated May 12, 2015, 12 pages.
Notice of Reasons for Rejection from the Japanese Patent Office dated Feb. 26, 2015 for design application No. 2014-015570, 4 pages.
Receipt of Certificate of Design Registration No. 1529678 from the Japanese Patent Office for design application No. 2014-015570 dated Jun. 26, 2015, 1 page.
International Search Report and Written Opinion for PCT/US2014/055710 dated Jul. 6, 2015, 19 pages.
International Search Report and Written Opinion for PCT/US2014/054420 dated Jul. 6, 2015, 21 pages.
The Preliminary Rejections from the Korean Intellectual Property Office for Application No. 30-2014-34959, is not translated into English. The document requests a renaming of the application to be in accordance with Korean patent law, 5 pages total.
The Preliminary Rejections from the Korean Intellectual Property Office for Application No. 30-2014-34959, is not translated into English. The document requests a revision of the drawings to be in accordance with Korean patent law, 6 pages total.
Certificate of Design Registration No. 30-809409 on Aug. 3, 2015 from the Korean Intellectual Property Office for Appln No. 30-2015-11475, 2 pages.
Certificate of Design Registration No. 30-809410 on Aug. 3, 2015 from the Korean Intellectual Property Office for Appln No. 30-2015-11476, 2 pages.
European Search Report for EP 14168875 dated Oct. 29, 2014, 9 pages.
International Search Report and Written Opinion for PCT/US2014/020894 dated Jun. 20, 2014, 12 pages.
International Preliminary Report on Patentability for PCT/US2014/020894 dated Sep. 8, 2015, 7 pages.
International Search Report and Written Opinion for PCT/US2014/041144 dated Dec. 10, 2014, 13 pages.
International Preliminary Report on Patentability for PCT/US2014/032574 dated Oct. 6, 2015, 12 pages.
International Search Report and Written Opinion for PCT/US2014/046238 dated Nov. 21, 2014, 17 pages.
Office Action from the German Patent and Trademark Office for Appln No. 402015100191.2, regarding the title of the invention, 2 pages.
Anonymous, "Shore durometer," Wikipedia, the free encyclopedia, Mar. 10, 2012, XP002747470, Retrieved from the Internet: URL: https://en.wikipedia.org/w/index.php?title=Shore_durometer&oldid=481128180 [retrieved on Oct. 20, 2015] * shore A, shore D, durometer, polymer, rubber, gel; the whole document *, 6 pages.
Notice of Reasons for Rejection from the Japanese Patent Office dated Oct. 5, 2015 for design application No. 2015-004923, 4 pages.
"Save Tourniquet," 3 pages. Copyright 2015. Accessed on Dec. 11, 2015. Retrieved from http://www.savetourniquet.com/.
International Preliminary Report on Patentability for PCT/US2014/041144 dated Dec. 8, 2015, all pages.
Supplementary European Search Report for EP 13761841 dated Oct. 21, 2015, all pages.
Notice of Reasons for Rejection for Japanese Patent Application No. 2016-518004 dispatched Jan. 27, 2017, 9 pages.
European Search Report for EP 14 80 6796, all pages.
Invitation to Pay Additional Fees and Communication Relating to the Results of the Partial International Search Report for PCT/US2017/065355 dated Mar. 23, 2018, 19 pages.
International Search Report and Written Opinion for PCT/US2017/065355 dated May 24, 2018, 23 pages.

* cited by examiner

SYSTEM AND METHODS FOR MINIMIZING DYNAMIC LACE MOVEMENT

CROSS-REFERENCE TO RELATED APPLICATIONS

This application claims priority to Provisional U.S. Patent Application No. 62/622,719 filed Jan. 26, 2018, entitled "System and Methods for Minimizing Dynamic Lace Movement;" Provisional U.S. Patent Application No. 62/534,105 filed Jul. 18, 2017, entitled "Alternative Boot Closure System;" and Provisional U.S. Patent Application No. 62/562,161 filed Sep. 22, 2017, entitled "Variable Footwear Configurations." The entire disclosure of all of the aforementioned Provisional U.S. Patent Applications are hereby incorporated by reference, for all purposes, as if fully set forth herein.

BACKGROUND

The present disclosure is related to reel based closure devices for various articles, such as braces, medical devices, shoes, clothing, apparel, and the like. Such articles typically include some closure system, which allows the article to be placed about a body part and closed or tightened about the body part. The closure systems are typically used to maintain or secure the article about the body part. For example, shoes are typically placed over an individual's foot and a shoelace is tensioned and tied to close and secure the shoe about the foot. Conventional closure systems have been modified in an effort to increase the fit and/or comfort of the article about the body part. For example, shoe lacing configurations and/or patterns have been modified in an attempt to increase the fit and/or comfort of wearing shoes. Conventional closure systems have also been modified in an effort to decrease the time in which an article may be closed and secured about the body part. These modifications have resulted in the use of various pull cords, straps, and tensioning devices that enable the article to be quickly closed and secured to the foot.

BRIEF DESCRIPTION

The embodiments herein describe reel based closure devices that may be used with an article, such as footwear, to close and tighten the article, such as tightening the footwear about a user's foot. In some of the embodiments described herein, the reel based closure device, and/or another component of a lacing system, may be configured to minimize dynamic movement of a tension member or lace within the system. According to one aspect, a reel based closure device includes a housing component, a spool, and a tightening component. The housing component includes a bottom member that has a channel that is defined in a bottom surface of the bottom member. the housing component also includes a cylindrical wall that extends upward from the bottom member to define an interior region of the housing component. The spool is rotatably positioned within the interior region of the housing component. The spool is configured so that a tension member is windable about the spool. The tightening component is rotatably coupled with the housing component and is operably coupled with the spool so that an operation of the tightening component causes the spool to rotate within the interior region of the housing component to wind the tension member about the spool. The channel of the bottom member is configured so that the tension member is routed from the housing component and through the channel and so that tension member crosses itself within the channel.

The reel based closure device may also include a base component that is releasably coupleable with the bottom member of the housing component to attach the reel based closure device with an article. The base component may include an aperture that is aligned with the channel of the bottom member when the housing component is coupled with the base component. The aperture may enable the tension member to be routed from the housing component to the channel of the bottom member. The channel of the bottom member may be a U-shaped channel and the U-shaped channel may extend from a first side of the bottom member to a second side of the bottom member. Opposing sides of the U-shaped channel have an arcuate or curved shape. The channel may be configured so that at the crossing of the tension member, the tension member is compressed between a surface of the channel and a material of an article that the reel based closure is coupled with. The channel may be made of a material that frictionally engages with the tension member.

According to another aspect, a reel based closure device includes a housing component, a spool, and a tightening component. The housing component has an interior region within which one or more components of the reel based closure device are positioned, such as the spool. The spool is rotatably positioned within the interior region of the housing component and is configured so that a tension member is windable about the spool. The tightening component is rotatably coupled with the housing component and is operably coupled with the spool so that an operation of the tightening component causes the spool to rotate within the interior region of the housing component to wind the tension member about the spool. The housing component is configured so that the tension member is routed from the housing component axially below the housing component's interior region to a lace path of the tension member.

In one embodiment, the housing component includes a channel through which the tension member is inserted to route the tension member axially below the housing component's interior region. The channel may be defined or formed on a bottom surface of the housing component. In some embodiments, the channel is a U-shaped channel that is defined or formed on the bottom surface of the housing component. The U-shaped channel may extend from a first side of the housing component to a second side of the housing component. Opposing sides of the U-shaped channel may have an arcuate or curved shape. The reel based closure device may further include a base component that is releasably coupleable with the housing component to attach the reel based closure device with an article. The base component typically includes an aperture that is aligned with the channel of the housing component so that when the housing component is coupled with the base component, the tension member is insertable through the base component's aperture to the channel of the housing component.

According to another aspect, a method of assembling a reel based closure device includes providing a housing component that includes a bottom member and an exterior wall that extends upward from the bottom member to define an interior region of the housing component. The bottom member includes a channel that is defined or formed on or within a bottom surface of the bottom member. The channel is configured so that a tension member is positionable within the channel to route the tension member axially below the interior region of the housing component. The method also includes inserting a spool within the interior region of the housing component and coupling a tightening component with the housing component. The spool is configured so that the tension member is windable about the spool and the tightening component is configured so that an operation of the tightening component causes the spool to rotate within the interior region of the housing component to wind the tension member about the spool.

In some embodiments, the method also includes attaching the reel based closure device to a shoe. The method may further include coupling the housing component with a base component that is attached to a shoe to releasably coupleable the housing component with the shoe. The base component may include an aperture that is aligned with the channel of the housing component when the housing component is coupled with the base component. In such instances, the method may also include inserting the tension member through the aperture of the base component and through the channel of the housing component. The channel may be a U-shaped channel that is defined or formed on or within the bottom surface of the housing component. The U-shaped channel may extend from a first side of the housing component to a second side of the housing component. Opposing sides of the U-shaped channel have an arcuate or curved shape.

BRIEF DESCRIPTION OF THE DRAWINGS

The present invention is described in conjunction with the appended figures.

Figure 1A:
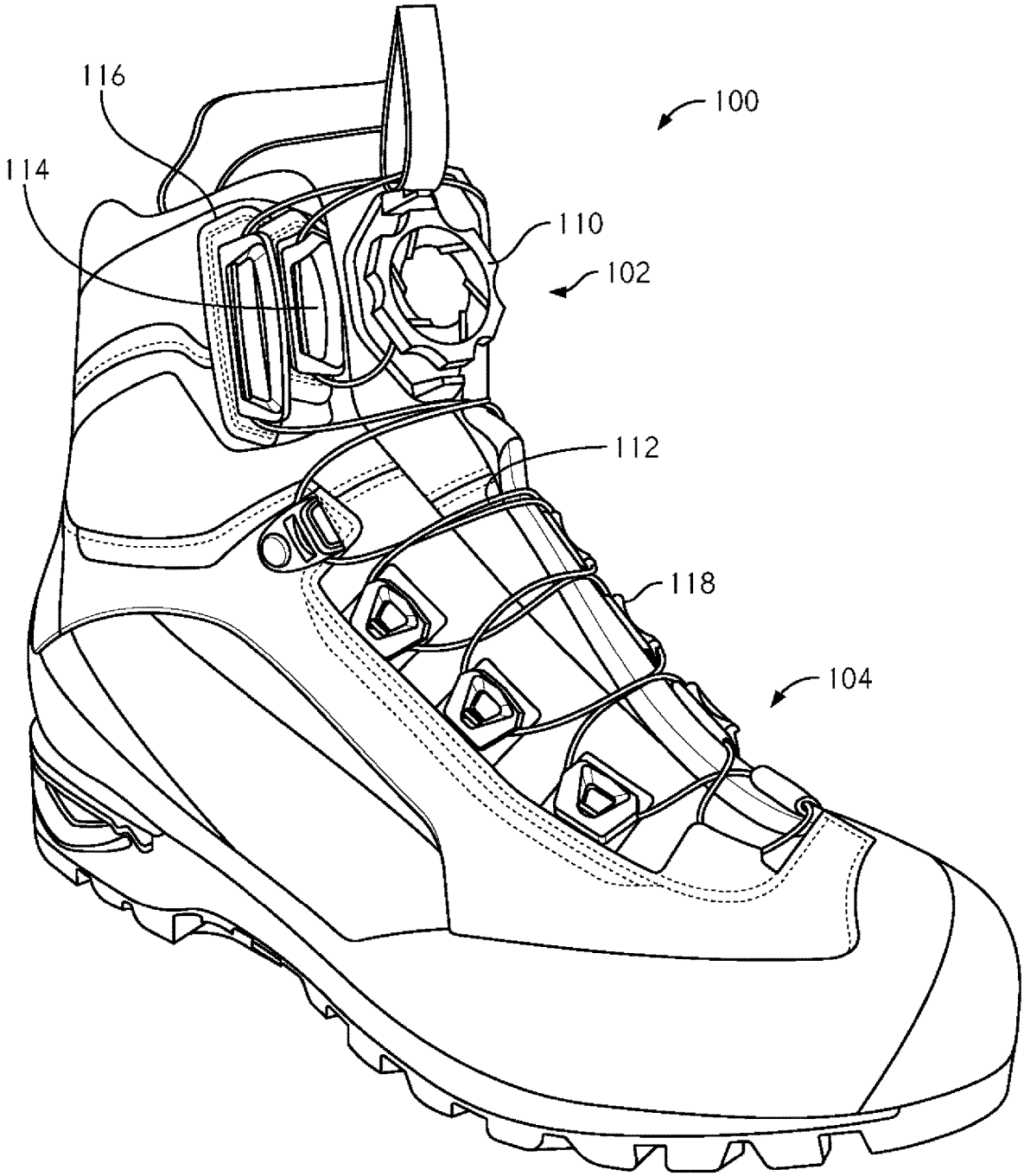
FIGS. 1A-B illustrate an embodiment of a lace guide configuration that may be employed to reduce dynamic lace movement in footwear.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE DRAWINGS

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Some of the embodiments described herein provide footwear configurations that may be employed to minimize the amount of "dynamic movement" of a lower friction lace or tension member about an article. The lower friction lace or tension member that is described herein is typically used in reel based closure devices or systems, but may also be used in other tensioning systems, such as pull-cord systems, automated or motorized closure systems, and the like. The lower friction lace or tension members of such systems may beneficially allow the article to be easily closed and/or tightened, but may easily slip or move after such tightening, which in some instances is not desired.

The term dynamic movement as used herein refers to the ability of the lace or tension member to shift and move between zones of the article. The lace or tension members is an elongate structure that is typically or cord, rope, wire, or other similar material that is capable of being tensioned, often to close and/or tighten the article. The disclosure herein focuses primarily on the configuration of "lace guides" or lace routing configurations that are able to minimize the dynamic movement of the lace or tension member (hereinafter tension member) about the article. A lace guide is a component that is positioned about the article and that is employed to direct or route the tension member about a path along the article. Common lace guides include eyelets, hooks, bosses, looped material segments, or other components about which the tension member may be positioned. In a particular embodiment, the lace guide may be a component that includes a channel within which the tension member is positioned. The lace guide may be formed of various plastic and/or metallic materials. The minimization of the dynamic movement in the system may be due to the introduction of additional lace guides that frictionally engage with the tension member to prevent movement of the tension member about the article. The position of the lace guides in the system may further increase the frictional engagement of the tension member with the lace guides, thereby reducing the ability of the tension member to move about the article.

The embodiments described herein that are directed to reducing dynamic lace movement are particularly useful in footwear (e.g., boots and shoes), and particularly in footwear that includes a high ankle or cuff. In footwear, the lower friction tension member may move between the ankle portion of the footwear and the toe portion of the footwear due to movement of the user's foot within the footwear. For example, walking or running in the footwear may cause the lower leg and ankle to press against the ankle portion of the footwear, which may increase the tension in tension member near the ankle. The increased tension in the tension member may cause the tension member to move or slide within the lace guides, which may cause the ankle portion of the footwear to open or widen and may simultaneously cause the toe portion to constrict about the user's toes. This dynamic movement of the tension member may be more pronounced when the footwear includes a high ankle or cuff because the high ankle or cuff is fit around the lower leg. The dynamic movement of the tension member may result in the user feeling like the footwear is not fully tightened or closed about the foot.

Other embodiments described herein provide alternative closure systems, mechanisms, and/or configurations for improving the fit and comfort of footwear, such as a boot. Specifically, the alternative closure systems/configurations improve the ease of entry into and/or exit from the footwear. For example, an individual may find it difficult to enter or exit a boot having a relatively tall ankle portion or a tight fitting collar. An alternative closure mechanism situated, for example, on the medial side of the boot can allow the collar of the boot to expand and provide for quick and easy entry or exit from the boot. The alternative closure systems/configurations also provide additional opportunities for adjusting the tightness or fit of at least one portion of footwear. For example, the alternative closure system can be affixed with specific lacing configurations that enable a user to adjust the tightness or comfort and fit of one or more specific regions of the footwear.

In some embodiments the alternative closure systems/configurations may enable the collar and/or ankle portion of the footwear to expand or open up. Expansion may be accomplished by use of an opening and a flap located on a side and/or a back of the footwear. For example, the medial side of a boot may have an opening and flap that overlaps the ankle portion. The opening and flap allow expansion of the ankle section, which may otherwise be constrictive and difficult to fit about a foot. The opening and flap may minimize the difficulty in donning the footwear by enabling the ankle portion to open up and expand. The alternative closure system may be positioned about the opening and flap to enable a user to quickly and conveniently close and secure the footwear about a user's foot.

In one embodiment, the alternative closure system may be a reel based system for tightening a lace or tension member that is routed or guided about a lace path that spans at least a portion of the opening of the footwear. The lace path may include a bottom end that is positioned near a sole of the footwear, a top end that is positioned opposite the bottom end, and a mid-portion that is roughly equidistant from the top end and the bottom end. The reel based system includes a tensioning mechanism and a plurality of guide members that are coupled with the footwear. The reel based system also includes a lace or tension member that is operationally coupled with the tensioning mechanism and that is routed about the footwear along the lace path via a plurality of guide members. The lace includes a first portion and a second portion that may each be operationally coupled with the tensioning mechanism so that operation of the tensioning mechanism simultaneously tensions both the first portion and the second portion. In other embodiments, the first portion of the lace may be operationally coupled with the tensioning mechanism while the second portion of the lace is terminated or coupled with the footwear or another component. In such embodiment, operation of the tensioning mechanism only directly tensions the first portion of the lace and not the second portion of the lace.

Other embodiments described herein provide footwear configurations that may be quickly and easily varied to provide a desired fit about a user's foot. In particular, the position and/or orientation of various components of the footwear may be quickly and easily adjusted to vary the fit of the footwear about the user's foot. In some instances, the fit of the footwear may be adjusted to provide a desired level of support or comfort, such as when the user in engaging in a sporting event, outdoor activity, leisure activity, and the like. In other instances, the fit and/or configuration of the footwear may be adjusted to determine an optimal placement of one or more components and/or how the placement of one or more components may affect the fit and/or functionality of the shoe.

In many of the embodiments, the footwear is closed and/or tightened via a tensioning mechanism and a lace or tension member. The footwear typically includes one or more guides or components (hereinafter guides) that route or direct the tension member or lace (hereinafter lace) about a path of the footwear, such as along the footwear's tongue. The lace is tensioned via operation of the tightening mechanism. Tensioning of the lace causes the article to close and/or tighten about the user's foot. Specifically, the lace may be routed along and across an opening of the footwear so that tensioning of the lace urges one side of the opening toward an opposite side of the opening in order to close and tighten the footwear about the foot.

The guide is generally positioned near the opening of the footwear, such as on opposing sides of an eyestay, and directs, routes, or guides the lace along and/or across the opening. The guide may be made of a low friction material that minimizes frictional engagement of the lace and guide. In some instances, the guides may be formed of a fabric or webbing type materials that is folded over to form a loop and/or made of one or more plastic or rigid materials.

As briefly described above, the lace is tensioned via operation of the tensioning mechanism. In a specific embodiment, the tensioning mechanism is a reel based closure system. The reel based closure system includes a knob that may be grasped and rotated by a user to tension the lace. Exemplary embodiments of reel based closure devices are further described in U.S. patent application Ser. No. 13/098,276, filed Apr. 29, 2011, titled "Reel Based Lacing System", U.S. patent application Ser. No. 14/328,521, filed Jul. 10, 2014, titled "Closure Devices Including Incremental Release Mechanisms and Methods Therefor," and U.S. patent application Ser. No. 12/623,362, filed Nov. 20, 2009, titled "Reel Based Lacing System", the entire disclosures of which are incorporated by reference herein.

In another embodiment, the tensioning mechanism may be a motorized device or mechanism that tensions the tension member or lace. An exemplary embodiment of a motorized mechanism that may be used to tension the lace is further described in U.S. patent application Ser. No. 14/015,807, filed Aug. 30, 2013, titled "Motorized Tensioning System for Medical Braces and Devices", the entire disclosure of which is incorporated by reference herein.

In yet other embodiments, the tensioning mechanism may be a pull cord type device that is configured to be grasped and pulled by a user to tension the lace. Exemplary pull cord devices are further described in U.S. patent application Ser. No. 14/166,799, filed Jan. 28, 2014, and titled "Lace Fixation Assembly and System", the entire disclosure of which is incorporated by reference herein. For ease is describing the various embodiments herein, the tensioning mechanism will be referred to generally as a "reel assembly" or "reel based closure device".

In some embodiments, multiple alternative systems may be employed to allow the user to customize the tightness and fit of the footwear, such as for comfort. Specifically, multiple reel based systems may be used to tighten and secure different portions or regions of the boot. For example, a user may desire that the ankle portion of the footwear be relatively loose in comparison with a calf or toe portion of the footwear. The use of multiple separate reel based enable these separate portions of the footwear to be differentially tightened, thereby provided a customizable and desired fit of the footwear. In other embodiments, the alternative closure system may be used in addition to traditional laces, or another closure system, that is positioned on the front of the footwear.

For convenience in describing the various embodiments, the remainder of the description will focus on the article typically being an article of footwear, although it should be realized that the configurations and/or other aspects described herein may be equally applicable to other articles, such as bags, boots, packs, helmets, jackets, articles of clothing or apparel, and the like.

Having describe various aspects of the embodiments generally, additional features and aspects will be readily recognized with reference to the description of the various drawings provided herein below.

Dynamic Lace Movement Minimization

Figure 1B:
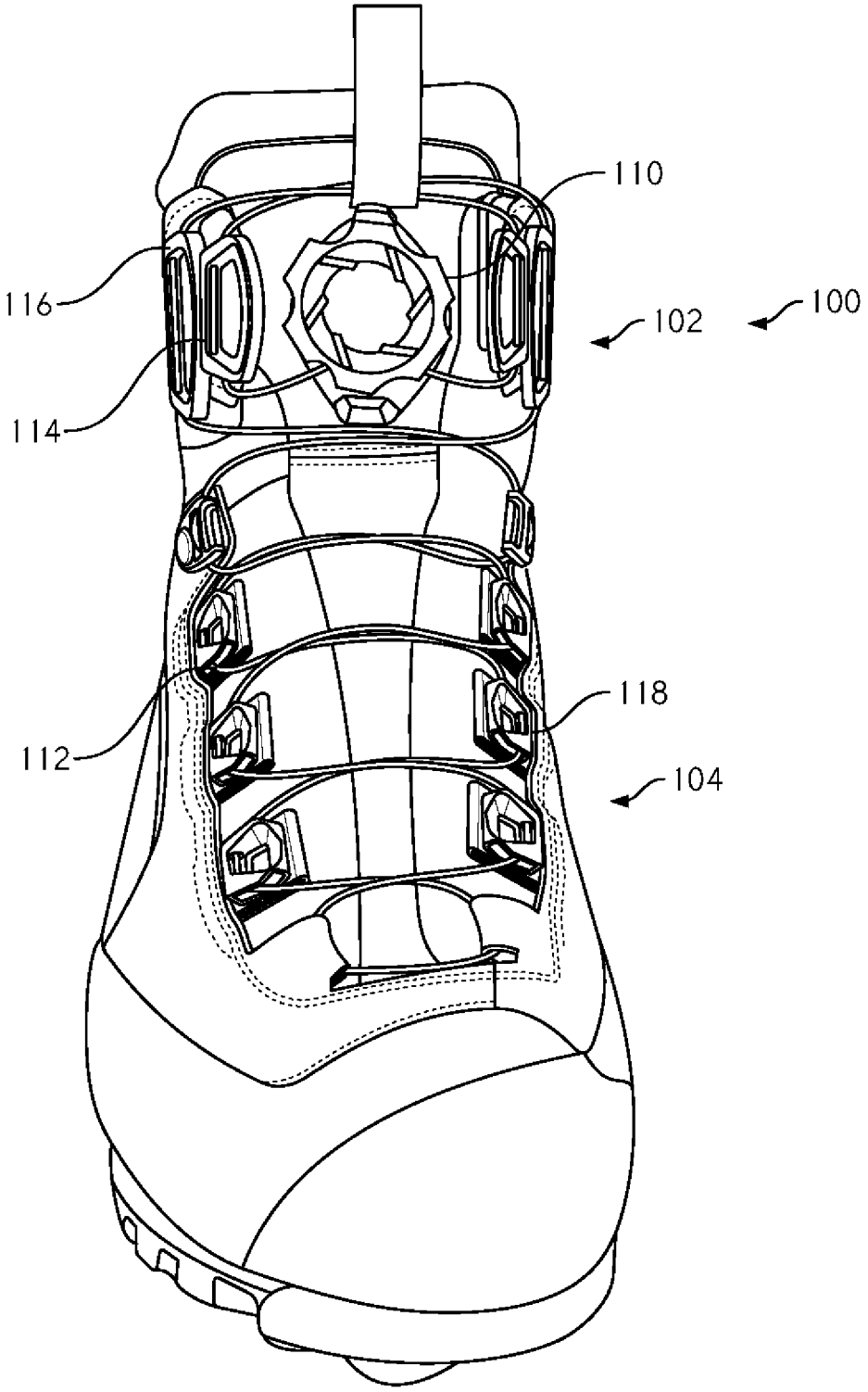

Referring now to FIGS. 1A-B, illustrated is a shoe or footwear 100 that includes a high ankle or upper cuff 102 and a toe portion or forefoot 104. The footwear 100 also includes a reel based closure device 110 that is operably coupled with a tension member 112 so that operation of the reel based closure device 110 (e.g., rotation of a knob) causes the tension member 112 to be tension, such as by winding the tension member 112 about an internal spool (not shown) of the reel based closure device 110. The tension member 112 is routed or directed about a path along the footwear 100 via lace guides that are positioned on opposing sides of an opening of the footwear 100. The lace guides include lower lace guides 118 that are positioned near the forefoot 104 and upper lace guides, 114 and 116, that are positioned near the upper cuff 102.

As described previously, when a user walks or runs in conventional high ankle footwear, the lower leg typically presses against the upper cuff, which may increase the tension in the tension member near the upper cuff. The increased tension in the tension member may cause the tension member to move or slide within the lace guides, which may cause upper cuff to widen and the forefoot to constrict about the user's toes. When the lower leg ceases to press against the upper cuff, the upper cuff may relax and close or constrict while the forefoot opens or widens to some degree. The result may be a constant constriction and opening of different portions of the footwear (e.g., the upper cuff and forefoot) about a user's foot, which may be somewhat uncomfortable and/or irritating to the user.

The configuration of the footwear 100 of FIGS. 1A-B minimizes this dynamic movement of the tension member 112, which results in significantly less constriction and opening of the footwear 100 about the foot. In particular, the footwear 100 employs a lace guide configuration in the upper cuff 102 that adds friction into the system and thereby minimizes movement, shifting, or sliding of the tension member 112 about the footwear 100. The lace guide configuration includes a first lace guide pair 114 and a second lace guide pair 116 that are each positioned on opposing sides of the reel based closure device 110 and on opposing eyestay edges of an upper of the footwear 100. The first lace guide pair 114 and second lace guide pair 116 have a stacked configuration, which means that the second lace guide pair 116 is positioned directly laterally on the side of the first lace guide pair 114. The first lace guide pair 114 typically has a longitudinal length that is greater than the second lace guide pair 116, which ensures that the positioning of the first lace guide pair 114 in front of the second lace guide pair 116 does not interfere with the tension member 112 being accessible to the second lace guide pair 116. In some embodiments, the first lace guide pair 114 and second lace guide pair 116 may be separated components while in other embodiments the first lace guide pair 114 and second lace guide pair 116 may be a unitary or single component.

In routing the tension member 112 about the lace path, the tension member 112 exits the reel based closure device 110 near a bottom end that is positioned closer to the forefoot 104. The tension member 112 is then routed through the first lace guide pair 114 and then immediately to the second lace guide pair 116. The tension member 112 is routed from the second lace guide pair 116 to the forefoot 104 via the lace guides 118 that are positioned near the forefoot 104. The reel based closure device 110 is oriented so that the lace exits are near the forefoot 104 to ensure that when the tension member 112 exits the second lace guide pair 116, the tension member 112 is positioned near the forefoot 104 rather than at the top of the upper cuff 102.

The use of the first lace guide pair 114 and second lace guide pair 116 adds an additional friction element to the system, which helps reduce movement or sliding of the tension member 112 due to the increased frictional engagement of the tension member 112 with the lace guides. In addition, the stacked configuration of the first lace guide pair 114 and second lace guide pair 116 results in the tension member 112 opposing opening or widening of the upper cuff 102 since the tension force is directed essentially opposite of a force that would widen the upper cuff 102. The multiple crossings of the tension member 112 about the upper cuff 102 also increases or amplifies the tension force in the upper cuff 102, which aids in keeping the upper cuff 102 closed and tightened about the lower leg. The stacked configuration of the first lace guide pair 114 and second lace guide pair 116 also results in a more tortuous path of the tension member 112, which renders the opening or widening of the upper cuff 102 more difficult.

Figure 2A:
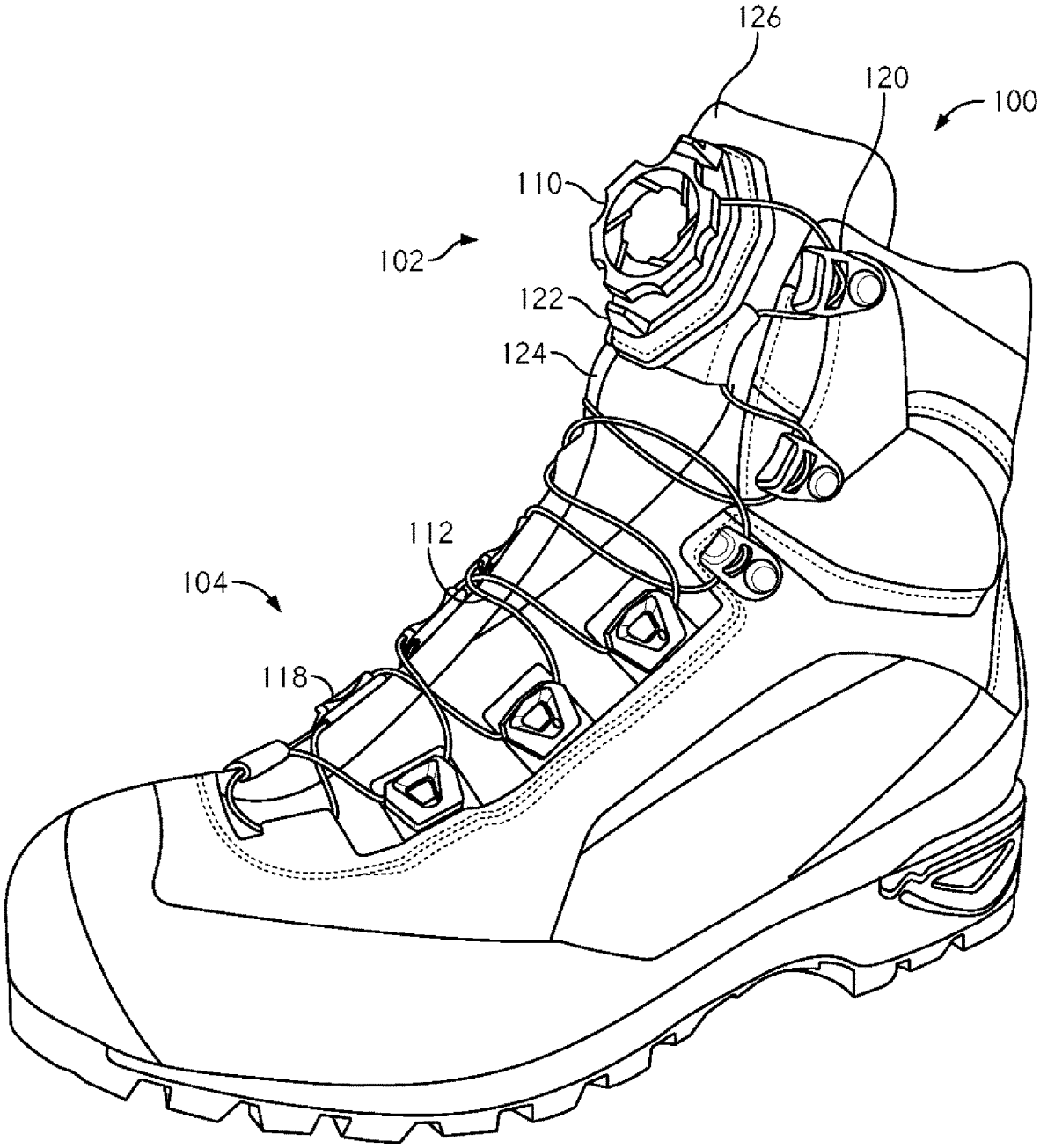
FIGS. 2A-B illustrate another embodiment of a lace guide configuration that may be employed to reduce dynamic lace movement in footwear.
Figure 2B:
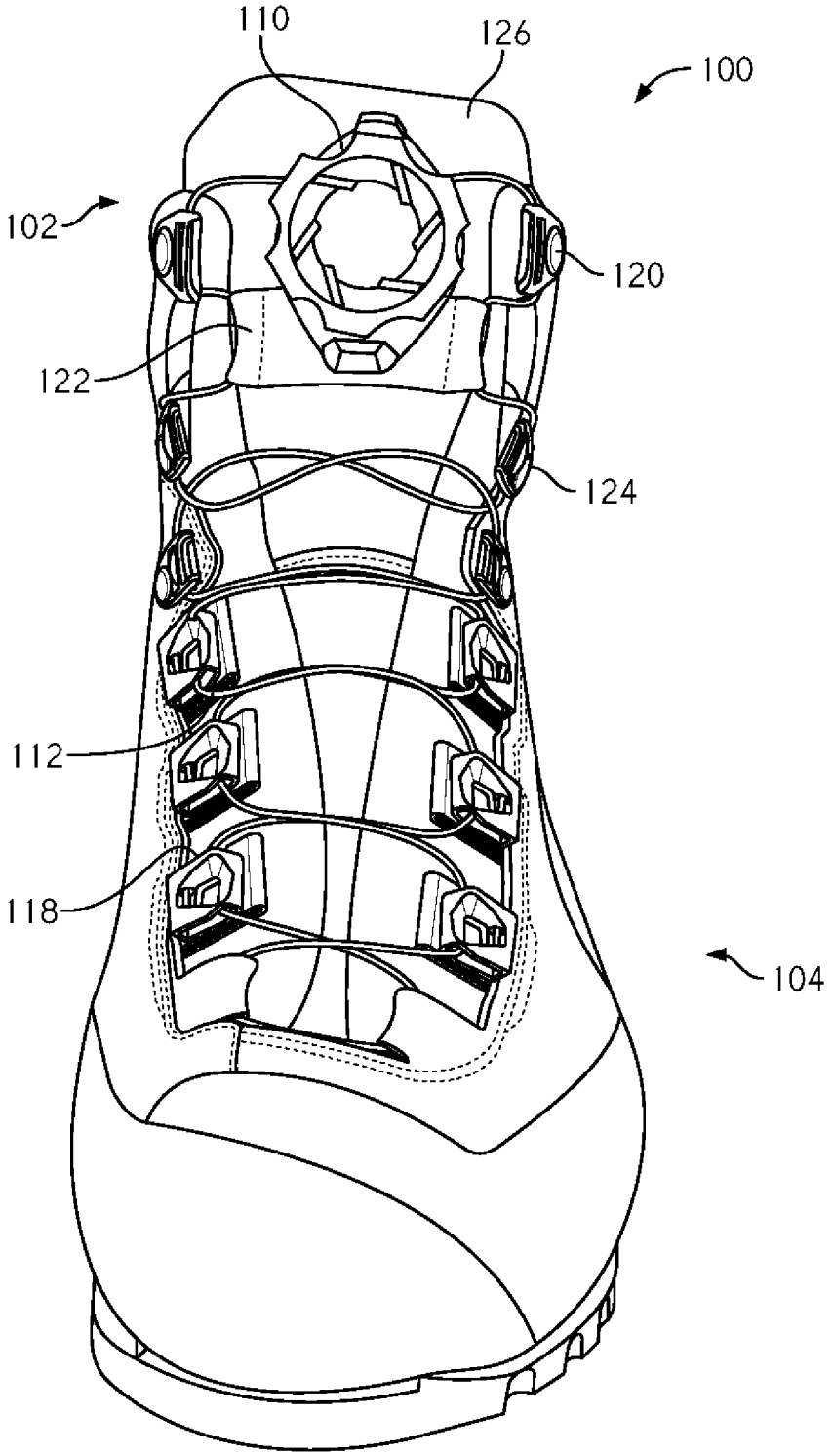

Referring now to FIGS. 2A-B, illustrated is another embodiment of lace guide configurations that may be employed to reduce dynamic lace movement in the footwear 100. In particular, the footwear 100 employs the use of a second lace guide pair 122, but the second lace guide pair 122 is not in a stacked configuration with the first lace guide pair 120. Rather, the first lace guide pair 120 is positioned near the top end of the upper cuff 102 while the second lace guide pair 122 is positioned closer to the forefoot 104. The second lace guide pair 122 is also positioned on the footwear's tongue 126 rather on the eyestay edge of the upper. The footwear 100 also employs a third lace guide pair 124 that is positioned on the eyestay edge of the upper closer to the forefoot 104 that the second lace guide pair 122.

The tension member 112 is routed from the reel based closure device 110 to the first lace guide pair 120. The lace is routed from the first lace guide pair 120 to the second lace guide pair 122 positioned on the footwear's tongue 126 and is then routed from the second lace guide pair 122 to the third lace guide pair 124. The tension member 112 is routed from the third lace guide pair 124 to the lace guides 118 that are positioned near the forefoot 104. The use of the first lace guide pair 120, the second lace guide pair 122, and the third lace guide pair 124 provides a tortuous path for the tension member 112, which increases the frictional engagement of the tension member and thereby reduces movement, shifting, or sliding of the tension member 112 about the footwear 100. The positioning of the second lace guide pair 122 on the footwear's tongue 126 may also counteract some of the forces that cause the upper cuff 102 to open or widen. For example, as the tension member 112 is tensioned and the upper cuff 102 begins to widen, the lace guide pair 122 may press the tongue 126 inward and against the user's lower leg, which may result in a sensation of the fit of the footwear 100 being relatively unchanged. As illustrated in FIGS. 2A-B, the lace exits of the reel based closure device 110 may be positioned near the top of the upper cuff 102 to increase the path of the tension member 112 about the footwear 100, which may increase the frictional engagement of the tension member 112 within the system.

Figure 3A:
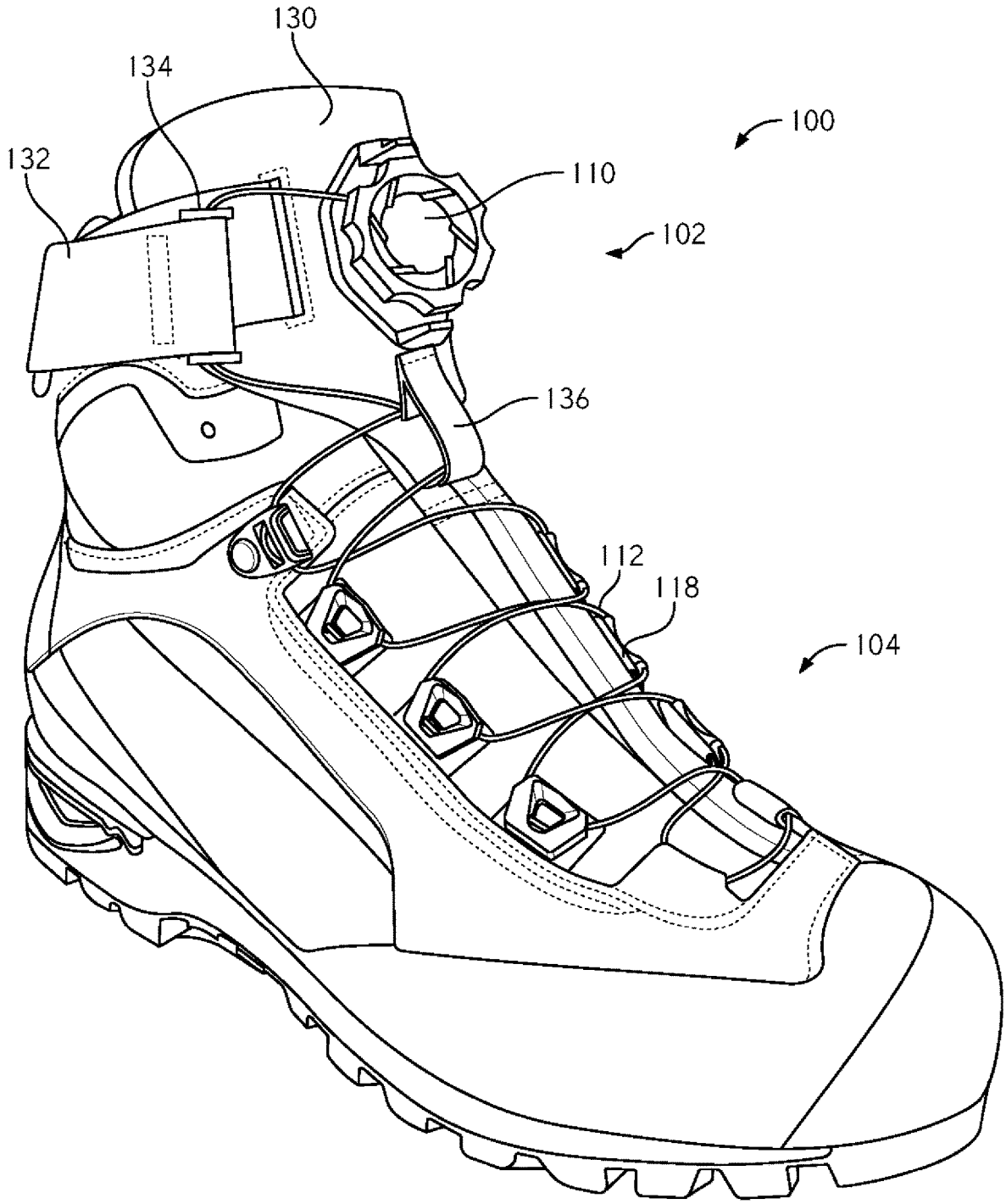
FIGS. 3A-C illustrate another embodiment of a lace guide configuration that may be employed to reduce dynamic lace movement in footwear.
Figure 3B:
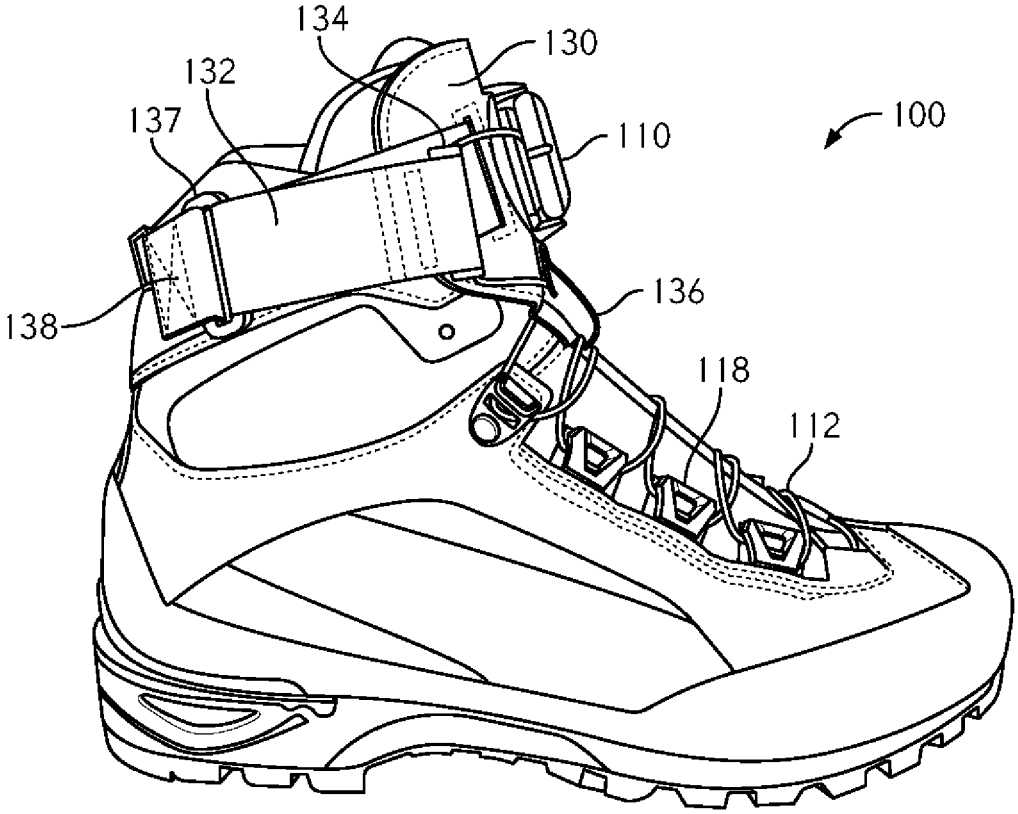
Figure 3C:
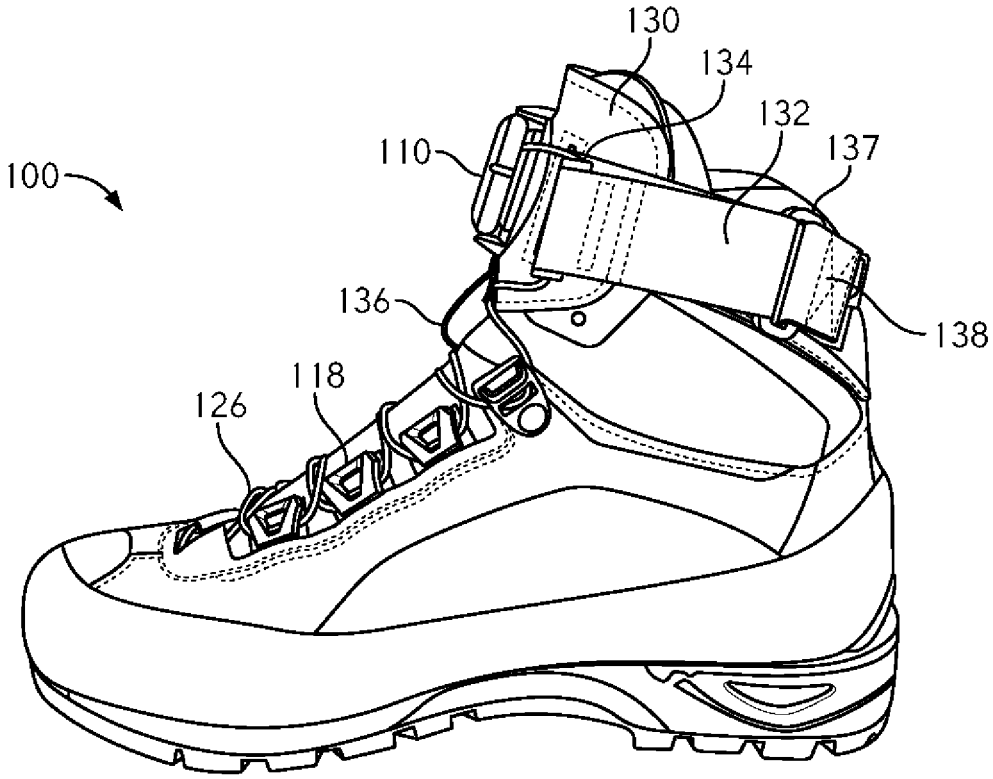

Referring now to FIGS. 3A-C, illustrated is another embodiment of a configuration that may be employed to reduce dynamic lace movement in the footwear 100. In particular, the footwear 100 includes a panel 130 that is positioned over the upper cuff 102 of the footwear 100. The panel 130 may be free floating atop the upper cuff 102 or may be fixed to the upper cuff 102 as desired. The reel based closure device 110 is positioned on the front surface of the panel 130 and the panel 130 includes lace guides that couple with the tension member 112. Specifically, a strap 132 is attached to the medial and lateral sides of the panel 130 and is fixed to the medial and lateral sides of the footwear 100 as shown in FIGS. 3B-C. The straps 132 are positioned through D-rings 137 that are fixed or anchored to the footwear 100 via stitching 138 or another means of coupling.

The straps 132 are moveable or slidable within the D-rings 137 so that tensioning of the tension member 112 causes the distal end of each strap 132 to move toward the footwear's tongue, which causes the panel 130 to move rearward and against the user's lower leg. The distal end of each strap 132 includes an elongate lace guide 134 that directs the tension member 112 from the reel based closure device toward the forefoot 104 of the footwear. The term "elongate" means that the lace guide 134 has a width and lace channel that is substantially longer than a typical lace guide, such as the lace guides 118 that are positioned near the forefoot 104. The elongate lace guide 134 is attached to the distal end of the straps 132 by forming a loop in the distal end of the straps 132 and attaching the strap to itself. Various other means of coupling may be used to attach the elongate lace guide 134 to the strap 132.

The panel 130 also includes a pull tab or guide 136 that is positioned on a portion of the panel 130 that protrudes or extends toward the forefoot 104 of the footwear 100. The pull tab or guide 136 is positioned on the panel 130 so that it is roughly centered in relation to the footwear's tongue. The pull tab or guide 136 may be formed of a plastic component or formed from folding a fabric material to form a loop. The tension member 112 is positioned through a channel that is formed in the pull tab or guide 136. The channel guides or directs the tension member 112 from the panel 130 and to the guides 118 that are positioned near the forefoot 104. The pull tab or guide 136 is also arranged so that it may be easily grasped by a user's fingers to pull the panel 130 away from the upper cuff 102 of the footwear 100, which aids in opening the footwear 100.

The panel 130 and strap 132 help close the upper cuff 102 around the lower leg and keep it from opening as the footwear 100 is flexed forward due to the user walking and the lower leg contacting the upper cuff 102. The closure of the upper cuff 102 about the lower leg is due mainly to the straps 132 being positioned around the collar of the footwear 100. The straps 132 may aid in minimizing dynamic movement of the tension member 112 by adding an additional friction element in the system. The straps 132 may be made of a material with an increased frictional coefficient so that the panel 130 frictionally engages with itself and thereby helps minimize shifting of the components of the footwear.

Figure 4A:
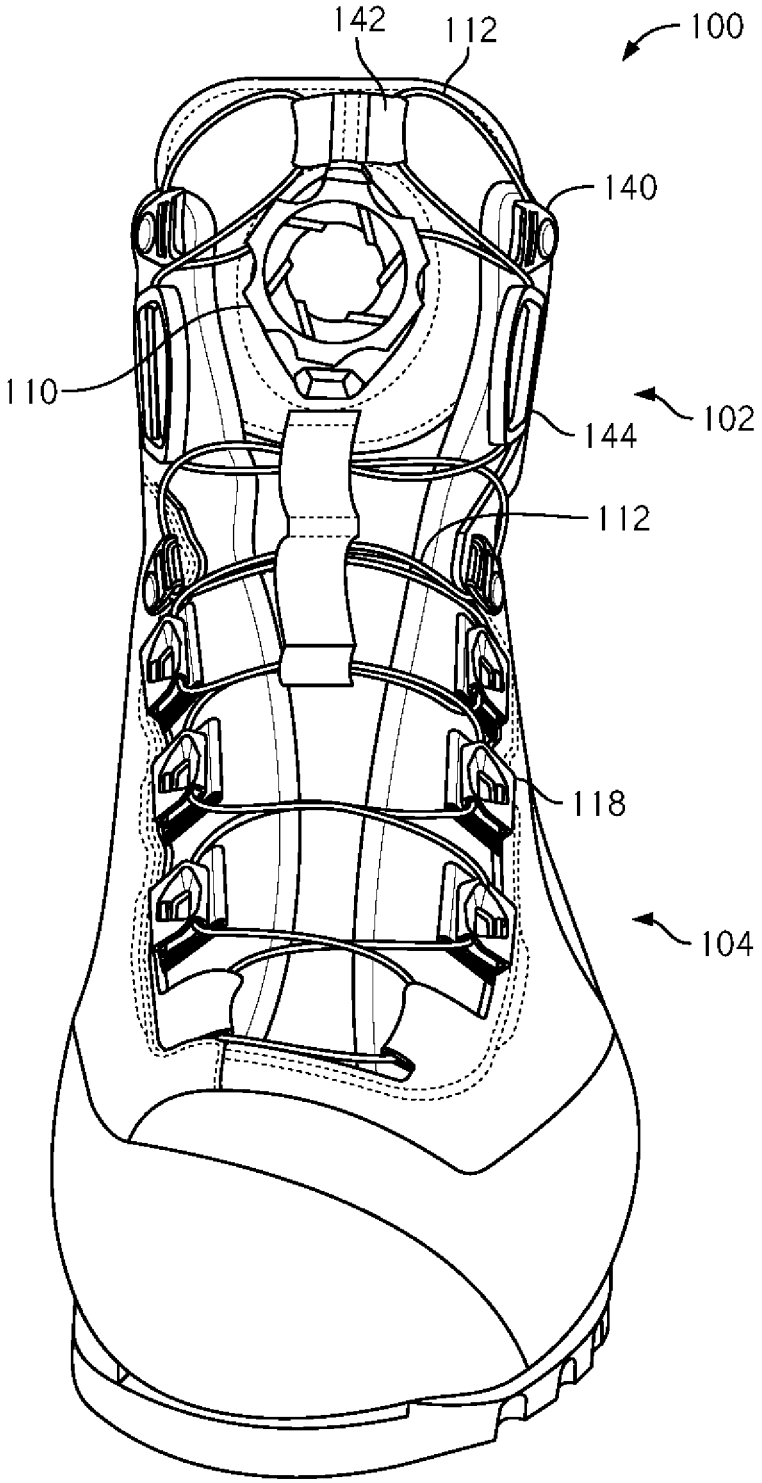
FIGS. 4A-B illustrate another embodiment of a lace guide configuration that may be employed to reduce dynamic lace movement in footwear.
Figure 4B:
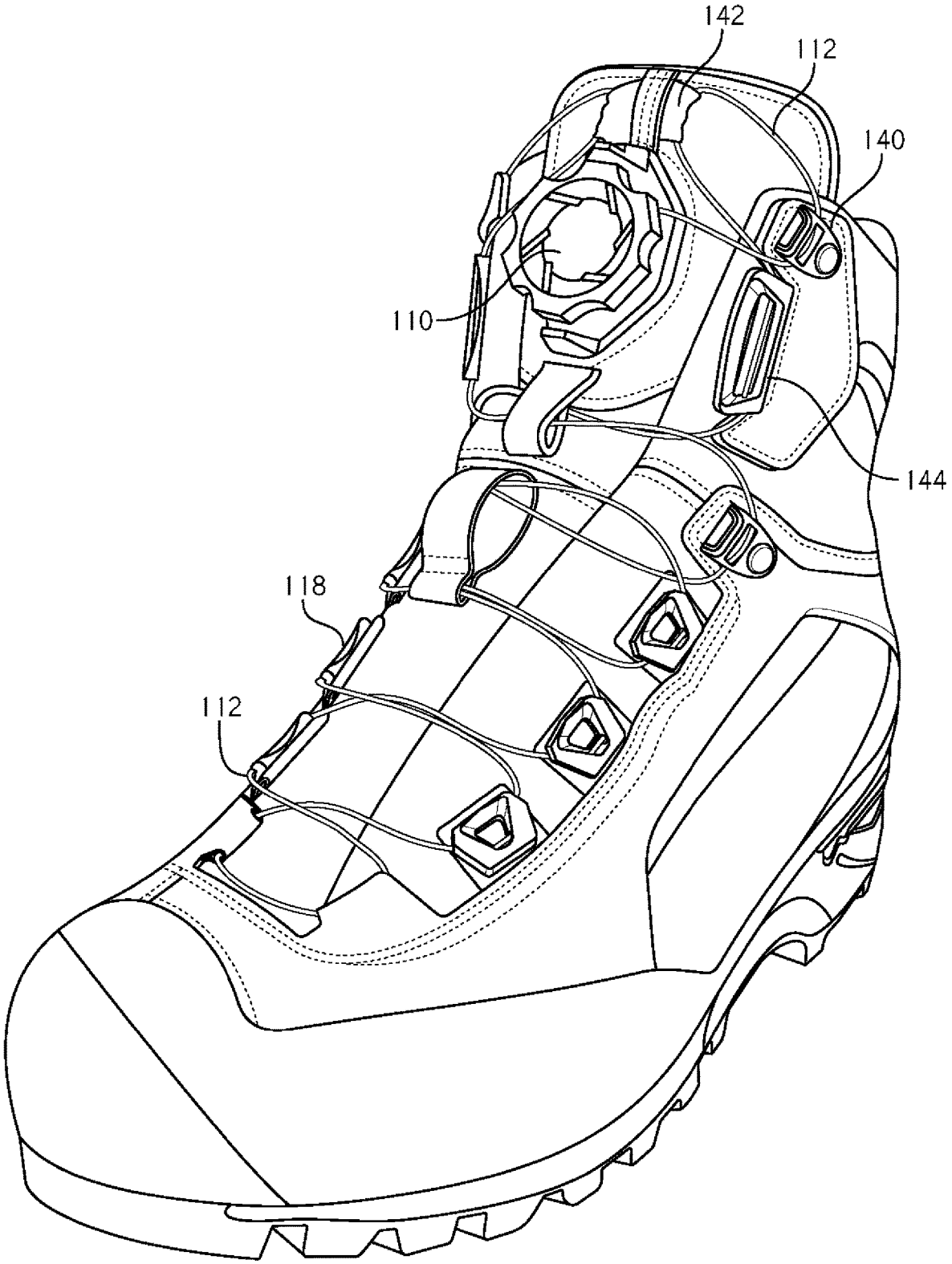

Referring now to FIGS. 4A-B, illustrated is another embodiment of a configuration that may be employed to reduce dynamic lace movement in the footwear 100. In particular, the footwear 100 includes a pair of looped webbing or fabric guides 142 that are positioned in the upper cuff 102 above the reel based closure device 110. The footwear configuration is similar to that illustrated in FIG. 2A except that the fabric guides 142 are disposed above the reel based closure device 110 rather than below the device 110. The tension member 112 is routed from the reel based closure device 110 to a first lace guide 140 and is routed therefrom to the fabric guide 142. From the fabric guide, the tension member 112 is routed to a second lace guide 144 and then is routed to the forefoot 104 via the guides 118. The use of the fabric guide 142 above the reel based closure device 110 provides a tortuous path for the tension member 112, which increases the frictional engagement of the tension member and thereby reduces movement, shifting, or sliding of the tension member 112 about the footwear 100. The positioning of the fabric guides 142 on the footwear's tongue and within the upper cuff 102 may also counteract some of the forces that cause the upper cuff 102 to open or widen, such as by pressing the tongue 126 inward and against the user's lower leg when the tension member 112 is tensioned.

Figure 5A:
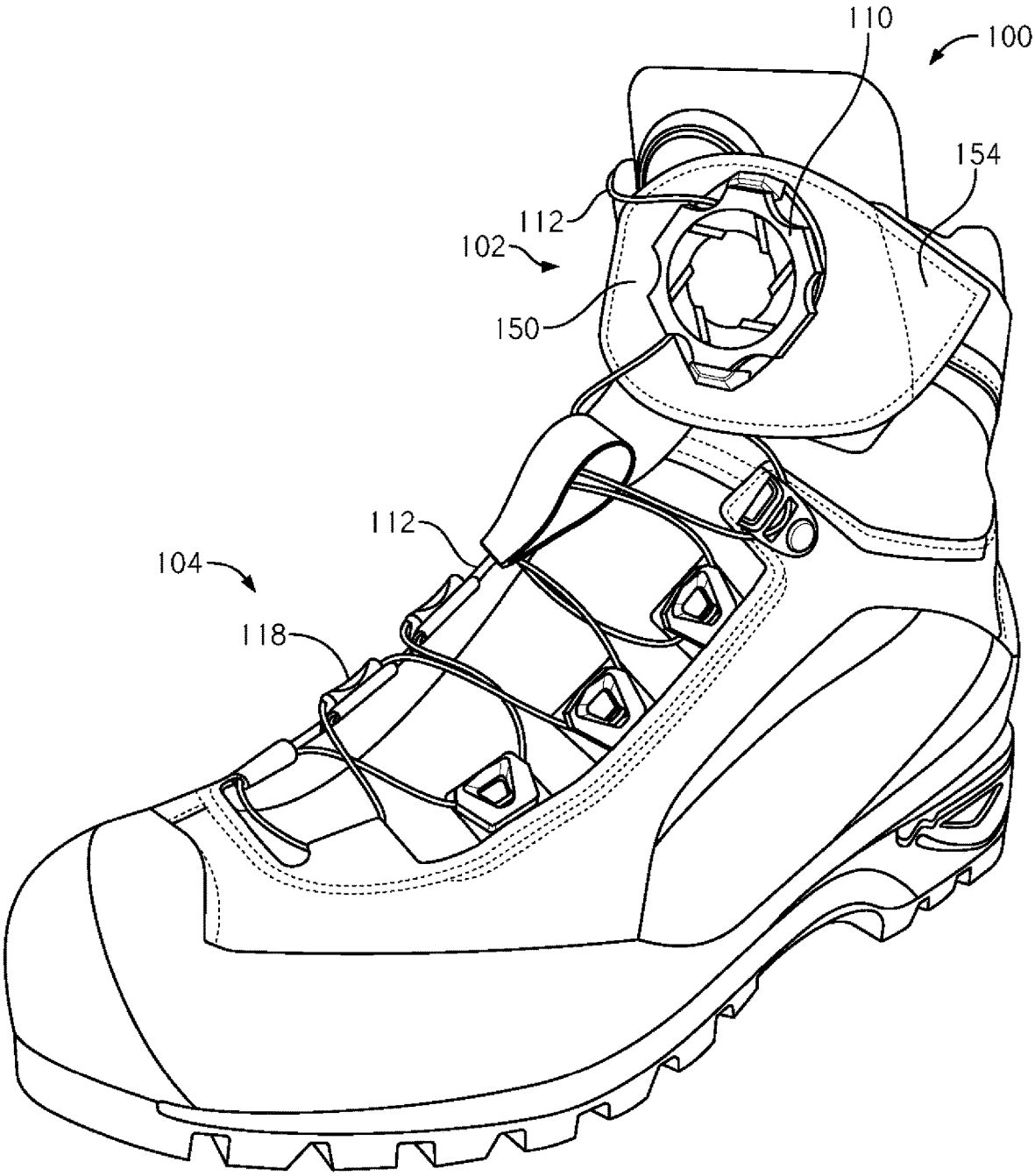
FIGS. 5A-B illustrate another embodiment of a lace guide configuration that may be employed to reduce dynamic lace movement in footwear.
Figure 5B:
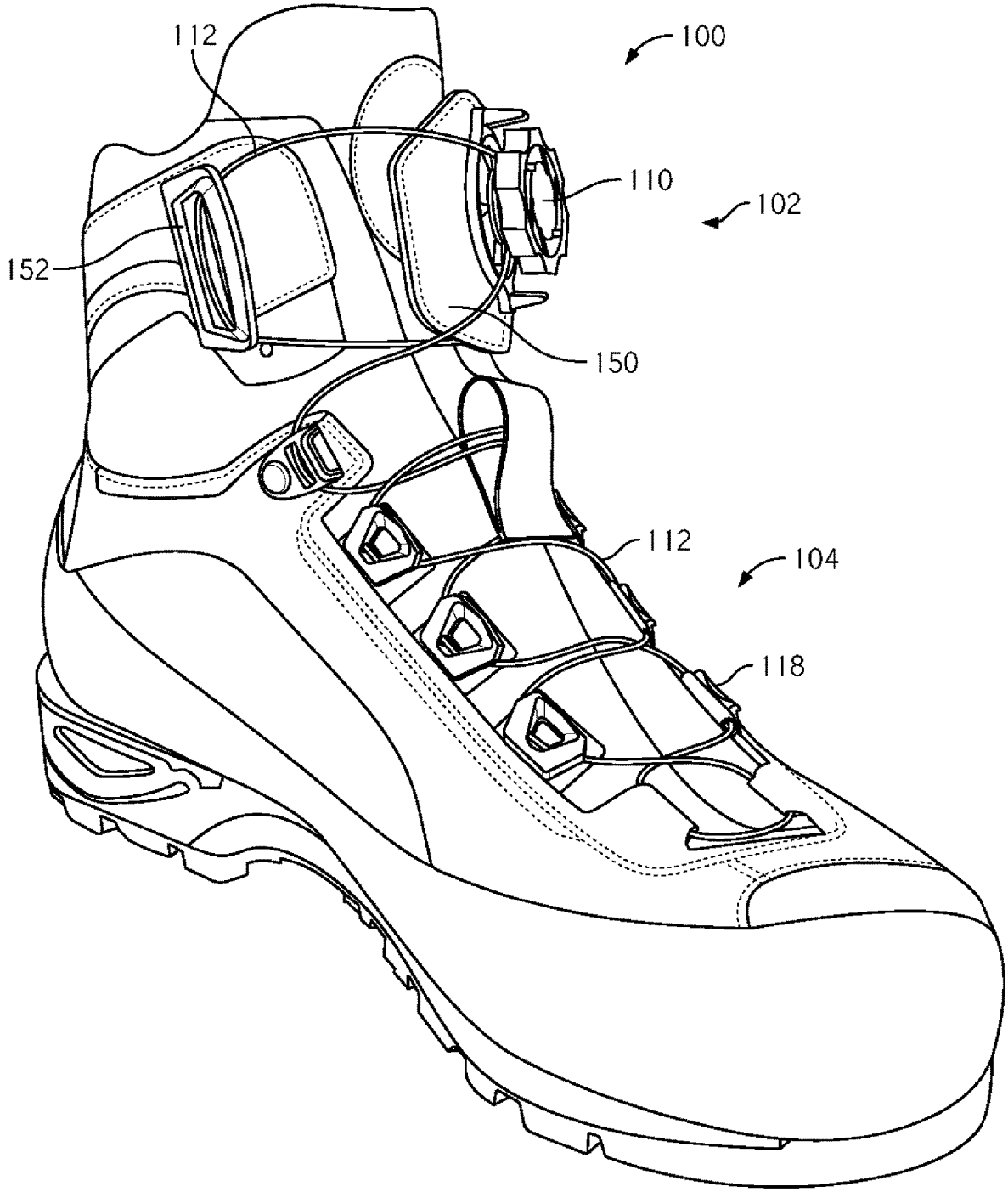

Referring now to FIGS. 5A-B, illustrated is another embodiment of a configuration that may be employed to reduce dynamic lace movement in the footwear 100. In particular, the footwear 100 includes a panel 150 that is positioned atop the tongue and within the upper cuff 102. The Reel based closure device 110 is positioned on the panel 150. A proximal side 154 is fixed to the footwear 100 while a distal side is foldable over the footwear's tongue. An upper portion of the tension member 112 is routed from the reel based closure device 110 to a guide member 152 that is positioned within the upper cuff 102. The tension member 112 is routed from the guide member 152 and underneath the panel 150 to the guides 118 positioned near the forefoot 104. A lower portion of the tension member 112 is routed from the reel based closure device 110 to a uppermost lace guide 118.

When the tension member 112 is tensioned, the panel 150 is pulled toward and typically into contact with the guide member 152. The panel 150 presses the footwear's tongue against a user's lower leg and also pinches or compresses the tension member 112 that is routed underneath the panel 150. The compression or pinching of the tension member 112 by the panel 150 may increase the frictional engagement of the tension member with the footwear 100 and thereby minimize dynamic movement or shifting of the tension member 112. The panel 150 also reduces the "crossings" of the tension member 112 across the tongue that can pull open when the user flexes their lower leg forward. The crossings of the tension member 112 are reduced because the proximal side 154 of the panel is fixed or locked to footwear 100 and the length of the tension member 112 between the free end of the panel 150 and the guide member 152 is minimized, which helps keep the upper cuff 102 closed when the footwear 100 is flexed.

Figure 6A:
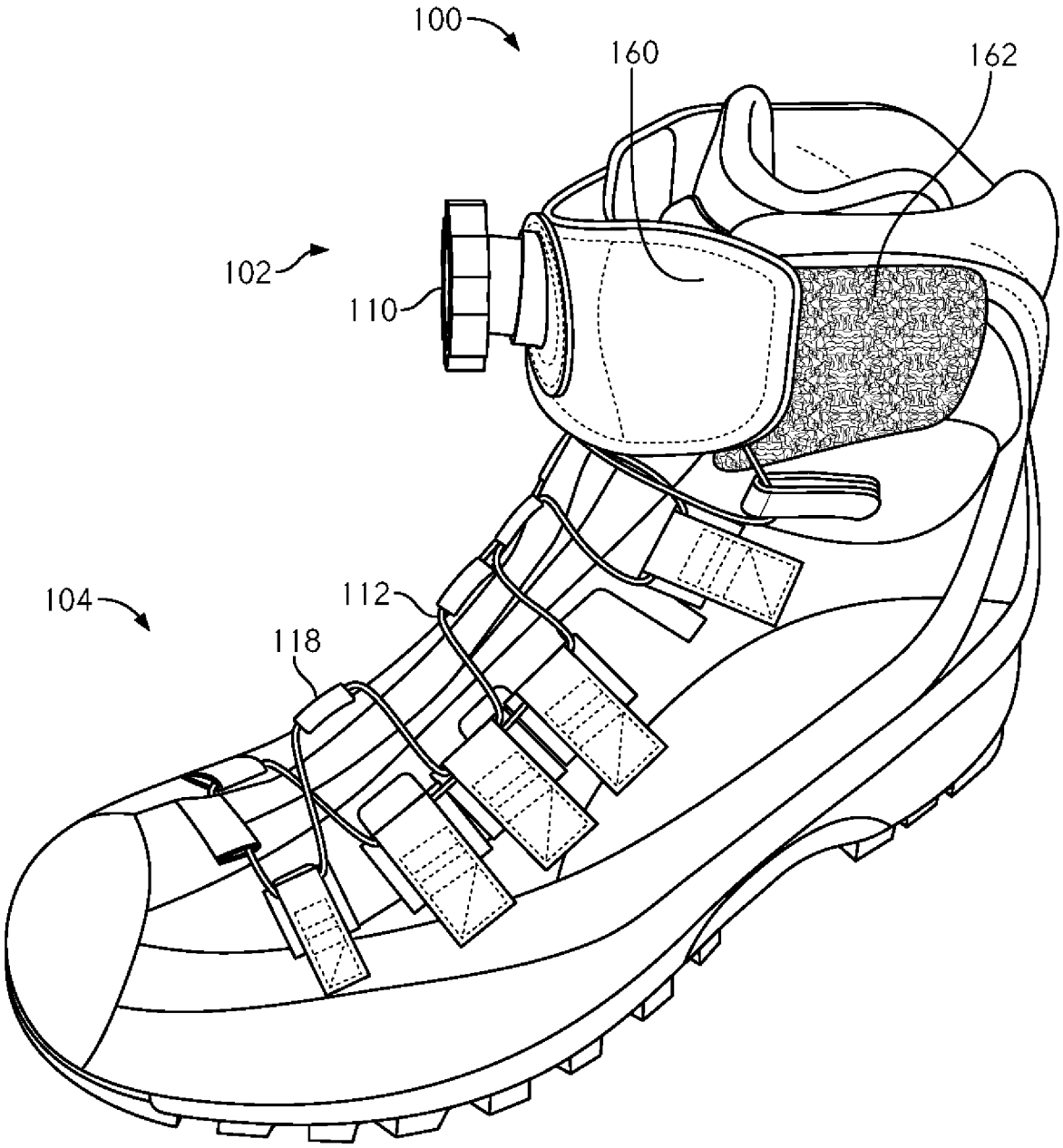
FIGS. 6A-B illustrate another embodiment of a lace guide configuration that may be employed to reduce dynamic lace movement in footwear.
Figure 6B:
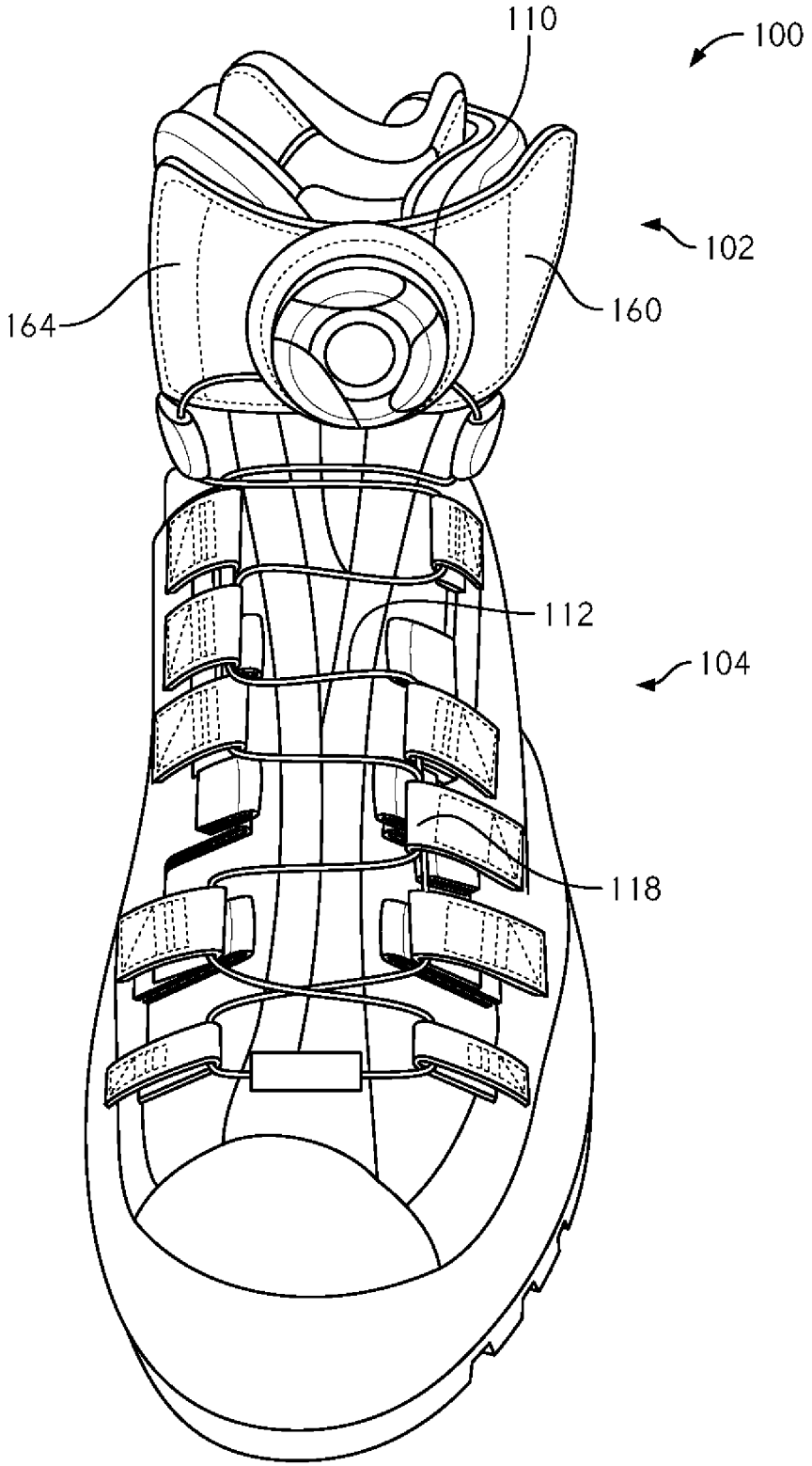

Referring now to FIGS. 6A-B, illustrated is another embodiment of a configuration that may be employed to reduce dynamic lace movement in the footwear 100. In particular, the footwear 100 includes a panel or strap 160 that is positioned in the upper cuff 102 of the footwear 100. The panel 160 is fixed on a proximal end 164 to the footwear 100 while a distal end of the panel 160 is removably coupleable with the footwear 100. In the illustrated embodiment, the distal end of the panel 160 includes a hook and loop type fastener (e.g., Velcro®) that couples with a corresponding hook and loop type fastener 162 that is positioned on the upper cuff 102 of the footwear 100. In other embodiments, the distal end of the panel 160 may include other means of fastening the panel 160 to the upper cuff 102, such as zippers, buttons, magnets, snaps, buckles, and the like.

The coupling means (e.g., hook and loop fastener 162) couple the panel 160 to the upper cuff 102 independent of the tension member 112 and thus, tensioning of the tension member 112 does not affect the coupling of the panel 160. In this manner, the panel 160 remains tightened around the user's leg regardless of if the footwear 100 is flexed and/or if the lower leg is pressed outward against the tongue. The reel based closure device 110 may be positioned on the panel 160 as illustrated or may be positioned elsewhere on the footwear 100 as desired. The tension member 112 is routed from the reel based closure device 110 to the lace guides 118 that are positioned near the forefoot 104 of the footwear 100.

Figure 7B:
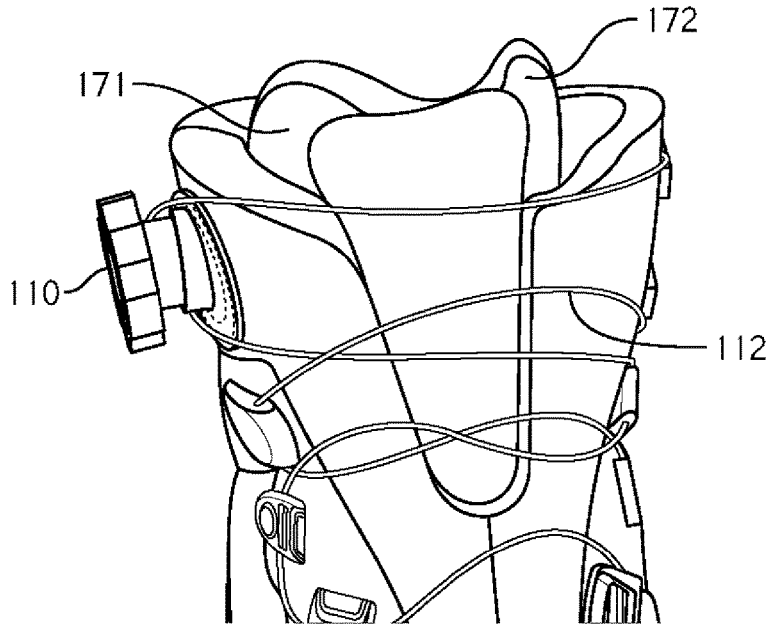
FIGS. 7A-B illustrate another embodiment of a lace guide configuration that may be employed to reduce dynamic lace movement in footwear.
Figure 7A:
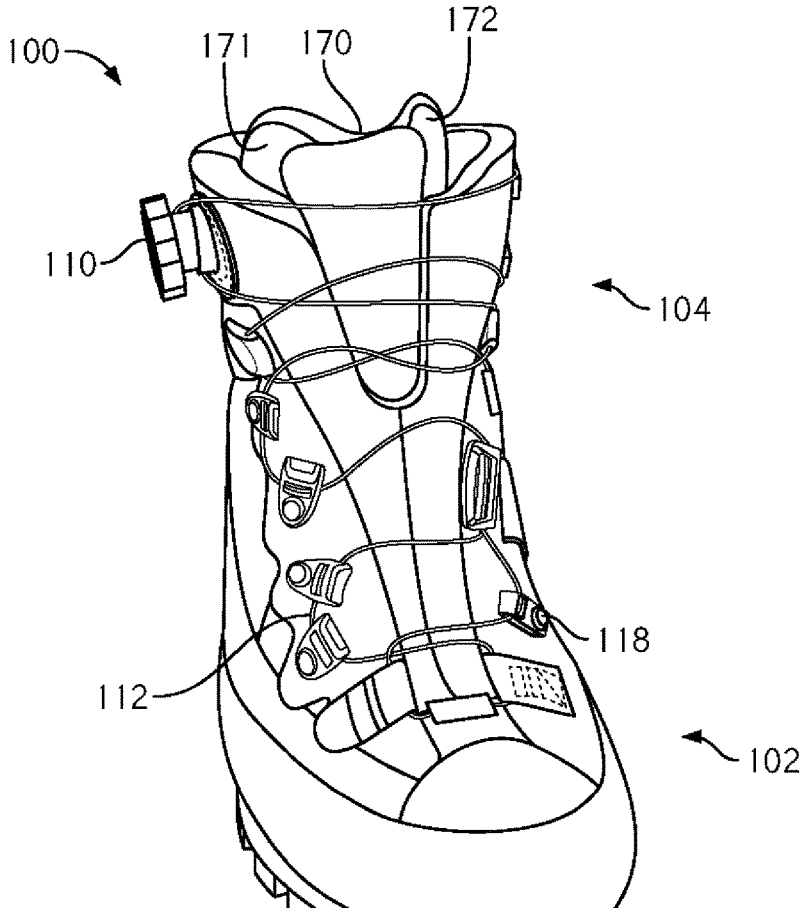

Referring now to FIGS. 7A-B, illustrated is another embodiment of a configuration that may be employed to reduce dynamic lace movement in the footwear 100. In particular, the footwear 100 includes a fastener, or fasteners, that are positioned on the exterior surface of the footwear's tongue 170 and that engage with the footwear's upper to keep the tongue 170 from moving outward as the user's lower leg presses against the tongue 170. In the illustrated embodiment, a first edge 171 and a second edge 172 of the tongue 170 include hook and loop type fasteners (e.g., Velcro®) that couple with corresponding hook and loop type fasteners positioned on corresponding inner edges of the footwear's upper. In other embodiments, the first edge 171 and the second edge 172 of the tongue 170 may include other means of fastening the tongue 170 to the footwear's upper, such as zippers, buttons, magnets, snaps, buckles, and the like.

The coupling means (e.g., hook and loop fasteners) secure the tongue 170 to the footwear's upper independent of the tension member 112 and thus, tensioning of the tension member 112 does not affect the coupling of the tongue 170 and upper. In this manner, the tongue 170 remains secure around the user's leg regardless of if the footwear 100 is flexed and/or if the lower leg is pressed outward against the tongue 170. The reel based closure device 110 may be positioned on a side of the footwear 100 as illustrated or may be positioned elsewhere as desired. The tension member 112 is routed from the reel based closure device 110, across the upper cuff 102, and to the lace guides 118 that are positioned near the forefoot 104 of the footwear 100.

Figure 8A:
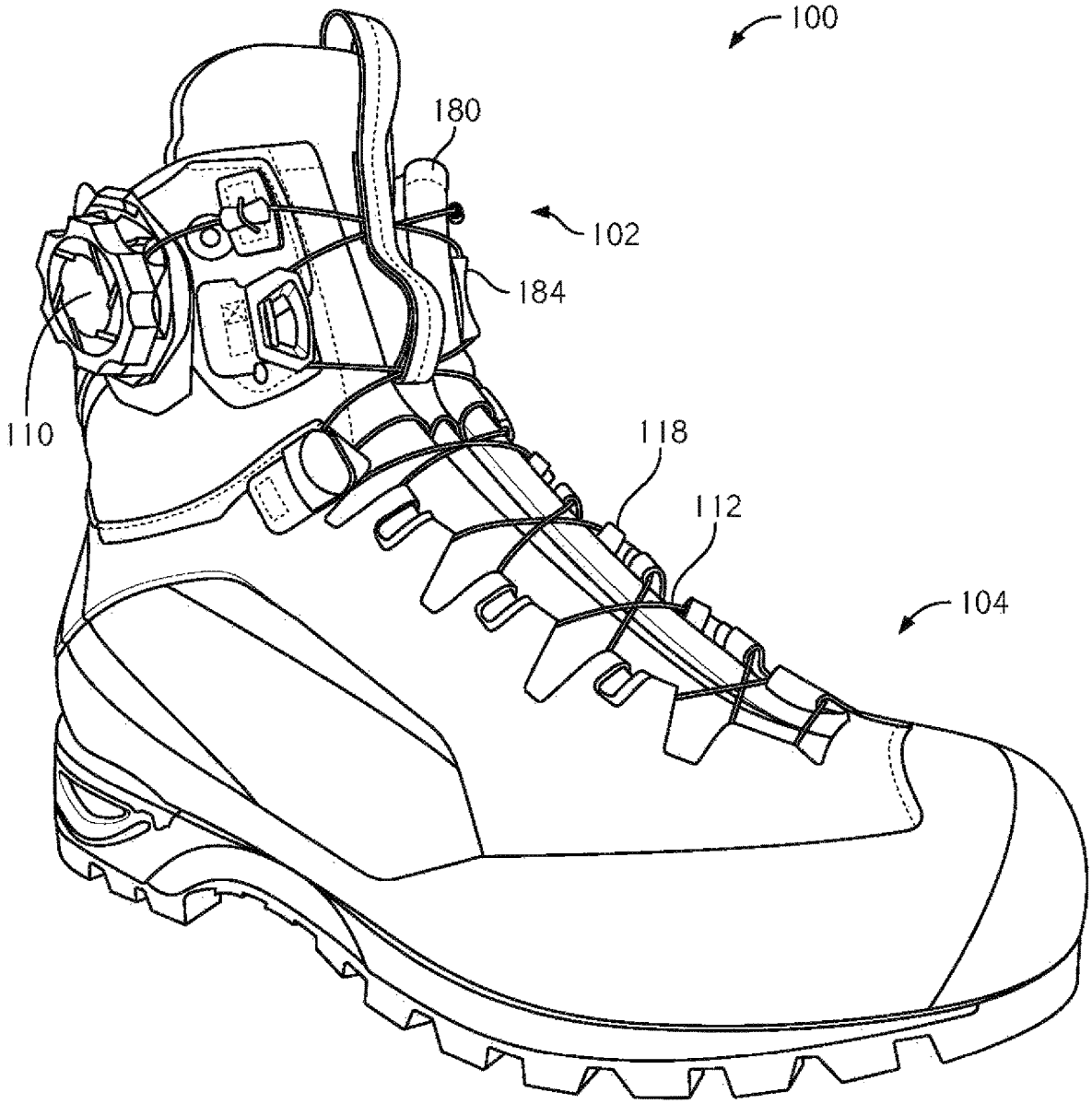
FIGS. 8A-C illustrate another embodiment of a lace guide configuration that may be employed to reduce dynamic lace movement in footwear.
Figure 8B:
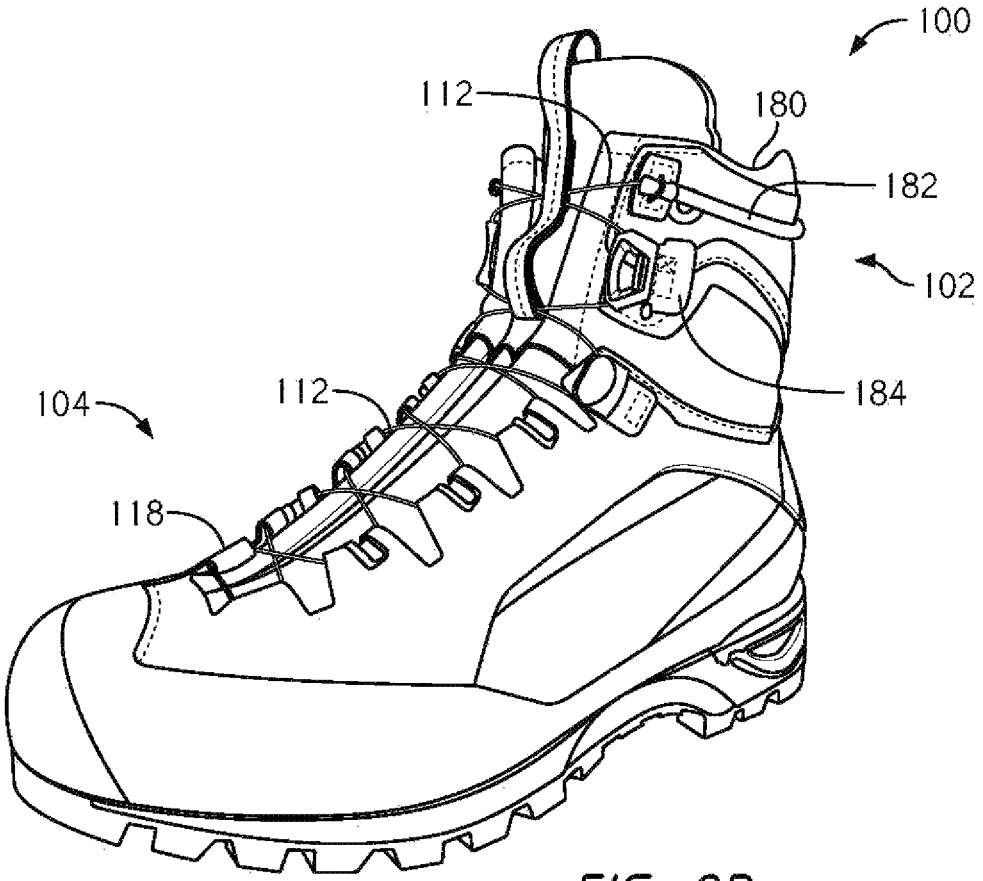
Figure 8C:
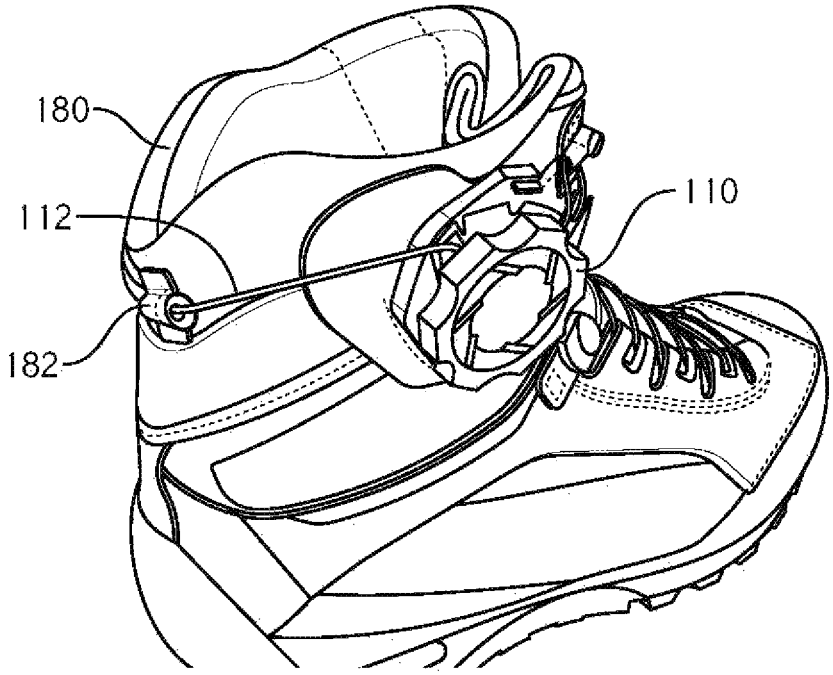

Referring now to FIGS. 8A-C, illustrated is another embodiment of a configuration that may be employed to reduce dynamic lace movement in the footwear 100. In particular, the footwear 100 includes a lace guide 182 that is positioned around a heel or collar 180 of the footwear 100. The lace guide 182 directs, routes, or guides a portion of the tension member 112 from the reel based closure device 110 and around the heel or collar 180 to an upper lace guide 184 that is positioned in the upper cuff 102 of the footwear 102. The positioning of the lace guide 182 around the heel or collar 180 minimizes dynamic movement of the tension member 112 by increasing the frictional engagement of the tension member 112 with the footwear 100 and/or by providing a force that cinches the heel or collar 180 about the lower leg. An increase in tension of the tension member 112 may result in some cinching or tightening of the heel/collar 180 about the lower leg, which may offset some of the widening or opening of the footwear 100 in response to flexing of the footwear 100 and/or movement of the lower leg within the footwear.

The tension member 112 is routed from the upper lace guide 184 to the lower lace guides 118 that are positioned near the forefoot 104. In some embodiments, the lace guide 182 may be formed or, or include, a segment of tubing that is disposed around a portion of the heel or collar 180. The tubing segment may be formed of various fabric or plastic based materials. In other embodiments, a non-tubing lace guide may be employed to route or direct the tension member around the heel/collar 180 of the footwear 100.

In any of the embodiments described herein, the footwear may include a component that is positioned on or near the tongue that aids in locking or securing the tension member 112 to the footwear's tongue, or any other part of the footwear. The dynamic movement or shifting of the lace may be greatly minimized or prevented with the use of a component that locks or secures the tension member 112 in this manner since the tension member 112 in the forefoot 104 and in the upper cuff 102 is essentially locked or fixed in place.

Figure 9A:
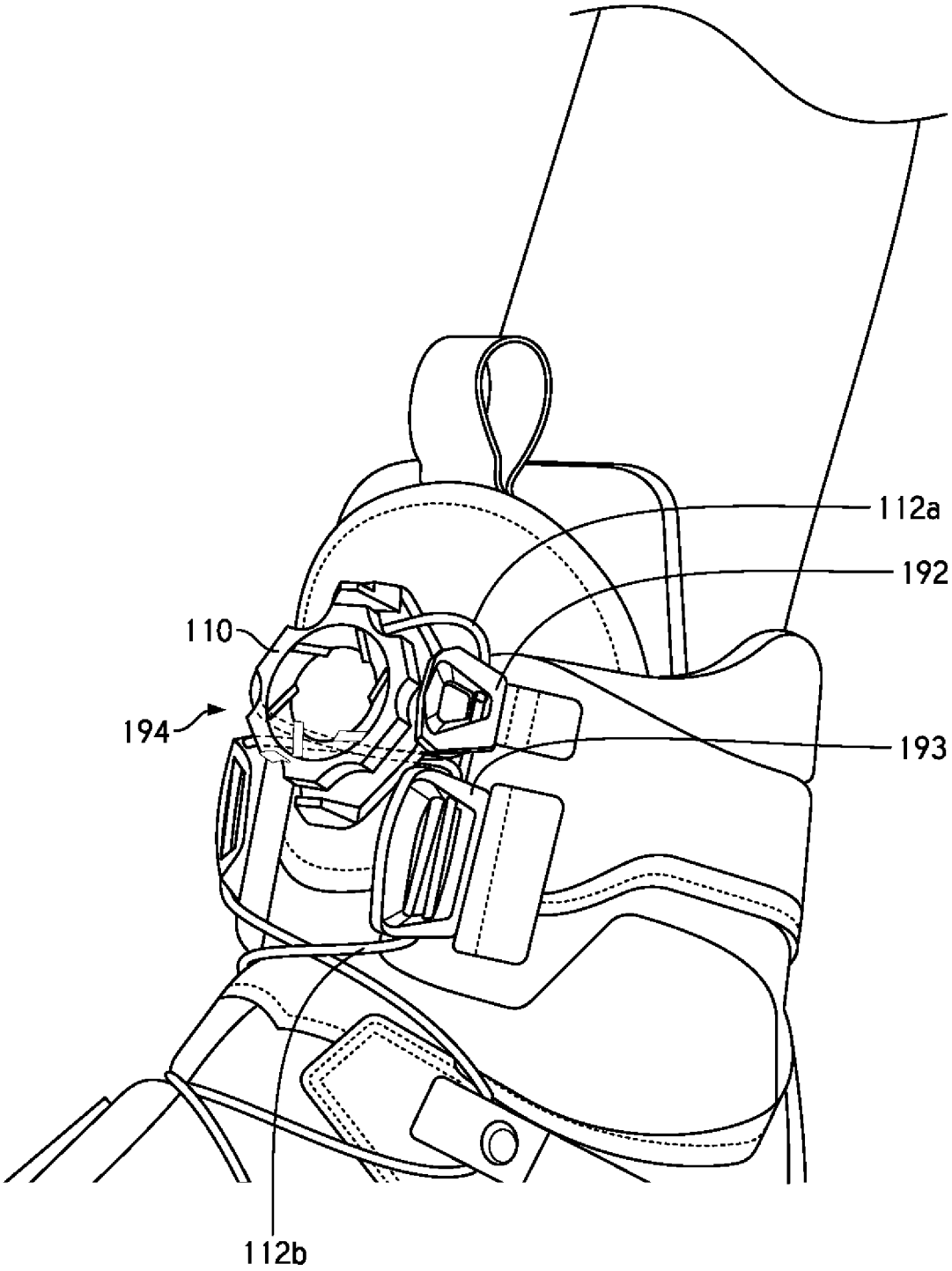
FIGS. 9A-E illustrate another embodiment of a lace guide configuration that may be employed to reduce dynamic lace movement in footwear.
Figure 9B:
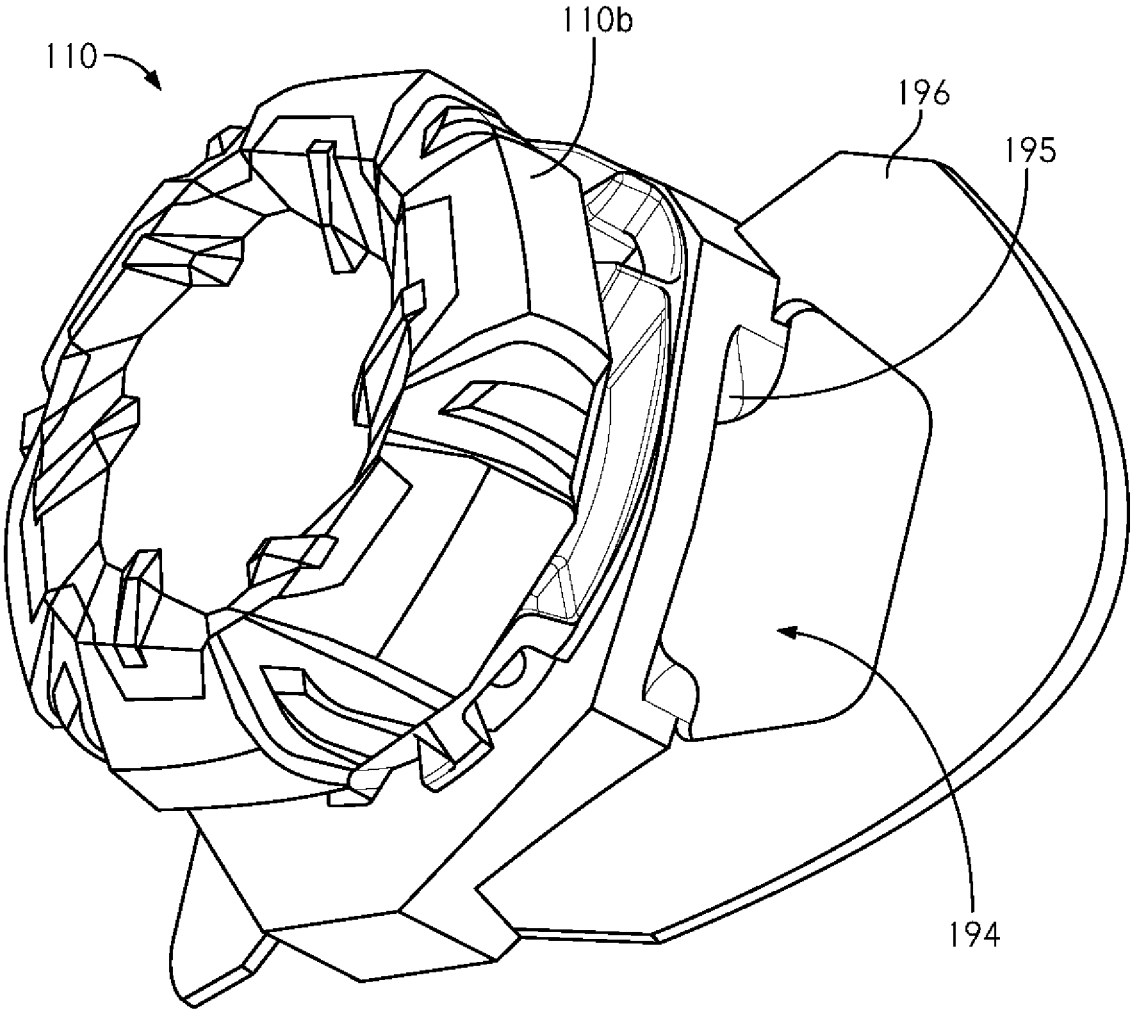
Figure 9C:
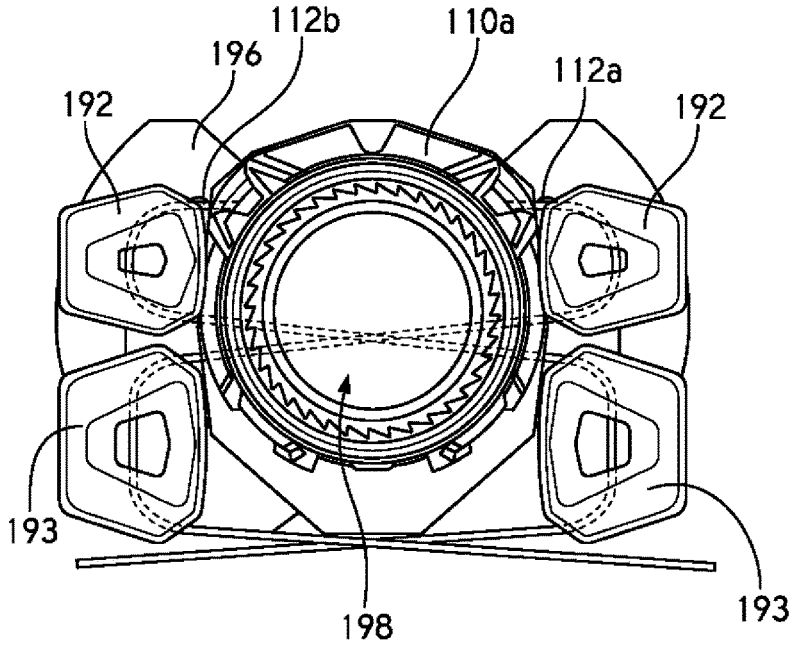
Figure 9D:
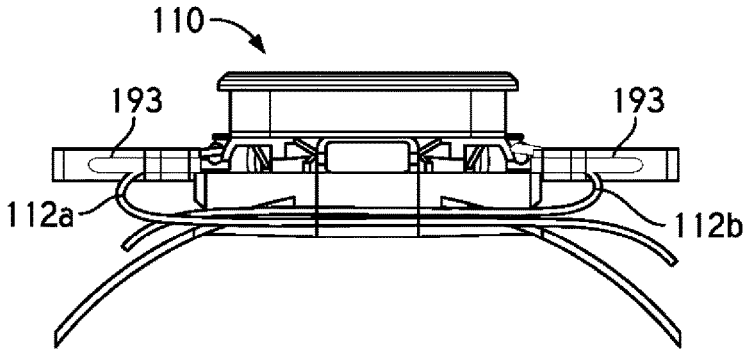
Figure 9E:
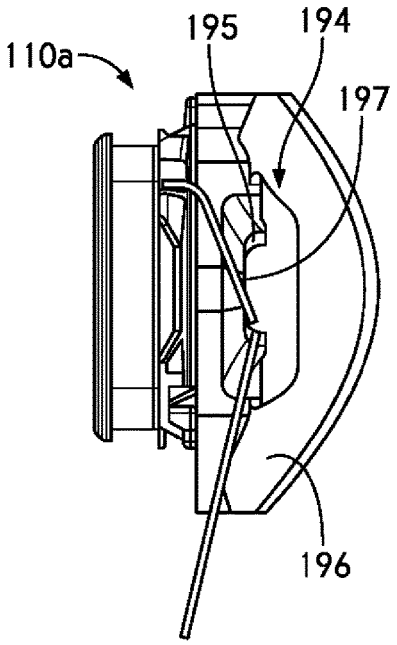

Referring now to FIGS. 9A-E, illustrated is a reel based closure device 110 that is configured so that a tension member 112 is routed axially below the interior region of the reel based closure device's housing component. The tension member 112 is routed in this manner so that the lace frictionally engages with itself and/or with the housing component to minimize dynamic movement or shifting of the tension member as described herein. As illustrated in FIGS. 9C-E, the reel based closure device 110 includes a housing component 110*a* that includes an interior region within which one or more components of the reel based closure device 110 are positioned. The components that may be positioned within the interior region of the housing include a spool (not shown), a pawl disc or component (not shown), and/or any of the other components that are described herein or that are described in the applications that are incorporated by reference herein. In regards to the spool, the spool is rotatably positioned within the interior region of the housing component 110*a* so that the spool may be rotated via operation of a knob or tightening component 110*b* and thereby wind the tension member 112 about the spool.

In most embodiments, the housing component 110*a* includes a bottom member and a wall that extends upward from the bottom member. The wall is typically cylindrical and the bottom member and wall define the interior region of the housing component 110*a*. The tightening component or knob 110*b* (hereinafter knob 110*b*) is rotatably coupled with the housing component 110*a* and operably coupled with the spool so that an operation of the knob 110*b* causes the spool to rotate within the interior region of the housing component to wind the tension member about the spool. The housing component 110*a* is configured so that the tension member 112 is routed axially below the housing component's interior region and to a lace path that is positioned along an opening of an article, such as a show as illustrated in FIG. 9A. The tension member 112 may be routed axially below the housing component interior region via tubing that is positioned within or axially below the bottom member or via a channel that is formed within or below the bottom member.

As illustrated in FIG. 9E, a channel 197 may be formed or defined in a bottom surface of the bottom member. The channel 197 extends axially upward from a bottom surface of the bottom member so that a channel is formed between the bottom member and an upper surface of an article (e.g., a shoe's upper or tongue) when the reel based closure device 110 is attached to the article. The channel 197 is typically about 10-50 mm wide and more commonly about 20-40 mm wide. In a specific embodiment, the channel 197 has a width of approximately 30 mm. The channel 197 also typically extends from one side of the housing component 110*a* to the opposite side of the housing component 110*a* so that when the reel based closure device 110 is attached to the article, the channel 197 extends entirely through, and typically underneath, the housing component 110*a*. Stated differently, when the reel based closure device 110 is attached to the article, the channel 197 typically extends between opposing sides of the housing component 110*a*, which allows the tension member 112 to be inserted entirely through the reel based device 110 below the housing component's interior region.

The channel 197 typically also has a depth of between 1 and 4 mm, and more commonly between 2 and 3 mm. In a specific embodiment, the depth of the channel 197 is approximately 2 mm. The depth of the channel 197 is measured from the bottom surface of the bottom member and axially upward from the bottom surface. The depth is sufficient to enable the tension member 112 to be inserted through the channel 197, but is shallow or small enough so that the tension member 112 frictionally engages with itself within the channel 197, or frictionally engages with the channel itself. In some embodiments, the channel 197 or the housing component 110*a* is made of a material that increases the frictional engagement of the tension member 112 with the channel 197.

As illustrated in FIG. 9C, the tension member 112 is inserted through the channel 197 so that the tension member 112 crosses itself at a point 198 within the channel 197. Specifically, a first portion 112*a* of the tension member 112 is routed form the housing component 110*a* and around a first guide 192. The first tension member portion 112*a* is routed from the first guide 192 and through the channel 197. The first tension member portion 112*a* is routed from the channel 197 and toward a lace path via a second guide 193. Similarly, a second portion 112*b* of the tension member 112 is routed form the housing component 110*a* and around a first guide 192. The second tension member portion 112*b* is routed from the first guide 192 and through the channel 197. The second tension member portion 112*b* is routed from the channel 197 and toward a lace path via a second guide 193. The first tension member portion 112*a* crosses the second tension member portion 112*b* at point 198 within the channel 197. The first tension member portion 112*a* frictionally engages with the second tension member portion 112*b* at point 198, which minimizes movement of the first tension member portion 112*a* relative to the second tension member portion 112*b* and thereby minimizes dynamic movement of the tension member 112 as described herein.

The depth of the channel 197 may be configured so that at the tension member crossing point 198, the combined thickness of the first tension member portion 112*a* and the second tension member portion 112*b* is approximately equal to or thicker than the depth of the channel 197. In such embodiments, the channel 197 may effectively pinch or squeeze the first tension member portion 112*a* and the second tension member portion 112*b* at point 198 between the bottom surface of the bottom member and an outer material of the article that the reel based closure device 110 is attached to. The pinching or squeezing of the first tension member portion 112*a* and the second tension member portion 112*b* at point 198 may further reduce relative movement of the tension member portions and thereby further reduce dynamic movement of the tension member 112 within the system.

As illustrated in FIG. 9E, the channel 197 is typically U-shaped and opposing sides or walls 195 of the U-shaped channel typically have an arcuate or curved shape. The arcuate or curved walls 195 allow the tension member 112 to slide within the channel 197 without overly abraiding or wearing on the walls 195. In this manner, the tension member 112 does not prematurely fall due to sliding of the tension member through the channel 197. The U-shaped channel typically extends between opposing sides of the housing component 110*a*.

The reel based closure device 110 may also include a base component 196 or bayonet that is configured to releasably couple with the housing component 110*a*. The base component 196 includes a relatively large flange or surface that is configured to allow the base component 196 to be easily attached to the article via stitching, adhesive bonding, RF or other welding, mechanical fastening, and the like. After the base component 196 is attached to the article, the housing component 196 may be coupled with the base component 196 to attach the reel based closure device 110 to the article. The reel based closure device 110 may be subsequently detached or removed from the base component 196 for inspection, replacement, etc. In some embodiments, the base component 196 may be integrally formed or attached to the housing component 110*a* as desired.

The base component 196 includes an aperture 194 that aligns with the channel 197 of the housing component 110*a* when the housing component 110*a* is coupled with the base component 196. The aperture 194 allows the tension member 112 to be routed from the housing component 110*a*, through the base component's aperture 194, and through the channel 197 of the housing component 110*a*. The aperture 194 may have a width that corresponds to the width of the channel 197 or is typically larger than the channel 197. This arrangement helps ensure that the tension member 112 does not abrade or wear on the aperture 194, which may cause premature failure of the tension member 112. Coupling of the base component 196 and the housing component 110*a* may be achieved via the configuration described in U.S. patent application Ser. No. 15/836,475, filed Dec. 8, 2017 and titled "Reel Based Closure System," the entire disclosure of which is incorporated by reference herein.

Alternative Closure Systems, Mechanisms, and/or Configurations for Footwear

Figure 10A:
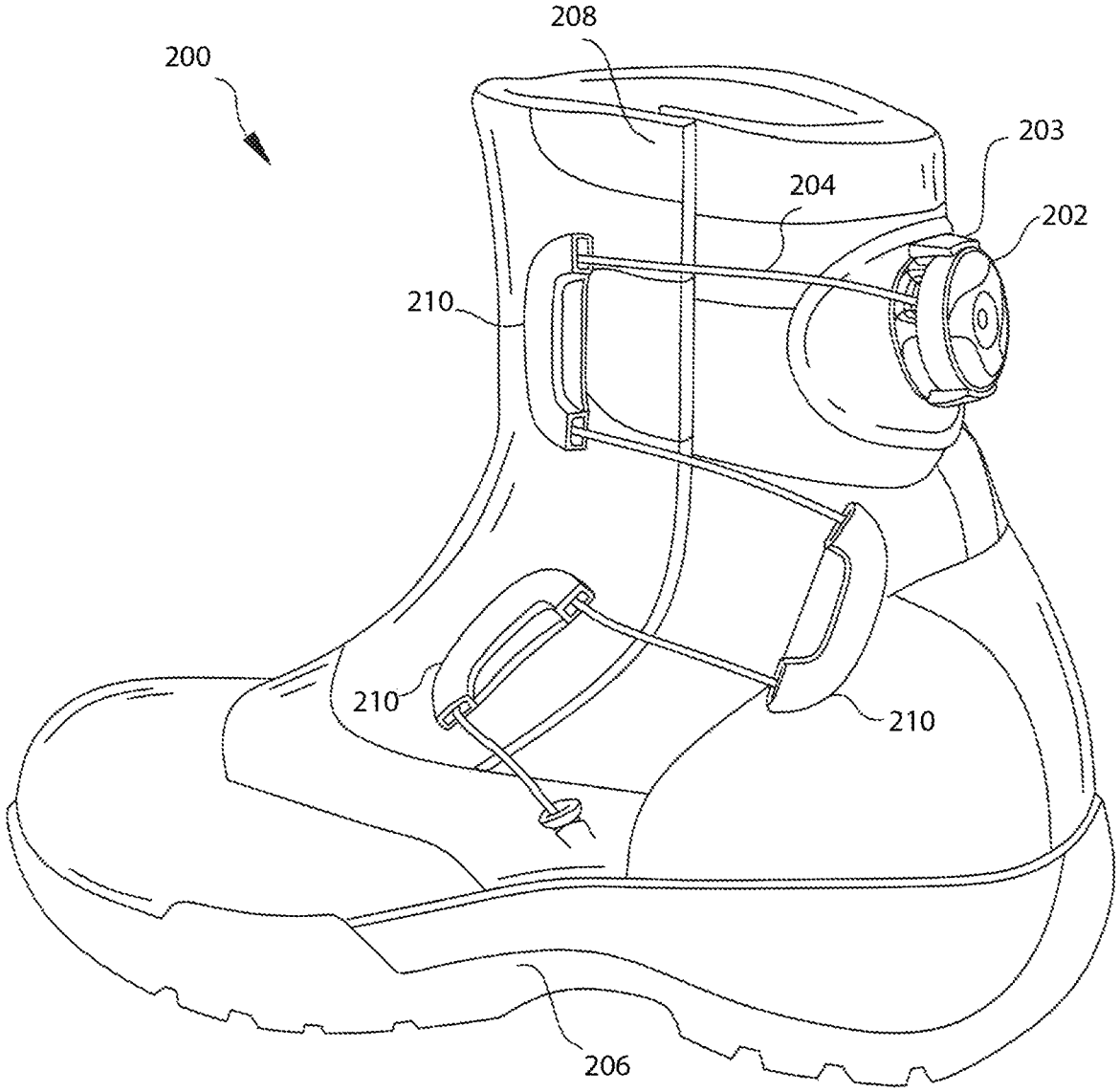
FIGS. 10A-B illustrate an embodiment of footwear that is configured to allow easy entry/exit for a user's foot.

Referring now to FIG. 10A, illustrated is an embodiment of a shoe 200 that is configured to allow easy entry/exit for a user's foot. This is achieved, in part, by positioning the alternative closure system about the shoe 200 so that it tensions and pulls a flap closed about an ankle portion of the shoe 200. In addition to the alternative closure system, the shoe 200 may also include traditional laces or a reel based closure system (see FIG. 11B) on the front of the shoe 200 in a traditional location for laces (i.e., about a tongue of the shoe). The use of traditional laces, a reel based closure system, and/or other shoe closure device (e.g., Velcro®) may be employed on any of the embodiments described and illustrated herein. The shoe 200 includes a reel assembly 202 that is positioned on a side of the shoe 200. In some embodiments, the reel assembly 202 include walls or members 203 that function to shield or protect the reel assembly's knob from contact with external objects by blocking or preventing the external objects from contacting the knob. The reel assembly 202 is operably coupled with a lace 204 so that rotation of the knob causes the lace to be tensioned. As illustrated in FIG. 10A, one end of the lace 204 is attached to the reel assembly 202 while the opposite end of the lace 204 is attached to a lower portion of the shoe 200. As such, operation of the reel assembly 202 tensions only a single end of the lace 204.

The reel assembly 202 is positioned on the back or heel of the shoe 200, however it may also be positioned elsewhere on the shoe 200 as desired—e.g., on the medial side, lateral side, or on the tongue of the shoe 200. The reel assembly 202 may be sewn onto the shoe 200 or may be heat welded, adhered, or otherwise affixed to the sole of the shoe 200. If the reel assembly 202 is located at or near the top of the shoe 200, then the non-sewing alternatives may be preferable to avoid compressing or altering the shape of the collar of the shoe 200.

The lace 204, typically traverses the opening or discontinuity in the ankle portion of the shoe 200 and when tensioned, will draw a flap 208 over the opening or discontinuity to tighten or secure the shoe 200 about a user's ankle. The flap 208 may begin at the top of the shoe 200 and continue either partially or fully to the sole 206 of the shoe 200. The flap 208 may be substantially vertical, however the flap 208 may curve or become partially horizontal towards the bottom of the shoe 200 to follow the natural contours of the shoe 200 and/or foot. Tightening of the shoe 200 about the ankle is accomplished by tensioning the lace 204 via the reel assembly 202. Since the lace 204 is routed along opposing sides of the opening via several guides 210 traversing between the flap 208 and the remainder of the shoe, tensioning of the lace 204 causes the shoe 200 to constrict about the user's ankle. The guides 210 may include channels or lumens about which the lace 204 slides. In some embodiments the guides 210 may be tubing through which the lace 204 is inserted. The guides 210 may be sewn onto, adhered, or otherwise affixed in the various locations along the opening of the shoe 200. Alternatively, the guides may be mounted within the outsole or midsole of the shoe 200. There may be any number of guides 210 between the reel assembly 202 and the attachment point at the sole 206, as well as many different lace configurations or paths. In the embodiment of FIG. 10A, the lace 204 begins at the reel assembly 202 at the back of the shoe and traverses along the opening via multiple guides 210 that are attached on opposing sides of the flap 208. The lace 204 terminates and is anchored, affixed, or otherwise attached, either permanently or removably, to the body of the shoe 200 near the sole 206.

Figure 10B:
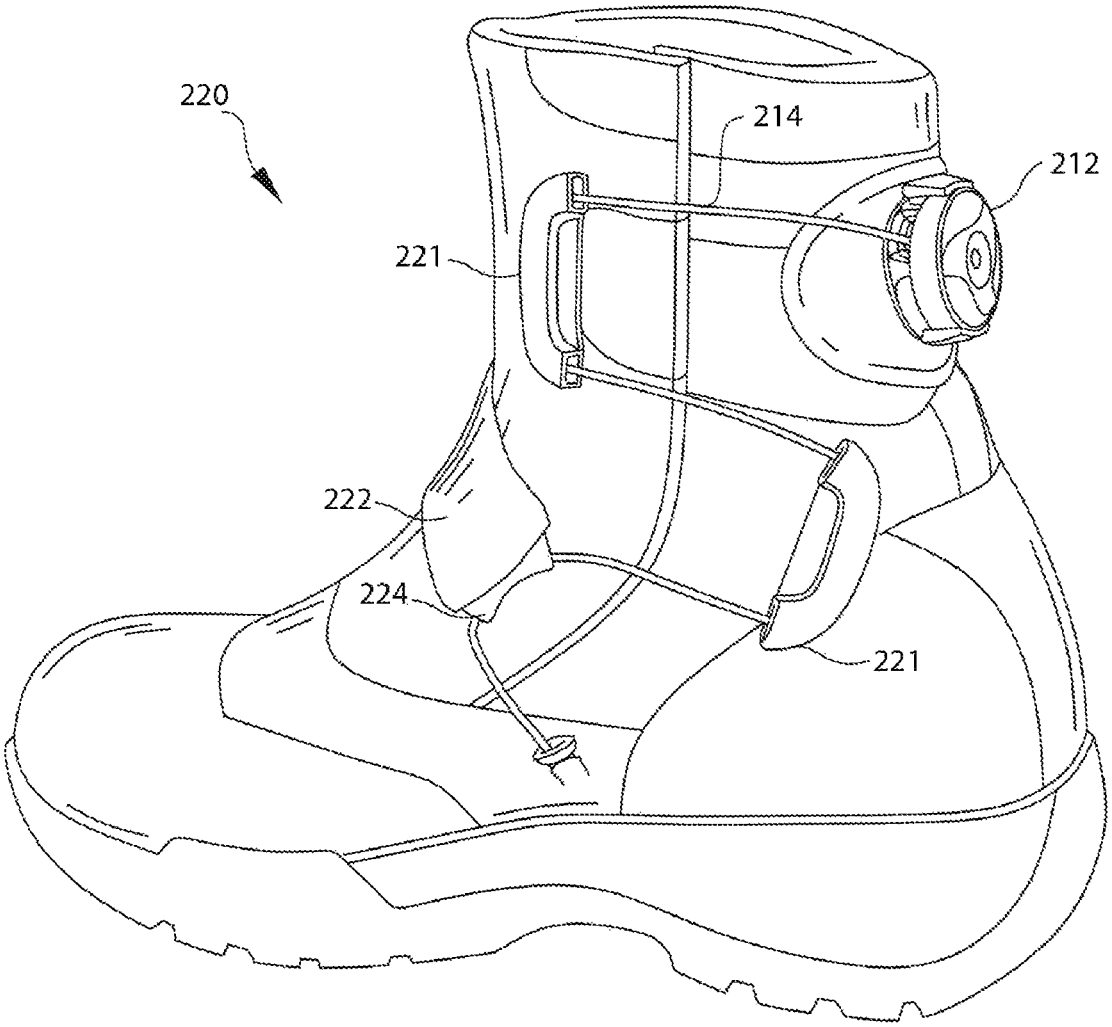

FIG. 10B illustrates a shoe 220 having an alternative closure system that is similar to that illustrated in FIG. 10A. The main difference between FIG. 10A and FIG. 10B is that instead one of the guides 210 is replaced with a strap 222 having a guide portion 224 through which the lace 214 is routed. The strap 222 is attached to the shoe 220 on the lateral side of the shoe 220 and extends across the front of the shoe 220 to a location near an edge of the flap. The strap 222 may be made of a textile, plastic, or other such durable material suitable for shoe construction. The use of the strap 222 changes how the shoe 212 tightens in response to tensioning of the lace 214. In some embodiments any and/or all of the guides 221 may be replaced with a similar strap. The guide portion 224 may be affixed to the strap 222 in a manner similar to the guides 221; namely via sewing, adhesive, heat welding, or other such attachment means. Alternatively, the guide portion 224 may be integrally formed with, or internal to, the strap 222, for example by folding a distal end of the strap 222 and affixing the distal end to create a loop for the guide portion 224.

Figure 11A:
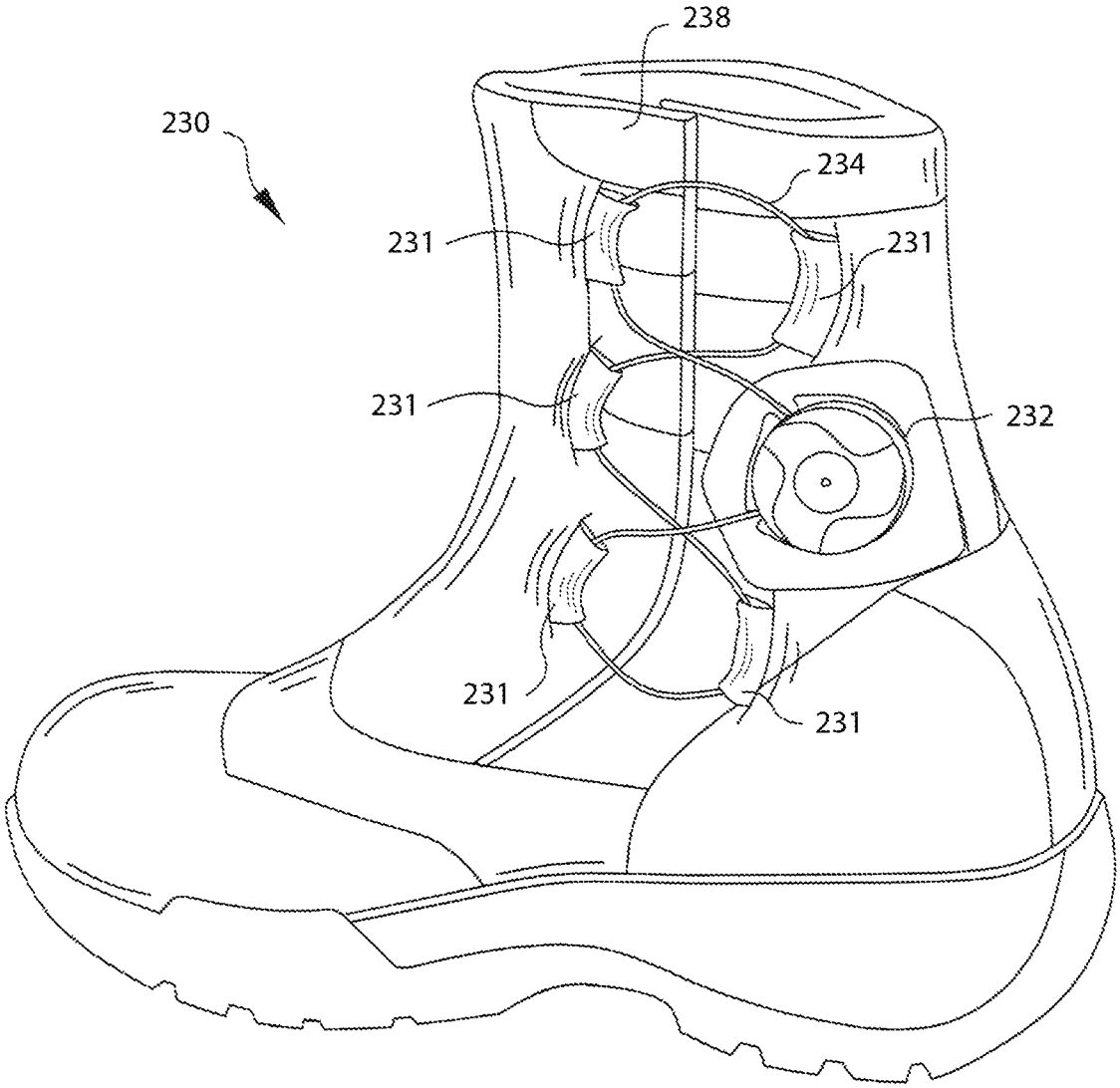
FIGS. 11A-B illustrate another embodiment of footwear that is configured to allow easy entry/exit for a user's foot.

FIG. 11A is similar to the embodiment of FIG. 10B except that the reel assembly 232 is centrally located on the side of the shoe 230, and both ends of the lace 234 are operationally attached or coupled to the reel assembly 232. The reel assembly 232 is located midway up the extended ankle of the shoe 230 so that the lace path has a lace configuration that promotes a more even or uniform tightening of the lace 234 along the entire lace path. For example, a typical lace experiences frictional losses due to routing of the lace through the various guides positioned along the lace path. The frictional losses often result in a lower lace tension as the lace gets farther or more remote from the reel assembly. The central location of the reel assembly 232 of FIG. 11A helps promote more even tightening of the lace 234 by compensating or accounting for frictional losses due to routing of the lace 234 through the various guides 231. In particular, the central positioning of the reel assembly 232 helps to ensure that the lace 234 remains relatively close to the reel assembly 232 along the entire length of the lace path. For example, the lace 234 is immediately routed to the top and bottom of the lace path, which ensure that the lace tension at the top and bottom of the lace path is the greatest. By ensuring that the portions of the lace 234 that experience the greatest tension are immediately routed to the top and bottom of the lace path, the lace 234 will tighten the flap 238 against the upper ankle portion more evenly or uniformly. The guides 231 shown in FIG. 11A may be textile or fabric guides, such as a loop sewn into a small piece of strapping or webbing that is sewn onto the shoe. Alternatively, the guides may be a loop sewn into one end of a longer strap that is positioned within or atop the shoe 230. For example, the guide 231 may be attached to the medial side of the shoe 230 and routed across the front of the shoe to the lateral side of the shoe 230, either over the top of the shoe or between one or more layers of the shoe upper assembly. These straps may function similarly to the strap 222 of FIG. 10B.

The lace path of FIG. 11A is shown having an overlapping figure-eight style, in which the lace 234 exits the reel assembly 232 and traverses between various guides 231 positioned on opposing sides of the flap 238. Though the embodiment shown in FIG. 11A has five total guides 231—i.e., three guides located on one side of the flap 238 and a pair of guides directly above and below the reel assembly 232—other embodiments may have additional or fewer guides while maintaining the criss-crossing figure-eight lace path and centrally located reel assembly 232 illustrated in FIG. 11A.

Figure 11B:
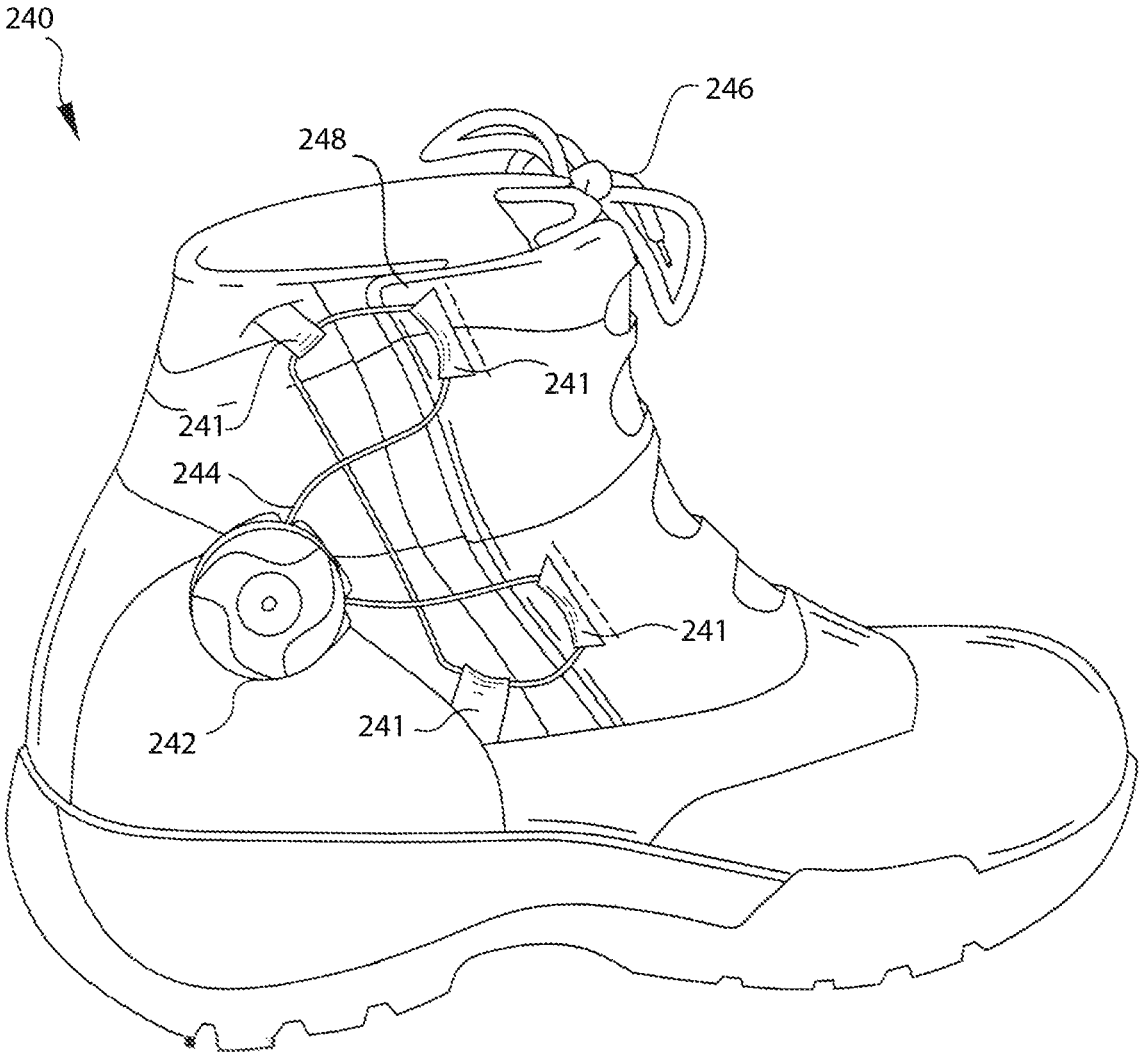

FIG. 11B is similar to the embodiment of FIG. 11A, in that FIG. 11B employes a centrally located reel assembly 242 that provides even or uniform tightening of the shoe despite frictional losses associated with routing the lace 244 through multiple guides 241. FIG. 11B displays a lace path in which the lace 244 crosses itself as it is routed along an opening of the shoe 240. Specifically, the lace 244 is routed from the reel assembly 242 to a pair of guides 241 that are positioned near an edge of the flap 248. The lace is then routed back across the opening and underneath the lace 244 near the reel assembly 242. FIG. 11B additionally displays a traditional shoelace 246 disposed on the front of the shoe over the tongue or gusset of the shoe 240. Though not pictured here, as described above, other traditional closure mechanisms (e.g., Velcro straps, an additional reel assembly, etc.) may be used in this and any embodiment of the present disclosure. In some embodiments, the shoelace 246 or other closure mechanism may be used for aesthetic purposes so that the shoe 240 has a more traditional appearance. In other embodiments, the shoelace 246 or closure mechanism may be functional and employed to additionally tighten the shoe 240. In such embodiment, the shoelace 246 may be the primary means or mode of closing and tightening the shoe 240 and the reel assembly 242 may be used as a secondary closure system.

Figure 12A:
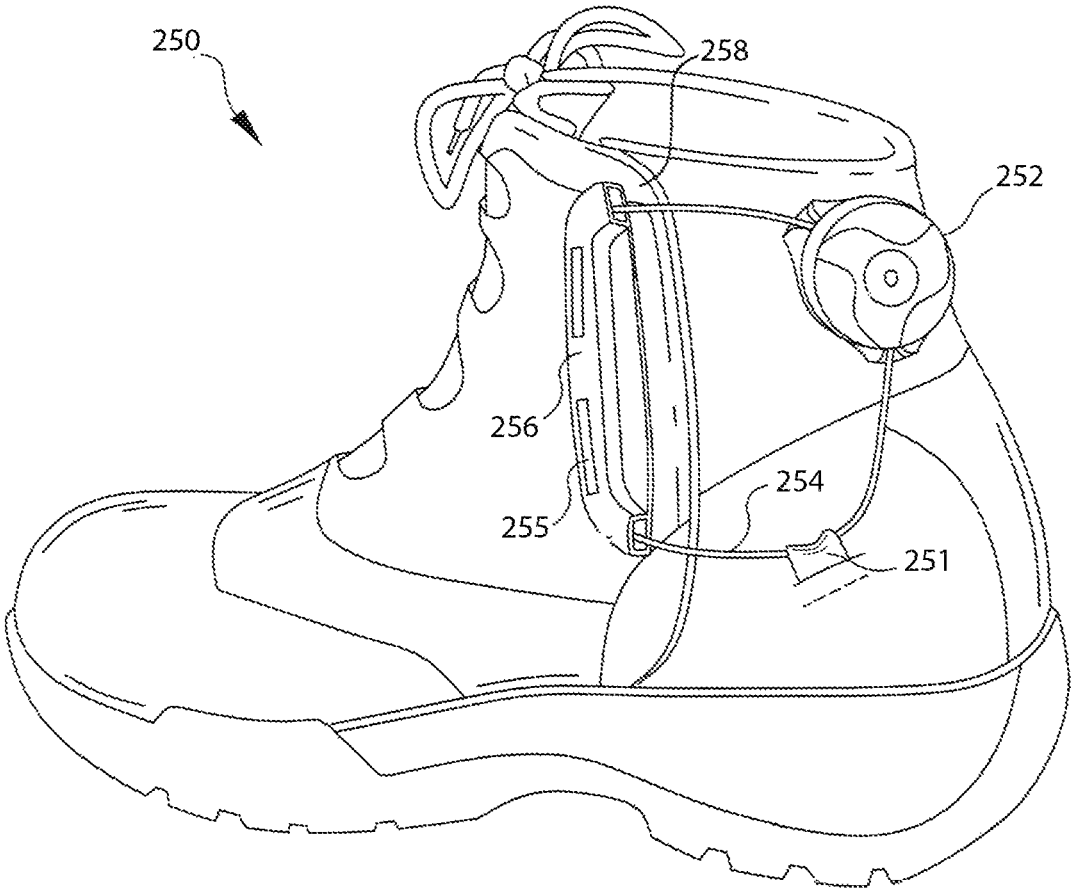
FIGS. 12A-B illustrate an embodiment of footwear that includes a lace path having a square or D-shaped configuration.

FIG. 12A illustrates a lace path having a square or D-shaped configuration. The reel assembly 252 is illustrated as being positioned near a top or upper end of the shoe 250, although the reel assembly 252 may be positioned elsewhere on the shoe 250, such as lower on the shoe 250 or toward a front or back of the shoe 250. The illustrated embodiment employs a single guide 256 that is used to route the lace 254, although in other embodiments multiple guides may be used. Alternatively, the guide 251 may not be present in some embodiments of the invention so that the lace 254 defines a triangular shape between the reel assembly 252 and the guide 256. The reel assembly 252 may be attached or connected to the shoe through any method described herein or otherwise known in the art.

The guide 256 of FIG. 12A is pictured as a partially enclosed u-shaped tubular design through which the lace 254 travels. The guide 256 may have one or more openings 255 that allow debris or other material to escape the guide 256 and prevent additional friction on the lace 254. The guide 256 may be positioned so that it primarily aligns with the edge of the flap 258 or is offset from the edge of the flap 258. In this configuration, the reel assembly 252 becomes difficult to tension when the guide 256 is in a vertical position with the flap 258 fully tightened. This results in the flap 258 bottoming out, or returning to an identical position each time the shoe 250 is worn providing an identical fit and tightness for the user. To further achieve a desired "bottoming out" of the system, the tensioning power or ability of the reel assembly 252 may be selected so that the reel assembly 252 is not further operable to tension the lace after the desired lace tension is achieved.

Figure 12B:
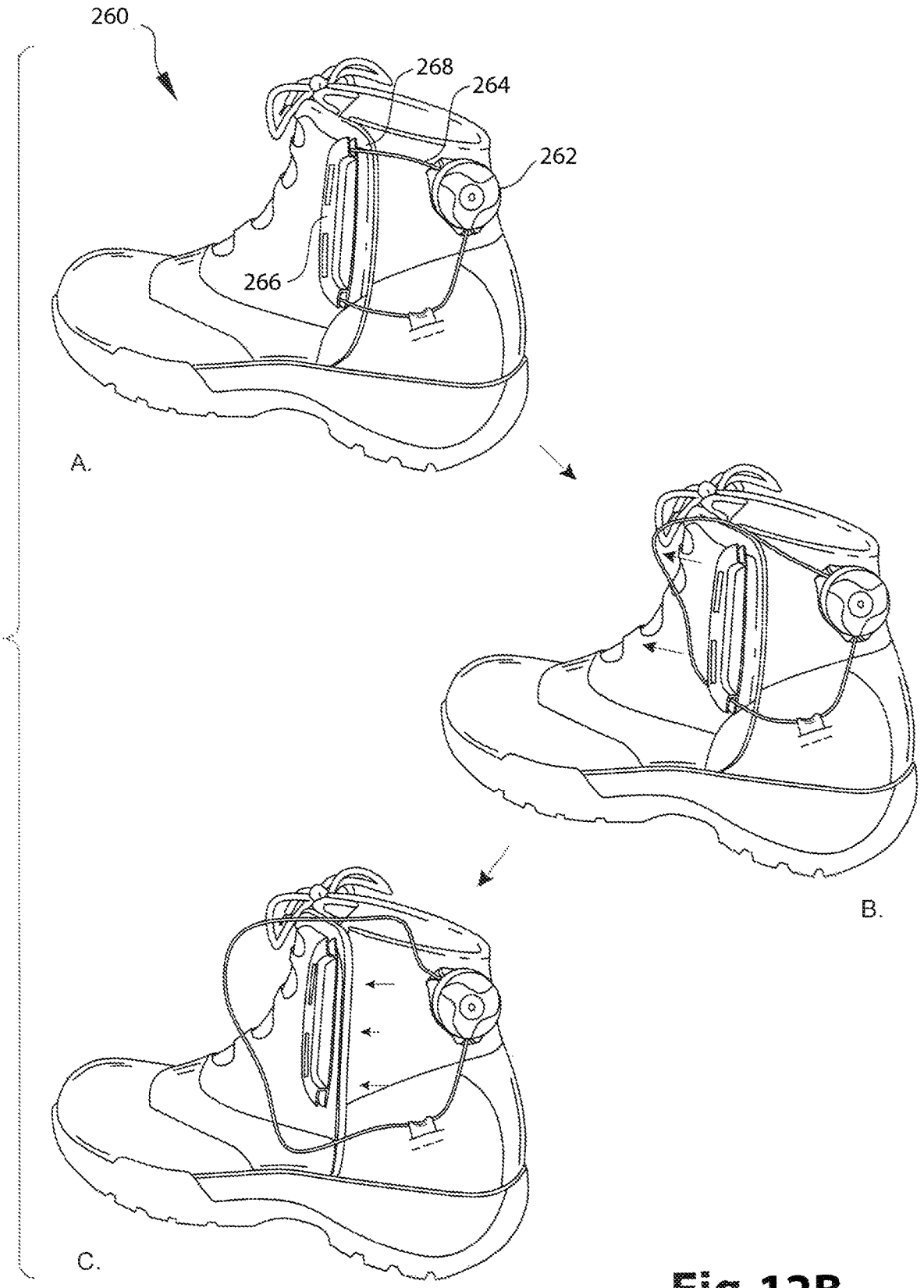

FIG. 12B illustrates an embodiment that is similar to FIG. 12A, except that the guide 266 is open on one side to allow the lace 264 to be removed completely from the guide 266. FIG. 12B further illustrates the lace 264 being removed from the guide 266. Specifically, FIG. 12B, step A, shows the shoe 260 with the lace 264 positioned within the guide 266. In this position, the reel assembly 262 may be operated to tension the lace 264 and thereby close or pull the flap 268 secure about a user's ankle. FIG. 12B, step B, shows the shoe 260 with the tension in the lace 264 loosened such that the lace 264 is able to be partially removed from the guide 266. To remove the lace 264, a rear surface of portion of the guide 266 is open so that the lace 264 may be withdrawn from a channel of the guide 266 through the opening. FIG. 12B, step C, illustrates the reel assembly 262 with the lace 264 fully loosened so that the lace 264 may be easily removed and uncoupled from the guide 266. Removing the lace 264 from the guide 266 allows the flap 268 to open or to be pulled towards the front or toe of the shoe to allow easy donning/doffing of the shoe. The other lace guides described herein may have open rear surfaces that allow the lace to be removed as illustrated in FIG. 12B.

Figure 13:
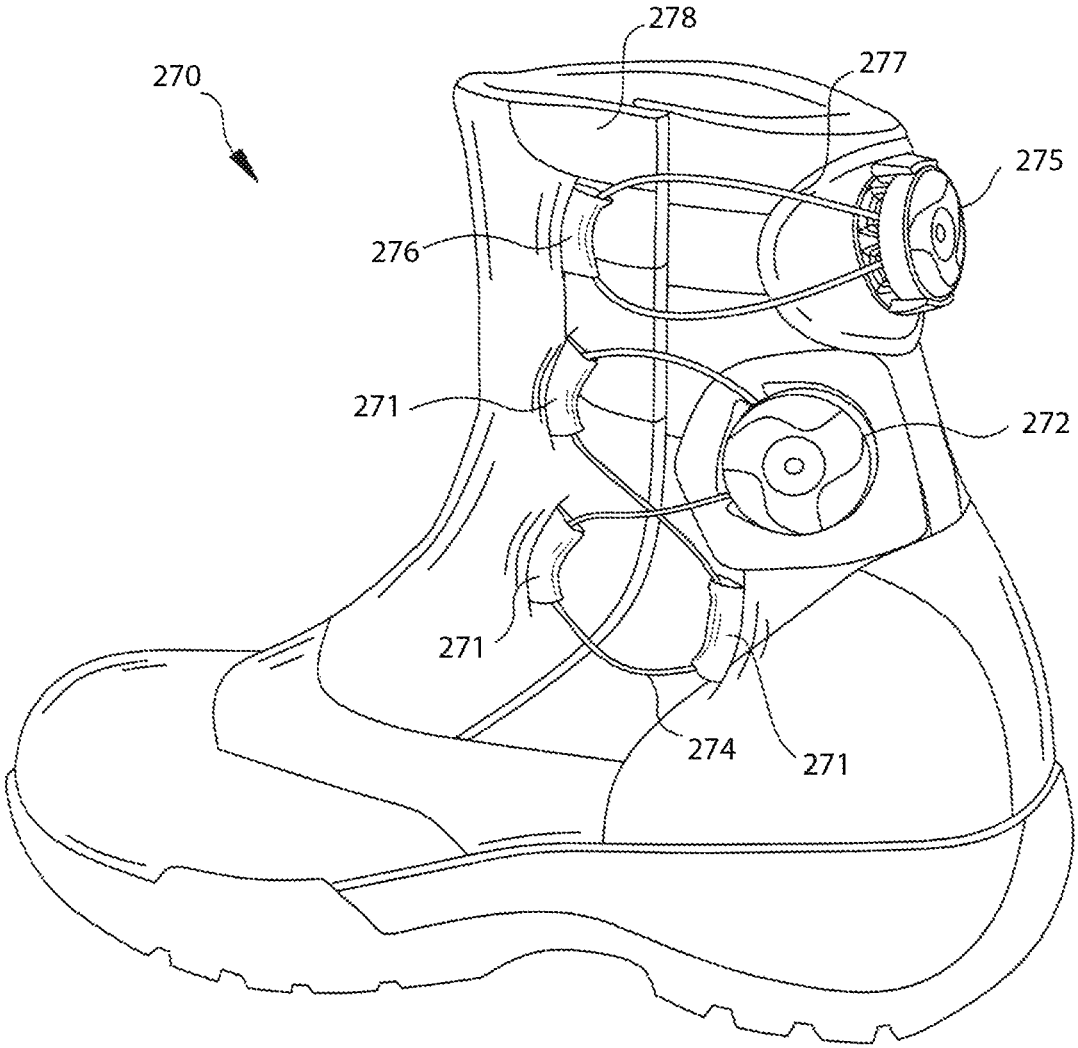
FIG. 13 illustrates an embodiment of footwear that is configured to allow easy entry/exit for a user's foot and that includes multiple tightening components.

FIG. 13 illustrates an embodiment of a shoe 270 that includes multiple alternative closure systems. Specifically, the shoe 270 features a first reel assembly 272 that is positioned on the shoe 270 in a manner similar to the reel assembly 232 of FIG. 11A. The lace 274 passes through guides 271 in a figure-eight pattern about a path that extends only along a lower portion of the flap 278. The lace path of the lace 274 may differ from the figure-eight pattern illustrated in FIG. 13 while extending only along the lower portion of the flap 278. A second reel assembly 275 is positioned on an upper portion of the flap 278. The second reel assembly 275 is operably with a lace 277 and a single guide 276 that are positioned on the upper portion of the flap 278. The second reel assembly 275 is employed to tighten the upper portion of the flap 278 independently of the first reel assembly 272. This embodiment allows for independent and differential tensioning or tightening of the upper and lower portions of the shoe 270, which allows the user to customize the fit of the shoe 270 to their preference. The differential or zonal tightening of the shoe 270 in FIG. 13 can be accomplished through use of either multiple reel assemblies, such as reel assemblies 272 and 275, or through use of a single reel assembly with multiple laces routed through different zones of the shoe and traversing differing numbers of guides. The guides, 271 and 276, illustrated in FIG. 13 may be any of the guides and/or straps described herein.

Figure 14A:
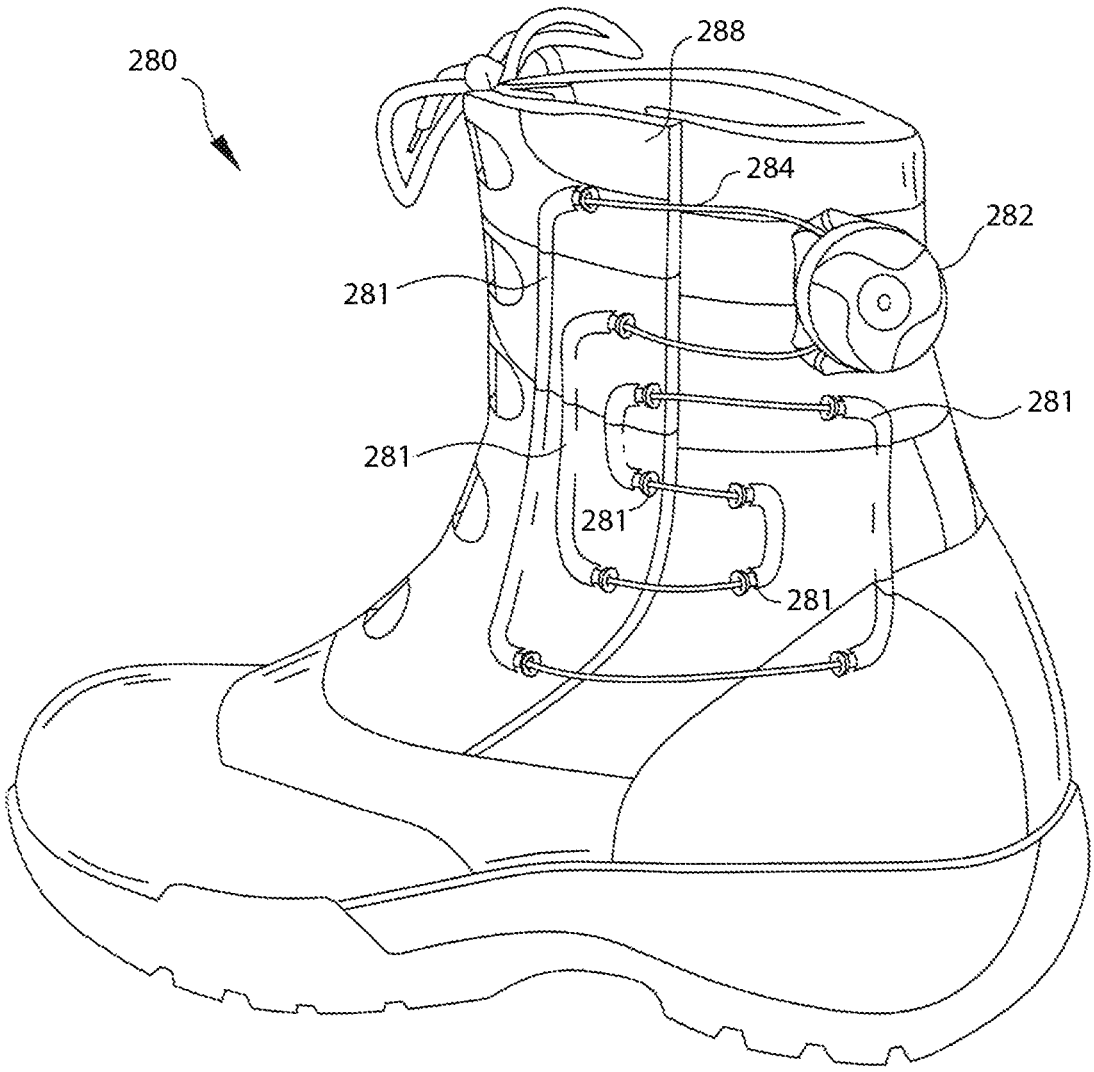
FIGS. 14A-B illustrate an embodiment of footwear in which a lace path is designed to ensure a more even or uniform tensioning and tightening of the footwear along an edge of a flap of the footwear.

FIG. 14A illustrates an embodiment in which the path of the lace 284 is designed to ensure a more even or uniform tensioning and tightening of the shoe 280 along the entire edge of the flap 288. The reel assembly 282 is positioned near the top of the shoe 280, although the reel assembly 282 may be positioned elsewhere on the shoe, such as near the middle or bottom of the ankle portion of the shoe 280. The guides 281 of the embodiment of FIG. 14A are tubes which have a u-shape configuration, though other tube configurations may be employed. The guides 281 may either be attached to the surface of the shoe 280, using any method described above, or may positioned under one or more layers of the shoe 280 so that the guide 281 is essentially not visible from the exterior surface of the shoe 280.

The lace path of FIG. 14A is designed to provide an even or uniform tenstioning through the use of a sequenced or spiral configuration. An upper portion of the lace 284 is routed directly from the reel assembly 282 at the top of the shoe into a first guide 281 that immediately routes or directs the lace 284 to the bottom of the lace path. The lace 284 then traverses across the opening to a guide 281 that is positioned near the back of the shoe 280, which guide 281 routes or directs the lace 284 to a mid-point of the lace path below the reel assembly 282.

A lower portion of the lace 284 is routed directly from the reel assembly 282 to a second guide 281 that also immediately routes or directs the lace 284 to the bottom of the lace path. The lace 284 then traverses across the opening to a guide 281 that routes or directs the lace 284 to the mid-point of the lace path below the reel assembly 282. The upper and lower portions of the lace 284 intersect or meet at the mid-point of the lace path. This lace path configuration provides a more even tensioning and tightening of the shoe 280 by minimizing the amount of frictional loss that the lace 284 experiences as it is routed from the top of the lace path to the bottom of the lace path. Specifically, by directing or routing each lace from the reel assembly 282 to the bottom of the lace path, the frictional loss in the lace is minimized and the lace tension is more uniformly distributed along the opening.

Figure 14B:
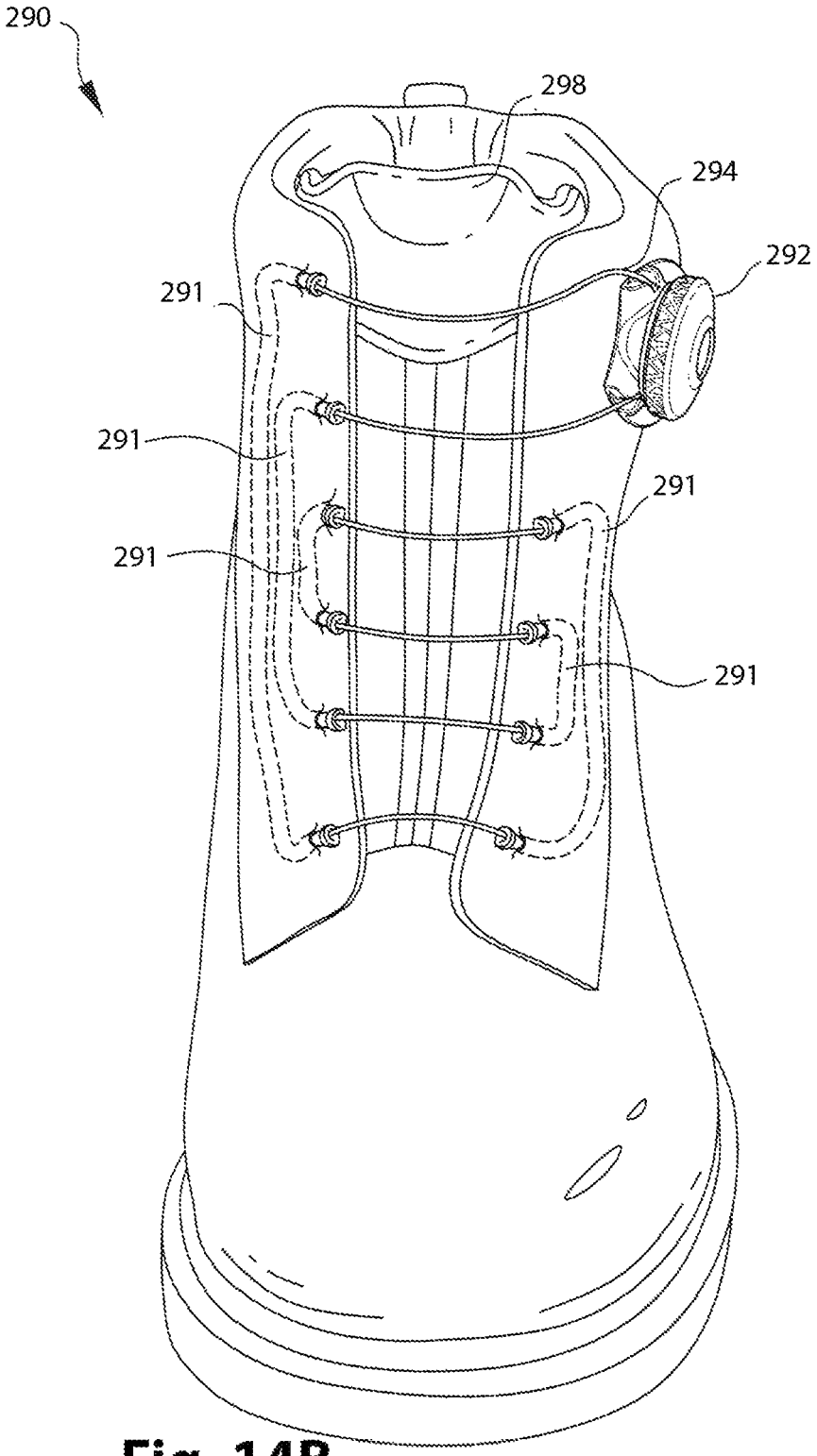

FIG. 14B illustrates an embodiment similar to FIG. 14A, except that the sequential or spiral lace path is used as described to close or tighten the front of the shoe 290. In this embodiment of the invention, rather than the guides 291 being located on the flap and rear portion of the shoe 290, the guides are positioned on the medial and lateral sides of the tongue 298 of the shoe to guide the lace 294 about the opposing sides of the tongue. The reel assembly 292 is likewise located on the side of the shoe 290, near the front of the shoe 290 rather than the rear as illustrated in FIG. 14A. The lace path provides a more even and uniform tensioning or tightening of the shoe 290 along the shoe's tongue. Though a particular arrangement for the sequential lacing has been described herein, further modifications of the lace path may be employed that incorporate additional guides or fewer guides while maintaining the principle of equalizing the tension across an opening of the shoe 290 between the top and bottom end of the lace path.

Figure 15A:
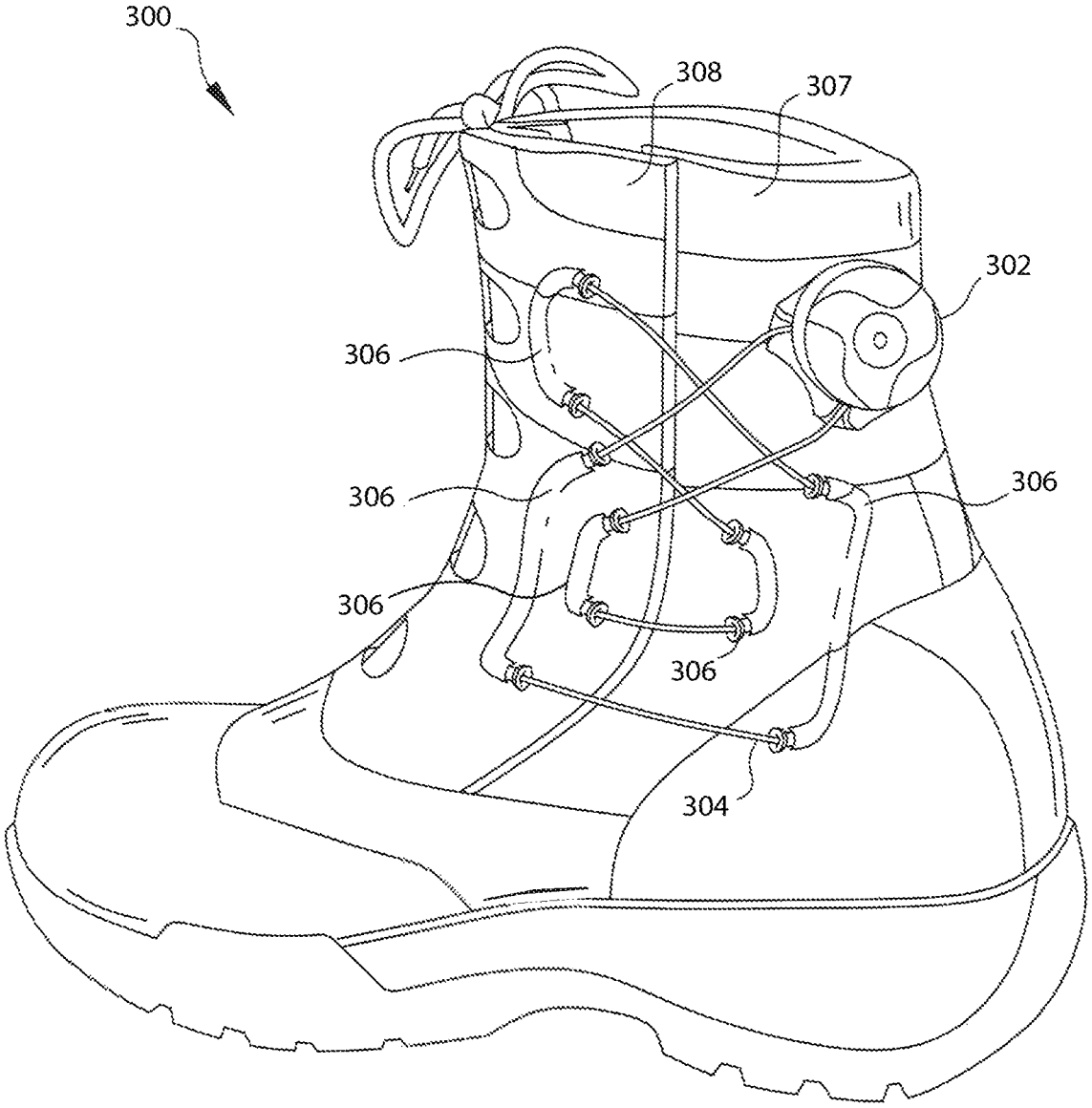
FIGS. 15A-B illustrate another embodiment of footwear in which a lace path is designed to ensure a more even or uniform tensioning and tightening of the footwear along an edge of a flap of the footwear.

FIG. 15A illustrates another embodiment of a sequential or spiral lace path. The lace path configuration of FIG. 15A may provide quicker tensioning and tightening around the throat or collar 307 of the shoe 230. In this embodiment, the reel assembly 232 is positioned on the side, or at the back of the shoe 230, optionally at the top or the bottom of the shoe 230. The reel assembly 232 may be attached to the shoe 230 using any of the methods described above, and may be used in concert with one or more other reel assemblies on the shoe 230. The path of the lace configuration begins at the reel assembly 232 and proceeds in an diagonally downward direction towards the front of the shoe 230 onto the flap 238. The path then traverses back from the flap 238 toward the back of the shoe 230 before continuing in an upward diagonal direction towards the front of the shoe 230. The diagonally upward and diagonally downward directed laces criss-cross as illustrated. The laces are directed via guide members 306, which in some embodiments may be formed of sections of tubing. As illustrated, an upper portion of the lace 234 is routed along an outer perimeter of the lace path while a lower portion of the lace is routed along an inner perimeter of the lace path. The lace 234 may be routed via tubular guides 306, or via any other type of guide described herein.

Figure 15B:
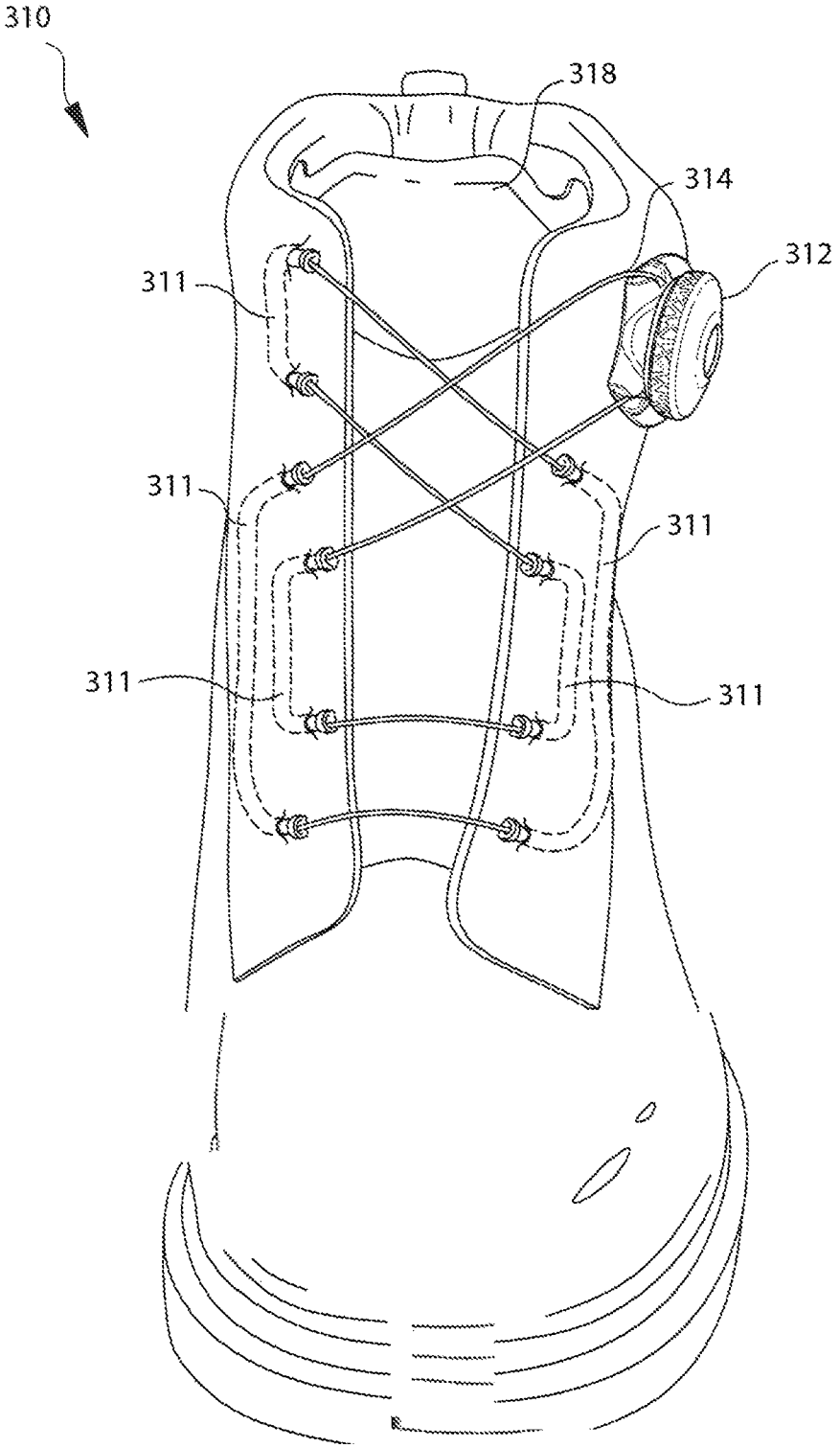

FIG. 15B is substantially the same as FIG. 15A, with the exception that instead of placing the closure system on a side of the shoe, the reel assembly 312, lace 314, and guides 311 are all located on the front portion of the shoe surrounding the tongue 318. Specifically, the reel assembly 312 is located on the lateral side of the shoe near the top and near the tongue 318. The path that the lace 314 follows is substantially the same as FIG. 15A, with an upper portion of the lace 314 routed along the perimeter or outside of the lace path and an inner portion of the lace 314 routed along an inner portion of the lace path. The embodiment shown in FIG. 15B may be used in conjunction with another closure system such as a reel system, traditional laces, or a zipper on the side of the boot. Additionally, there may be a second reel assembly and lace which serve to tighten a different region or portion of the shoe 231 than the system shown in FIG. 15B.

Although the embodiments described herein have been illustrated employing manual reel based devices, it should be realized that various other tensioning mechanisms or devices may be used. For example, a pull cord device and/or motorized device may be employed to tension the lace as desired. In a specific embodiment, a motorized lace tensioning device may be concealed within or adjacent the sole of the shoe and the lace may be routed to the motorized lace tensioning device under one or more layers of the upper.

Footwear Component Adjustment and Variability

Figure 16:
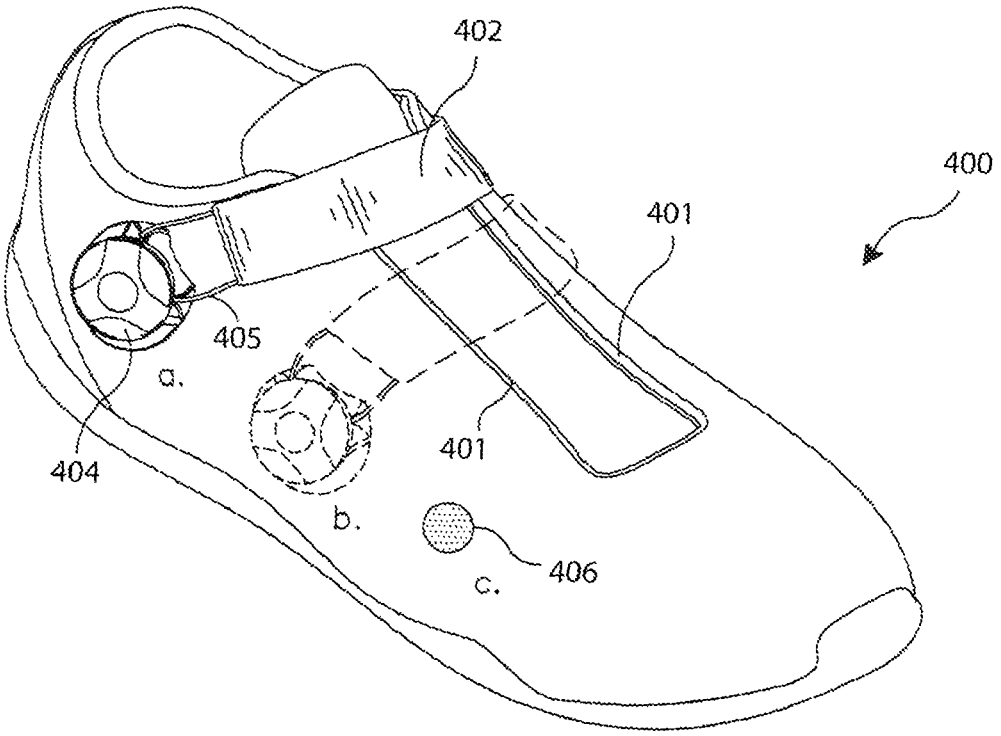
FIGS. 16-17 illustrate footwear that is configured so that a tension or fit of the footwear about a user's foot may be quickly and easily adjusted.

Referring now to FIG. 16, illustrated is a shoe or footwear 400 that includes an upper with a pair of eyestays 401 that are positioned on opposite sides of an opening of the shoe 400 (e.g., the shoe's tongue). The shoe is configured so that the tension or fit of the shoe about the user's foot may be quickly and easily adjusted. The adjustment of the shoe 400 is achieved via a strap 402 that is positioned across the opening and that extends between the opposing eyestays 401. A proximal end of the strap is attached or fixed to one side of the shoe 400 (e.g., the medial side) while a distal end of the strap 402 is freely moveable and positionable about the shoe. The distal end of the strap 402 may be coupled or removably attached to an opposite side the shoe 400 (e.g., the lateral side) in one of multiple positions or orientations, which affects how the shoe 400 will close and/or tighten about the user's foot.

In the illustrated embodiment, the distal end of the strap 402 may be removably attached to the opposite of the shoe 400 in one of three distinct positions or zones, which are labeled "a", "b", and "c" in FIG. 16. Coupling of the distal end of the strap 402 to one of the respective zones (e.g., positions "a", "b", or "c") is achieved via a fastener 406, which in the illustrated embodiment is a hook and loop type fastener, such as those commonly sold under the brand name Velcro®. Although the fastener 406 is illustrated as being positioned in zone "c", it should be realized that similar fasteners 406 are positioned in each of the other zones (i.e., positions "a" and "b") to enable the distal end of the strap 402 to be coupled with those respective zones of the shoe 400.

In FIG. 16, the distal end of the strap 402 is illustrated as being attached or coupled with a reel based closure device 404 via a length or segment of lace 405 that extends between the reel based closure device 404 and a distal tip or end of the strap 402. As described above, the reel based closure device 404 is configured so that operation of the device causes the lace 405 to be tensioned, which in turn tensions the strap 402 and tightens the shoe 400 about the user's foot. To attach the distal end of the strap 402 to the shoe 400, a rear or bottom surface of the reel based closure device 404 includes a corresponding hook and loop fastener (not shown) that enables the reel based closure device 404 to be coupled with the appropriate fastener 406 in the desired zone.

FIG. 16 illustrates that the distal end of the strap 402, and the reel based closure device 404, is attached to zone "a" of the shoe 400. With the distal end of the strap 402 attached to zone "a", the strap 402 extends across the opening or tongue of the shoe 400 near the shoe's collar. Thus, tensioning of the strap 402, via the reel based closure device 404 and lace 405, causes the shoe 400 to tighten or constrict to a greater degree about the shoe's collar in comparison with other portions of the shoe 400 (e.g., the toe box). Tensioning of the strap 402 in this manner causes the shoe 400 to constrict and tighten about the user's ankle to a greater degree than other portions of the shoe 400. If a user desires to change the fit of the shoe 400, and more specifically the manner in which the shoe constricts about the foot, the user may simply change the orientation or position of the strap 402 about the shoe 400. For example, FIG. 16 illustrates a second position of the strap 402 (i.e., in dashed lines) in which the distal end of the strap 402 is attached to zone "b" and in which the strap 402 extends across a mid-portion of the shoe 400. Tensioning of the strap 402 in this position would cause the shoe 400 to tighten or constrict to a greater degree about the mid-portion of the shoe. Similarly, the distal end of the strap 402 may be attached to zone "c" so that the strap 402 extends across a lower portion of the shoe 400 nearer to the toe box. Tensioning of the strap 402 in this position would cause the shoe 400 to tighten or constrict to a greater degree about the lower portion of the shoe near the toe box in comparison with the shoe's collar.

The user may adjust the fit of the shoe 400 based on an activity that the user is engaging in, such as a sporting event, an outdoor activity (i.e., hiking ascent vs. descent), and the like, or the user may adjust the fit of the shoe 400 to achieve a desired comfort level. In other instances, the position of the strap 402 may be changed to visually and/or physically demonstrate how a configuration of the shoe 400 may be modified in order to determine an optimal placement of one or more shoe components in designing and/or manufacturing the shoe 400. For example, it may be determined that the shoe 400 should include a single strap 402, but the final or optimal placement of the strap 402 in relation to the shoe 400 may be unknown. In order to facilitate in this decision making process, the adjustability of the strap 402 may be employed so that a team of designers and/or engineers may quickly assess how the various strap orientations affect the fit and/or functionality of the shoe 400. Once an optimal placement of the strap 402 has been determined, the shoe 400 may be constructed with the desired/selected strap placement. Similar rationales for the adjustable fit and/or visual/physical demonstration of the shoe configuration are applicable to the various other embodiments described and/or contemplated herein.

Figure 17:
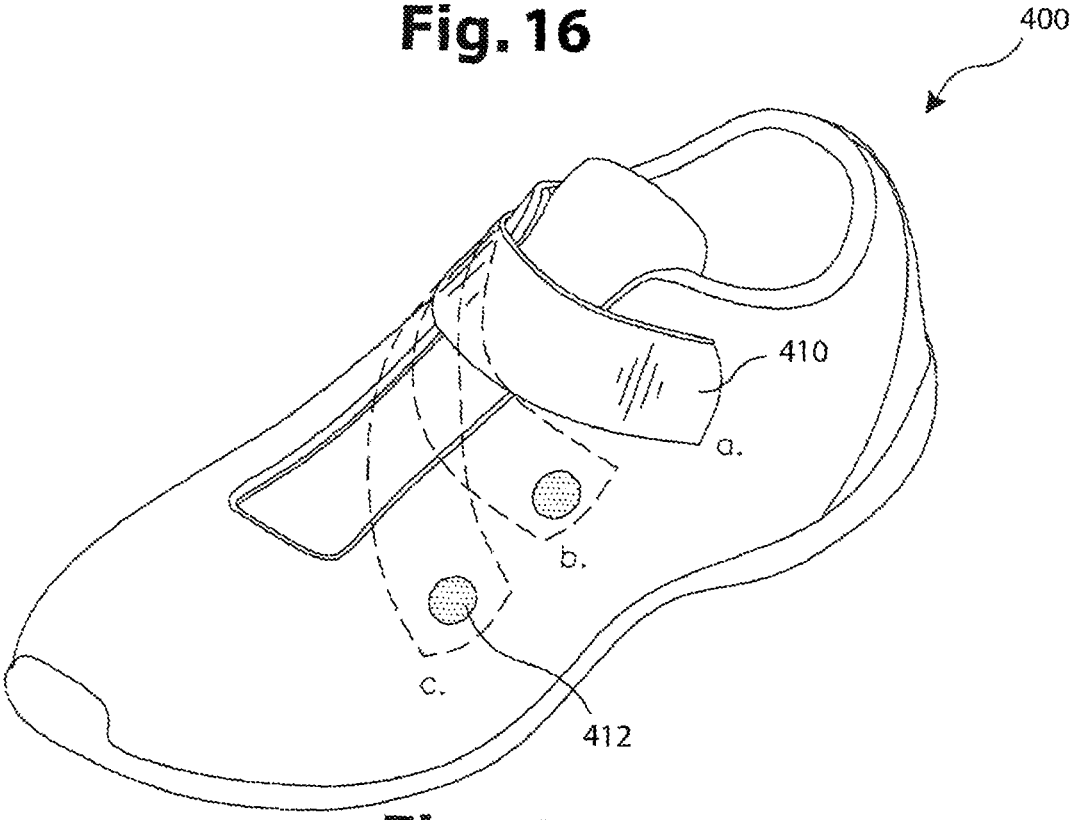

FIG. 17 illustrates a concept similar to that of FIG. 16 except that the distal end of the strap 410 is not coupled with a reel based closure device. Rather, the distal tip or end of the strap 410 is directly attached or coupled to the side of the shoe 400 in one of multiple positions or areas illustrated by zones "a", "b", and "c". The configuration and use of the strap 410 is similar to that of FIG. 16 except that the reel based closure device (not shown), or another tensioning mechanism, is position on the opposite side of the shoe or elsewhere on the shoe 400 as desired, such as on the shoe's heel or tongue. The distal end of the strap 410 is coupled with the shoe 400 via fasteners 412, which in the illustrated embodiment are hook and loop type fasteners. The strap 410 is illustrated as being coupled with zone "a" of the shoe, but is also shown in dashed lines as being coupled with zones "b" and "c".

In another embodiment, the concepts of FIGS. 16 and 17 could be combined so that the reel based closure device 404 and the strap 410 are both movable between one or more positions along the eyestay of the shoe 400. In such embodiments, the entire strap could be removed from the shoe 400 and both ends could be fastened to a desired fastener—i.e., the reel based closure device 404 could be attached to a desired fastener 406 and the strap 410 could be attached to a desired fastener 412. In such instances, the entire orientation and positioning of the strap about the shoe 400 could be modified as desired.

Figure 18A:
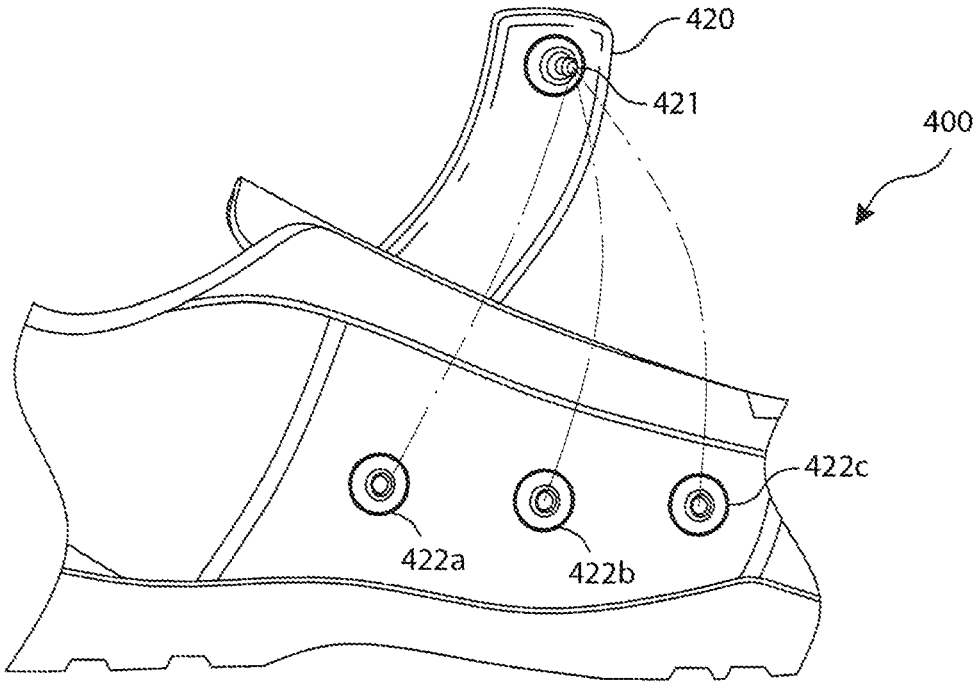
FIGS. 18A-B illustrate alternative means of coupling a strap with a side of a footwear.
Figure 18B:
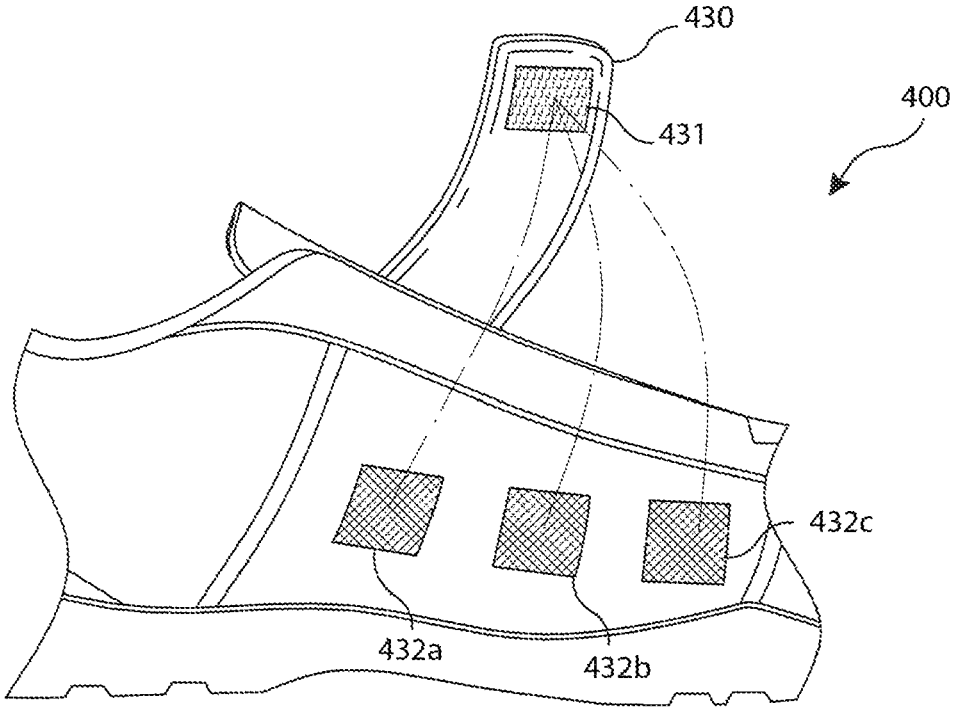

FIGS. 18A-B illustrate alternative means of coupling a strap with a side of a shoe 400. In FIG. 18A, the strap 420 includes a snap button 421 that is able to snap into engagement with a corresponding snap button 422*a-c* that is attached to the shoe and positioned within a respective zone. The snap button 421 may be uncoupled with one of the snap buttons, 422*a-c*, and re-engaged with another snap button, 422*a-c*, to change the position or orientation of the strap 420 about the shoe 400. FIG. 18B likewise illustrates a strap 430 that includes a component 431 that is configured to releasably engage with a corresponding component 432*a-c* attached to the shoe and positioned within a desired zone. The components of the strap 430 and shoe 400 may be magnetic components, adhesive based components, and the like.

Figure 19A:
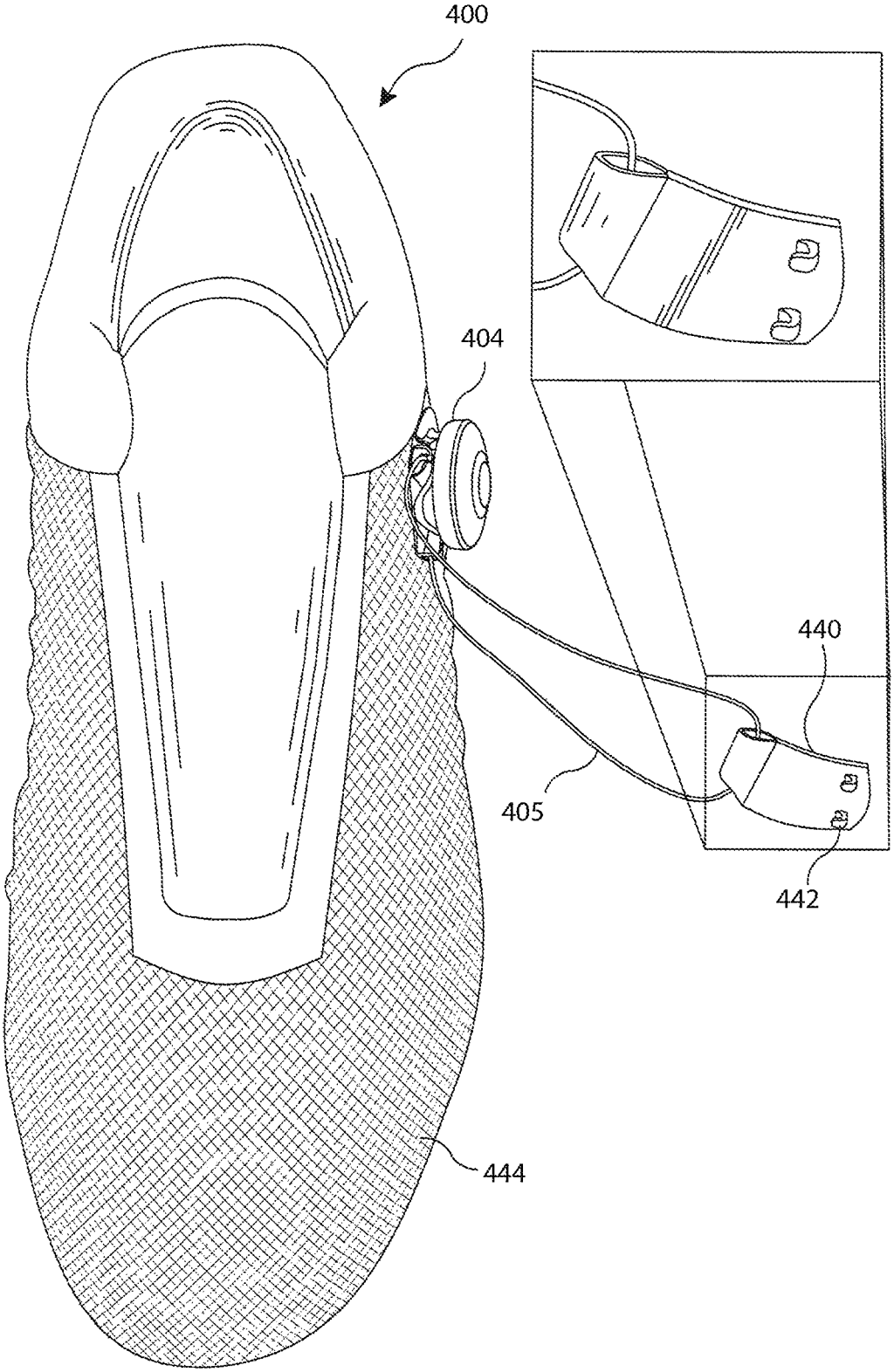
FIGS. 19A-B illustrate other alternative means of coupling a strap with a side of a footwear.
Figure 19B:
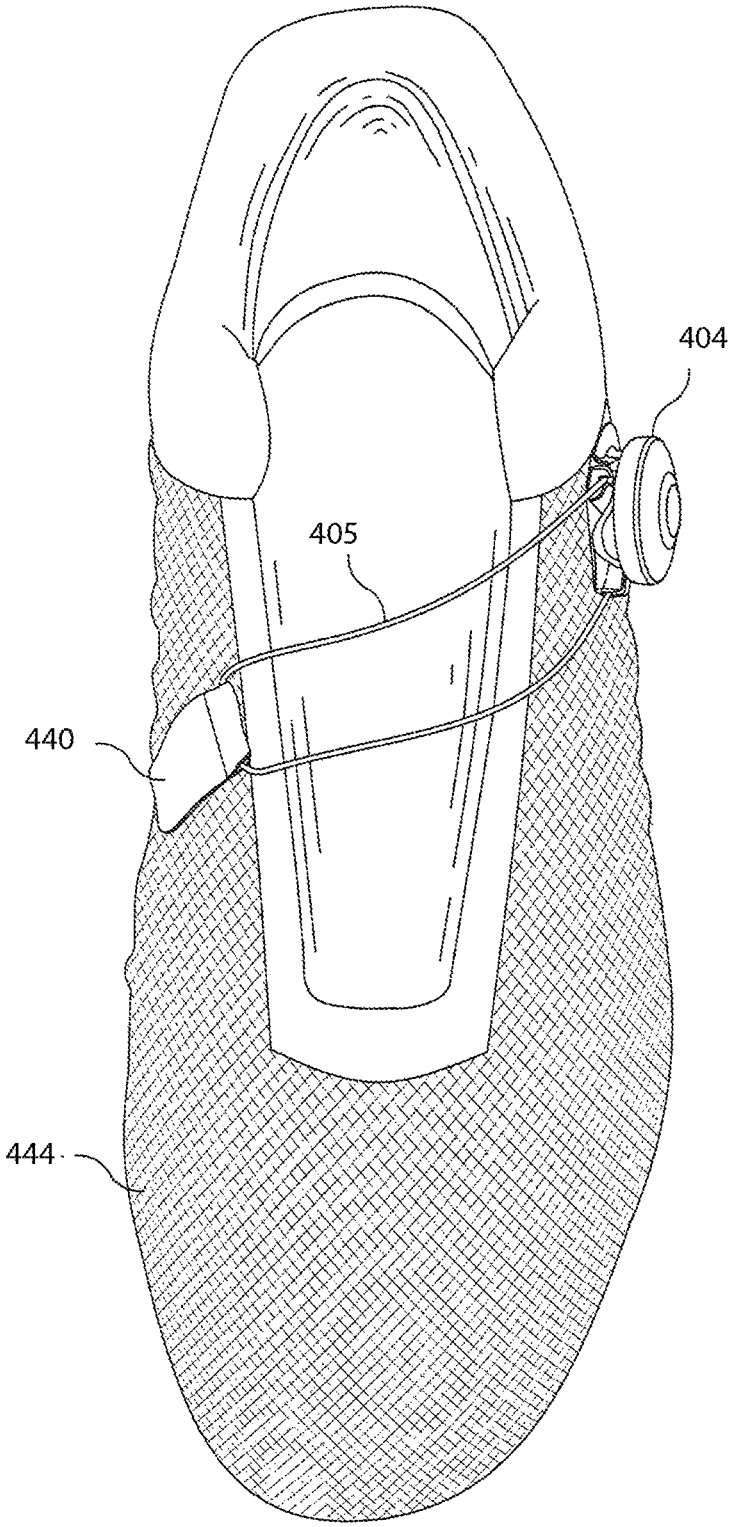

FIGS. 19A-B illustrate other alternative means of coupling a strap with a side of a shoe 400. In particular, the shoe 400 is made of an outer material 444 that may be mesh, woven, knitted, or any other material that is relatively open and/or porous. The reel based closure device 404 is attached to a side of the shoe 400 (or elsewhere as desired) and the lace 405 that is coupled with the reel based closure device 404 is coupled with an attachment component 440, such as by inserting or threading the lace 405 through a looped proximal end of the attachment component 440. The attachment component 440 includes a pair of hooks or grip members 442 that are configured to grip or couple with the outer material 444 of the shoe 400. This design allows the component 440 to be pulled across an opening of the shoe 400, such as the tongue, and attached to an opposite side of the shoe 400 as illustrated in FIG. 19B. Subsequent operation of the reel based closure device 404 functions to tension the attachment component 440 and the opposite side of the shoe 400, which closes and tightens the shoe about the user's foot.

Although not illustrated, in some embodiments the length of lace 405 between the reel based closure device 404 and the attachment component 440 may be replaced with a strap or other tensionable member, such as those illustrated in FIGS. 25A-26C. The design of the outer material 444 and the attachment component 440 enables the lace 405, or a strap, to be positioned or oriented essentially anywhere in relation to the shoe 400 rather than the pre-designated zones (i.e., zones "a", "b", and "c") of the previous figures. Thus, the fit of the shoe 400 may be customized to a greater degree with the design of FIGS. 19A-B in comparison with the previous figures. In other embodiments, the outer material 444 may extend over only a designated portion of the shoe 400 rather than essentially the entire outer surface, which may provide great latitude in customizing the fit of the shoe within a pre-designated area or range.

Figure 20A:
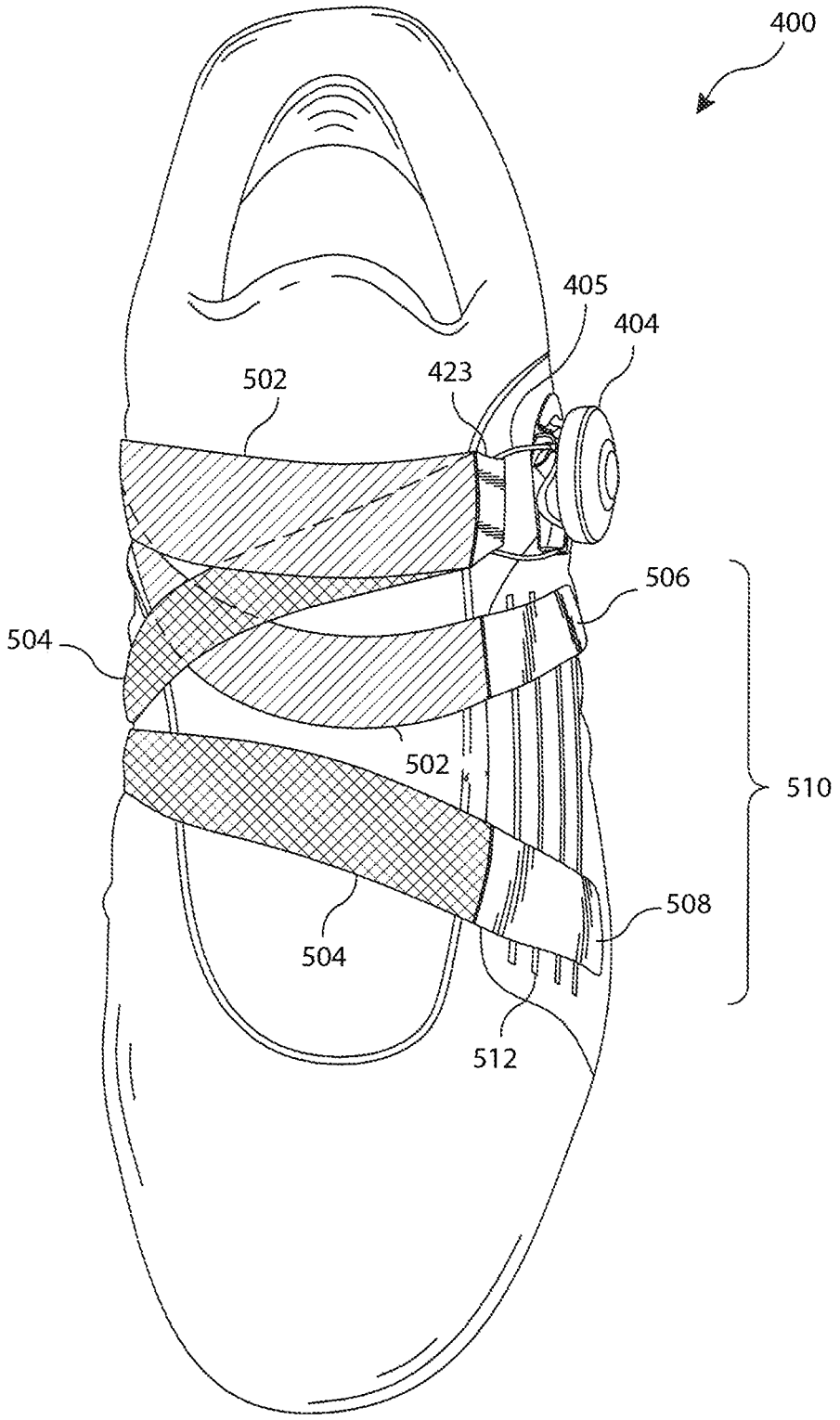
FIGS. 20A-C illustrate an embodiment in which a reel based closure device is coupled with a plurality of straps so that operation of the reel based closure device simultaneously tensions each of the straps.
Figure 20B:
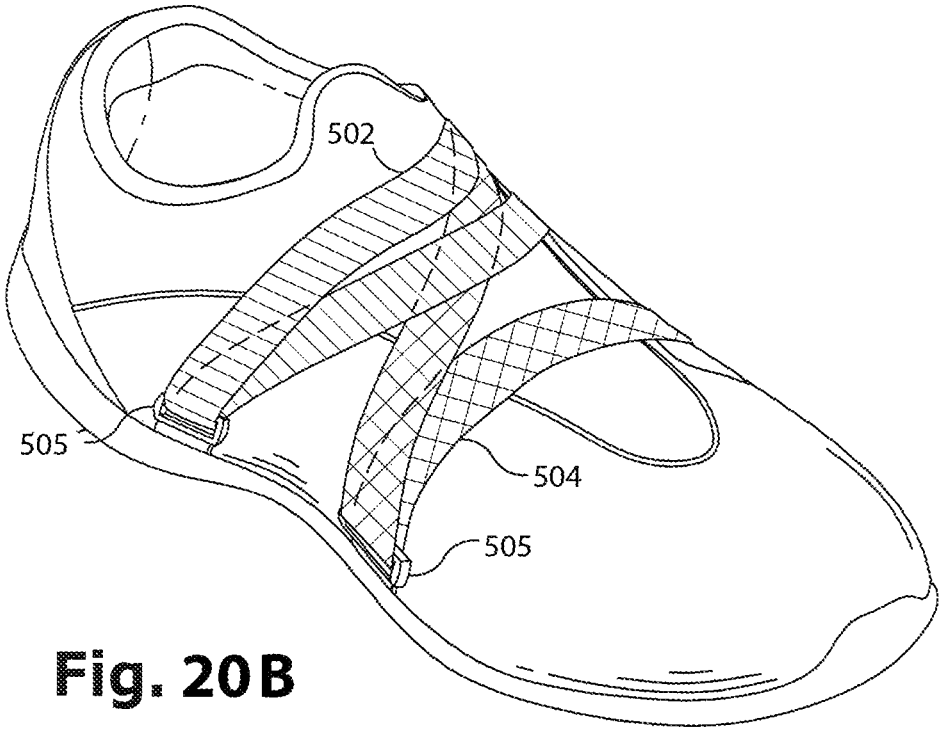
Figure 20C:
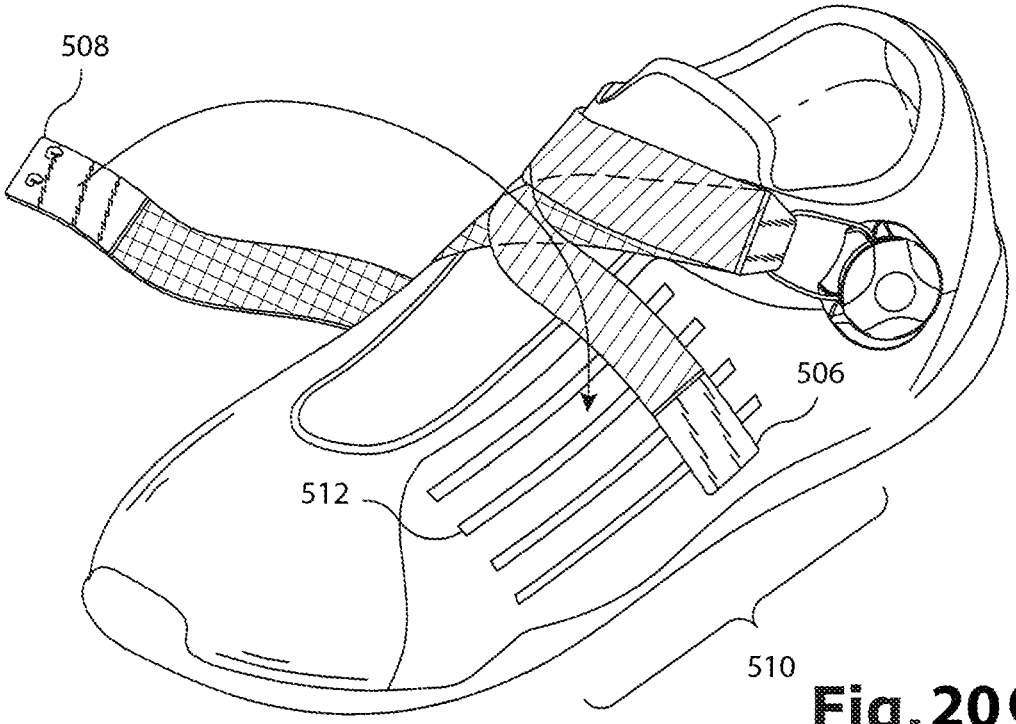

FIGS. 20A-C illustrate an embodiment in which the reel based closure device 404 is coupled with a plurality of straps so that operation of the reel based closure device 404 simultaneously tensions each of the straps. Specifically, the reel based closure device 404 is coupled with the lace 405, which is in turn coupled with a proximal guide 423. The proximal guide 423 is attached or coupled with a proximal end of a first strap 502 and a proximal end of a second strap 504. Operation of the reel based closure device 404 causes the first strap 502 and the second strap 504 to be simultaneously tensioned.

The first strap 502 and the second strap 504 are each routed across an opening of the shoe 400, such as across the shoe's tongue. As shown in FIG. 20B, the first and second straps, 502 and 504, are each routed through a guide or ring 505 that redirects or routes the respective strap back across the opening of the shoe 400. A distal end of each of the straps, 502 and 504, includes an attachment component that is able to couple with the side of the shoe. In particular, a distal end of the first strap 502 includes an attachment component 506 that includes a fastener or fastening member (e.g., hook and loop, magnet, button, pair or hooks or grips, etc.) that is able to attach to the side of the shoe 400 as described herein. The distal end of the second strap 504 likewise includes an attachment component 508 that is able to attach to the side of the shoe 400.

In some embodiments, the shoe 400 may include a tightening area or region 510 within which the attachment components, 506 and 508, are able to attach to the shoe 400. The tightening region 510 may include a mesh material, Velcro® material, woven material, magnets, and the like, as described or contemplated herein to enable the attachment components, 506 and 508, to attach or couple with the shoe 400. In some instances, the attachment components, 506 and 508, may not be able to attach or coupled with the shoe 400 outside of the tightening region 510. As shown in FIG. 20C, the distal ends of the respective straps, 502 and 504, may be moved or positioned essentially anywhere within the tightening region 510 and attached to the side of the shoe, which affects how the shoe 400 will fit and/or tighten about the user's foot. For example, each of the straps, 502 and 504, may tighten a different zone or portion of the shoe 400, such as the first strap 502 tightening the shoe's collar while the second strap 504 tightens the shoe's toe box. The tightness of the shoe in these zones is affected by how the distal end of the respective strap, 502 or 504, is positioned within the tightening region 510 and coupled with the shoe.

In some instances, the tightening region 510 may include discrete or individual coupling members 512 such as strips or sections of material to which the attachment components, 506 and 508, may be attached. In this manner, the position of the distal end of the straps, 502 and 504, may be limited to pre-designated attachment areas or orientations. In some instances, the straps, 502 and 504, could be made of a flexible material that changes its visual appearance under tension, such as those described in relation to FIGS. 25A-B. In such embodiments a level of tension that is applied in each zone via the straps, 502 and 504, may be visually indicated.

Figure 21A:
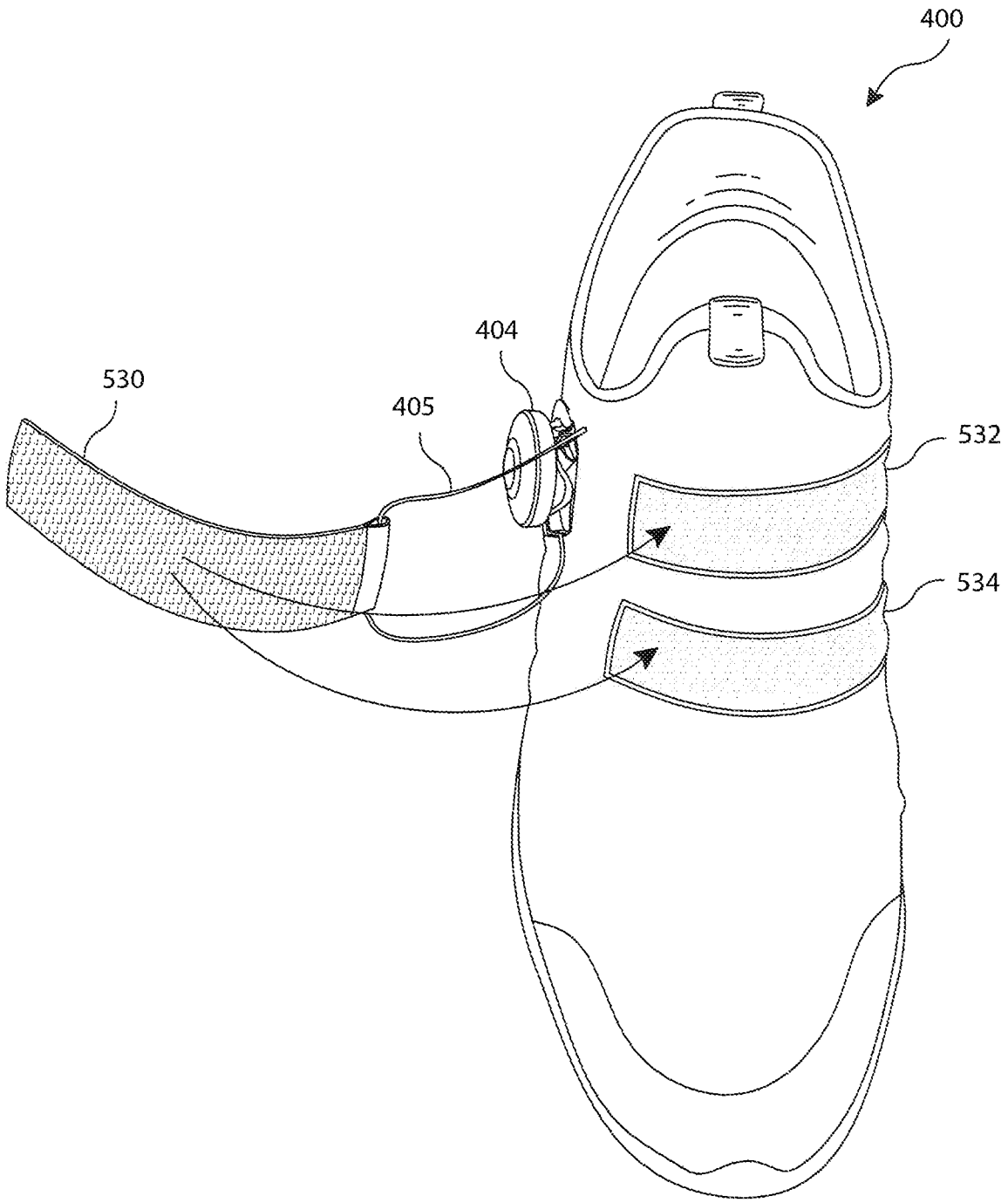
FIGS. 21A-B illustrate an embodiment in which an adjustability of a footwear's fit is constrained to pre-designated or defined areas.
Figure 21B:
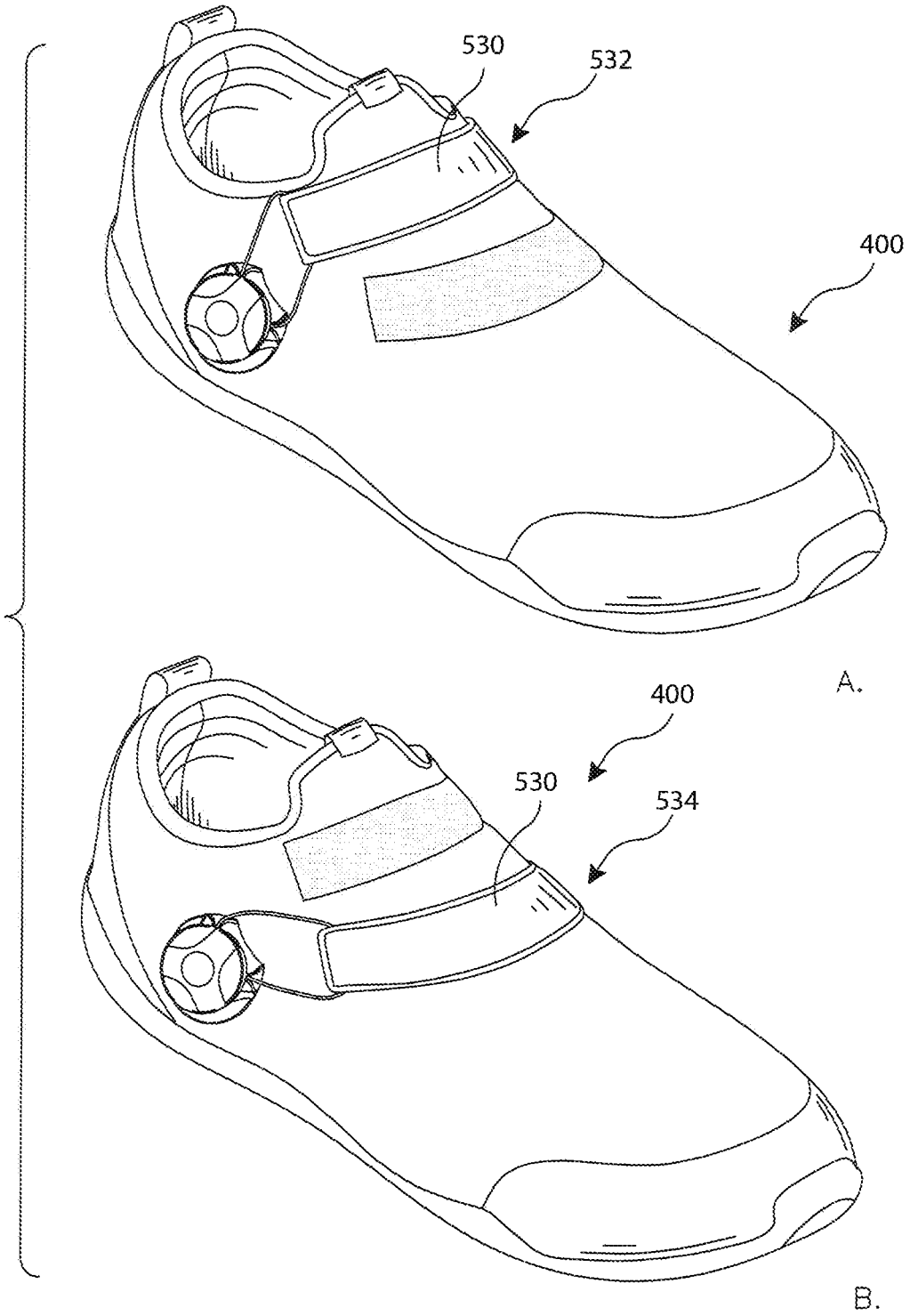

FIGS. 21A-B illustrate an embodiment in which the adjustability of the shoe's fit is constrained to pre-designated areas. Specifically, the shoe 400 includes multiple dedicated or pre-designated coupling zones, 532 and 534, to which a strap 530 may be attached. The dedicated coupling zones, 532 and 534, may be elongate strips or sections of a hook and loop type fastener material or another fastening material, such as magnets, adhesive based or tacky materials, and the like. The strap 530 includes a corresponding fastening material that enables the strap 530 to attach to one of the dedicated coupling zones, 532 or 534. The use of the elongate strips of fastening material may enable a greater or stronger coupling of the strap 530 to the shoe, which may be desired when substantial forces are imposed on the foot and shoe. The reel based closure device 404 is attached to the lace 405, which is in turn attached to the proximal end of the strap 530. FIG. 21B illustrates the strap 530 being attached to an upper coupling zone 532 and to a lower coupling zone 534.

An advantage of the dedicated coupling zones, 532 and 534, is that the shoe 400 is still configured with the ability to adjust the fit or tightness of the shoe 400, but the adjustability of the fit or tightness is simplified to a degree that may appeal to a greater number of people. Stated differently, the adjustability is not too complex so as to prevent an average person from utilizing or underutilizing the adjustability. The position or orientation of the dedicated coupling zones, 532 and 534, about the shoe may be designed to provide or achieve a tightness or fit based on a given activity or event. For example, in hiking it may be desirable to tighten the shoe 400 nearer to the toe box during ascent and to tighten the shoe 400 nearer to the collar or ankle during descent in order to prevent the user's toes from striking the front of the shoe 400. The dedicated zones, 532 and 534, may be oriented about the shoe and configured to provide this desired fit and tightness and thus, the user may adjust the fit of the shoe 400 without engaging in an overly complex process.

Figure 22A:
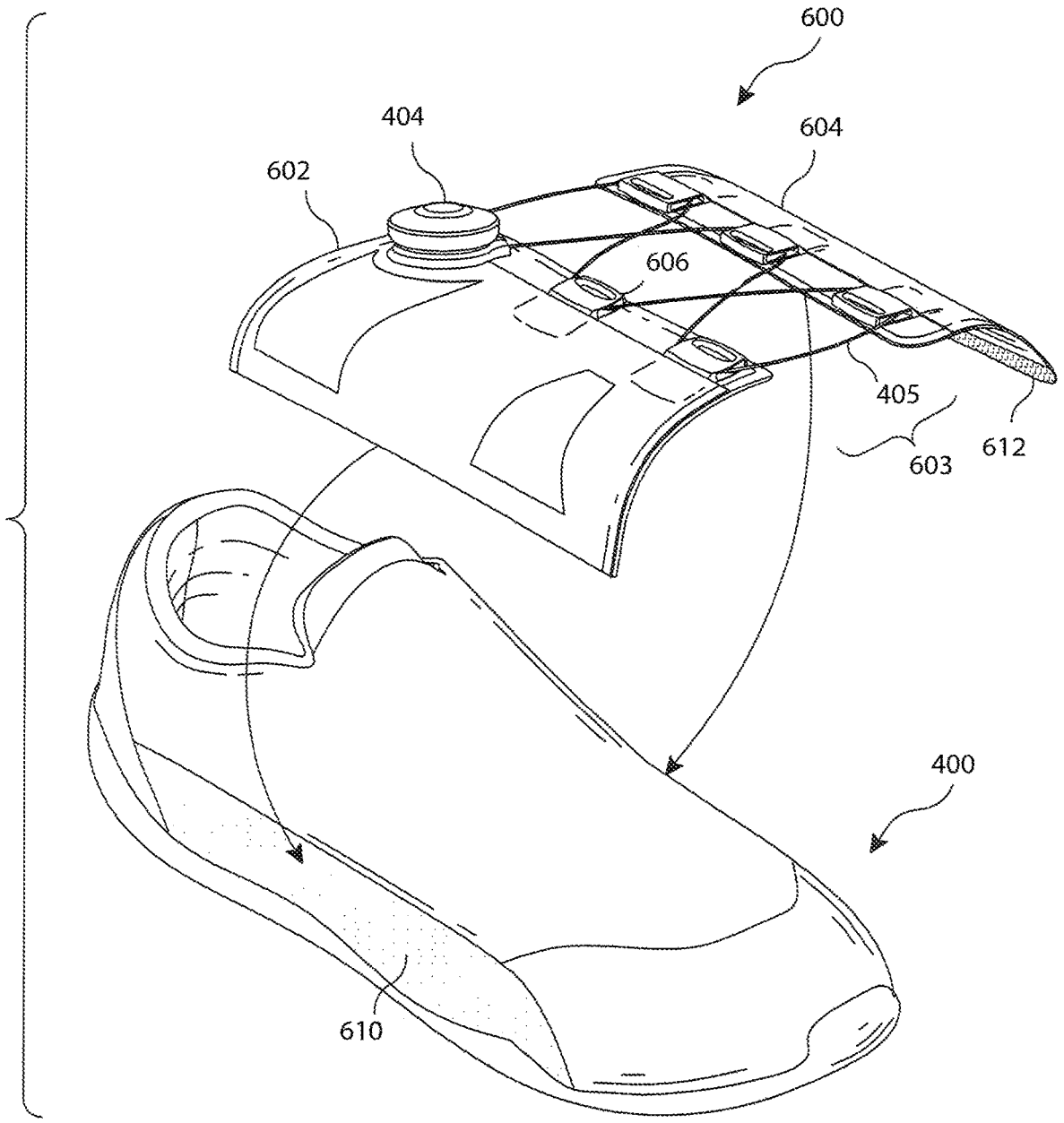
FIGS. 22A-B illustrate an embodiment in which a separate tensioning panel or member is attached to footwear.
Figure 22B:
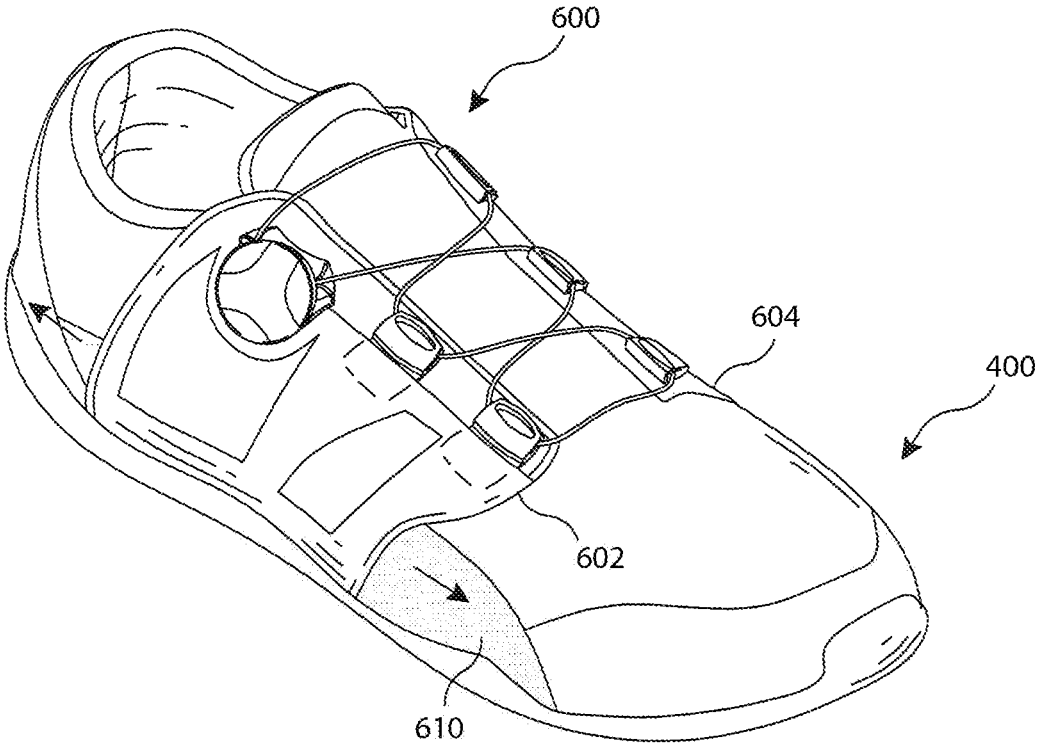

FIGS. 22A-B illustrate an embodiment in which a separate tensioning panel or member 600 is attached to the shoe 400. The tensioning panel 600 includes a first member 602 and a second member 604 that are separated by a gap 603. The reel based closure device 404 is positioned on the first member 602 and is coupled with the lace 405, which is routed or directed across the gap 603 via one or more guides 606. The tensioning panel 600 is configured to be removably coupled with the shoe 400. Specifically, an inner edge of the first member 602 and the second member 604 includes a fastening material or component 612 that is able to attach or couple with an outer material 610 of the shoe 400. The outer material 610 of the shoe 400 is positioned on both sides of the shoe 400, typically near the sole, so that the tensioning panel 600 may be placed or positioned atop the shoe 400 with the inner edge of the first member 602 and the second member 604 contacting the outer material 610, which causes the tensioning panel 600 to attach or couple with the shoe 400. This placement of the tensioning panel 600 about the shoe 400 is illustrated in FIG. 22B. Operation of the reel based closure device 404 causes the tensioning panel 600 to constrict atop and about the shoe 400, which causes the shoe 400 to constrict or tighten about the foot.

As further illustrated in FIG. 22B, the tensioning panel 600 may be moved laterally about the shoe 400 toward the heel or toe box as desired, which affects how the tensioning panel 600 causes the shoe 400 to constrict or tighten about the foot. In some embodiments, one side of the tensioning panel 600 (e.g., the second side 604) may be fixedly attached to a side of the shoe 400 while the other side of the tensioning panel 600 (e.g., the first side 602) is detached from, but coupleable to, the opposite side of the shoe 400. An advantage of the separate tensioning panel 600 is that the panel may be removed for various reasons, such as replacing the panel with a different panel that is designed to provide a different fit and/or feel when tensioned. The tensioning panel 600 may also be replaced to provide a different aesthetic such as replacing hard and rigid plastic guides with softer more flexible fabric or woven guides.

Figure 23A:
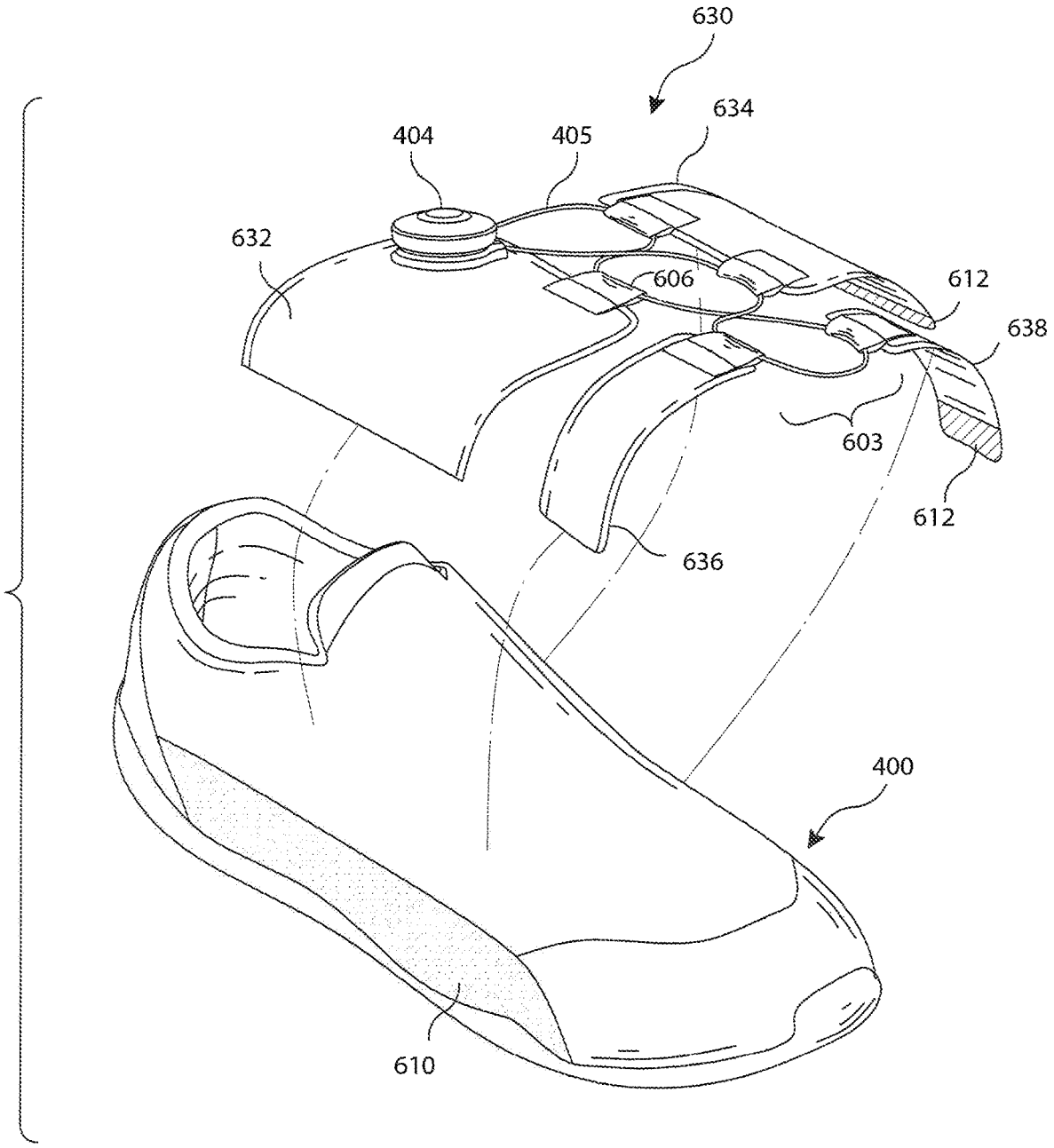
FIGS. 23A-C illustrate an embodiment similar to FIGS. 22A-B except that a tensioning panel includes additional panel members.
Figure 23B:
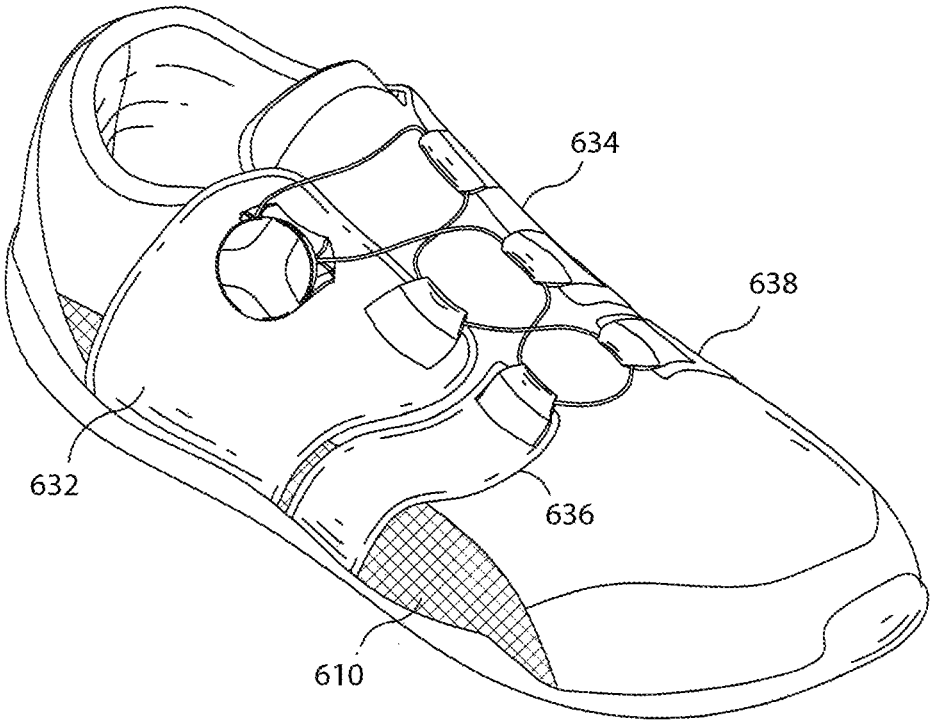
Figure 23C:
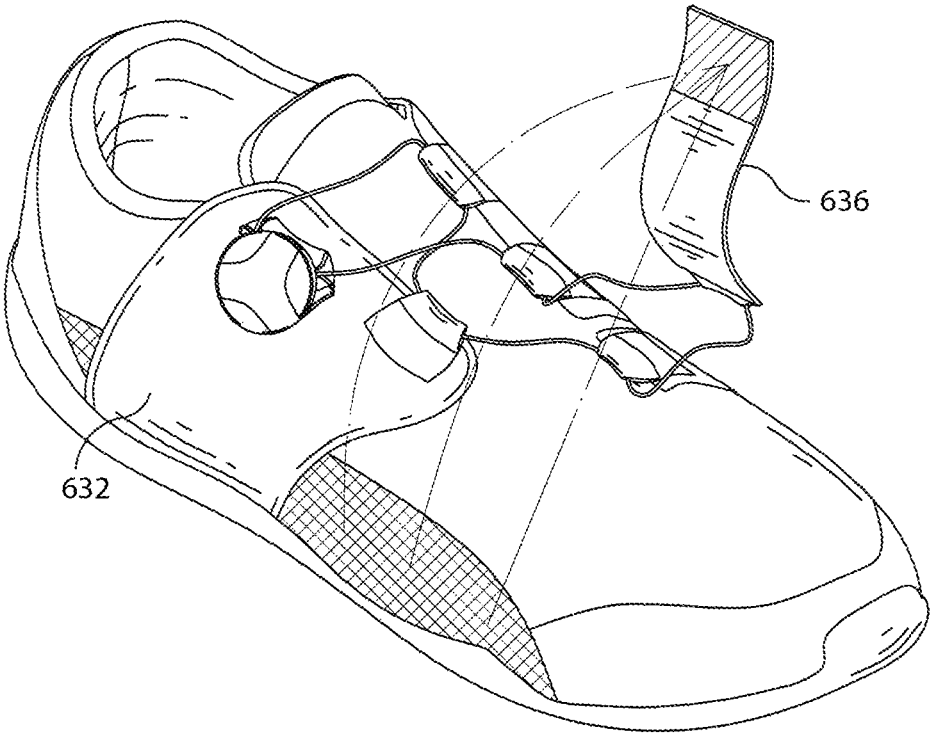

FIGS. 23A-C illustrate a similar embodiment except that the tensioning panel 630 includes additional panel members. Specifically, the tensioning panel 630 includes a first member 632, a second member 634, a third member 636, a fourth member 638. The first member 632 and the third member 636 are positioned on one side of the gap or opening 603 while the second member 634 and the fourth member 638 are positioned on an opposite side of the gap 603. As illustrated in FIG. 23B, when the tensioning panel 630 is positioned atop the shoe 400, the first member 632 and the third member 636 are positioned on one side of the shoe 400 (e.g., lateral side) while the second member 634 and the fourth member 638 are positioned on the opposite side of the shoe 400 (e.g., medial side).

In one embodiment, each of the members (i.e., 632, 634, 636, and 638) include the fastening material or component 612 that is able to attach or couple with the outer material 610 of the shoe 400. In such an embodiment, each of the members (i.e., 632, 634, 636, and 638) may be moved independently along the shoe 400 between the heel and toe box and coupled with the outer material 610 as desired. For example, FIG. 23C illustrates the third member 636 being repositioned about the outer material and shoe 400 while the first member 632, the second member 634, and the fourth member 638 remain attached to the outer material 610. The tensioning panel 630 of FIGS. 23A-C provides a greater latitude or freedom in positioning and attaching the tensioning panel 630 to the shoe 400 in comparison with the tensioning panel 300 of FIGS. 22A-B.

In other embodiments, one or more of the members (i.e., 632, 634, 636, or 638) may be fixedly attached to the shoe 400 while the other members are able to be moved and repositioned about the outer material 610 and shoe 400. For example, the first member 632 and/or the second member 634 may be fixed or anchored to the shoe 400 while the third member 636 and/or the fourth member 638 are removably attachable to the shoe 400, or vice versa.

Figure 24A:
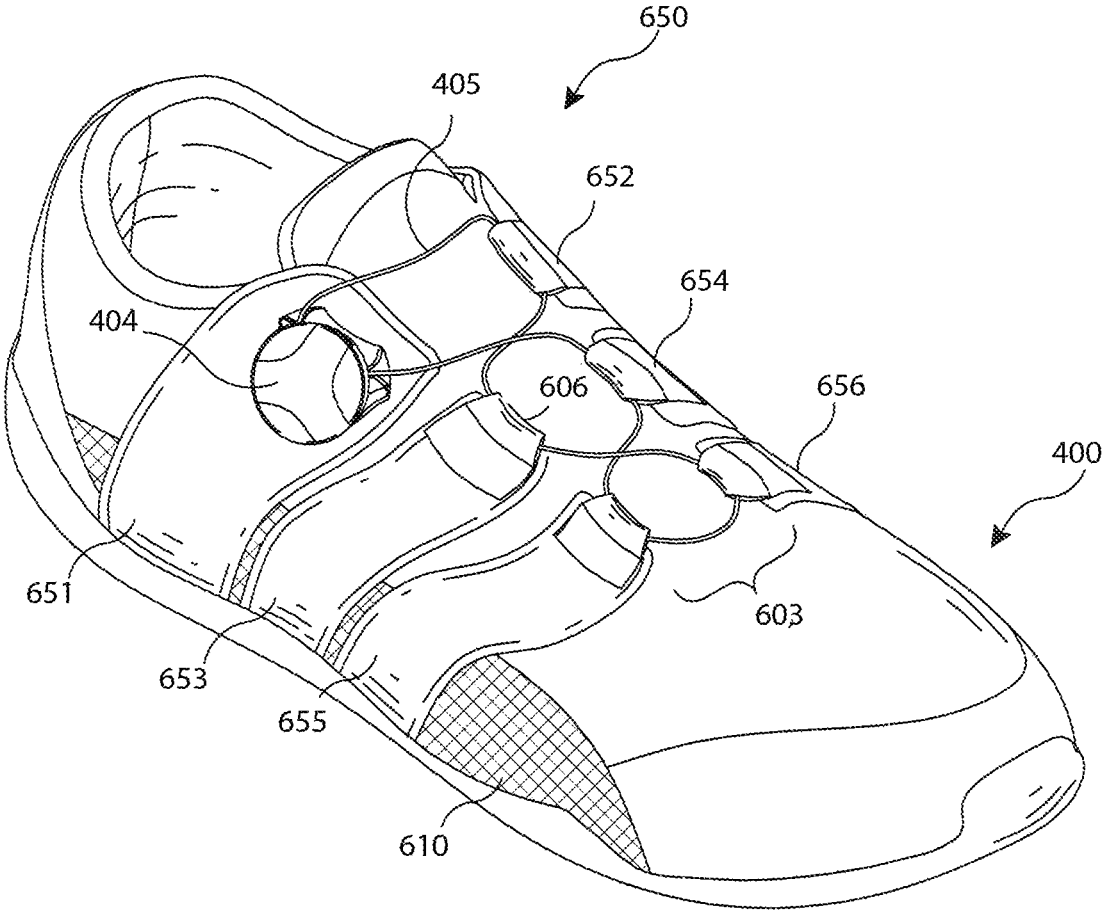
FIGS. 24A-B illustrate a tensioning panel similar to those of FIGS. 22A-B and FIGS. 23A-C except that the tensioning panel includes six separate and individual panel members.
Figure 24B:
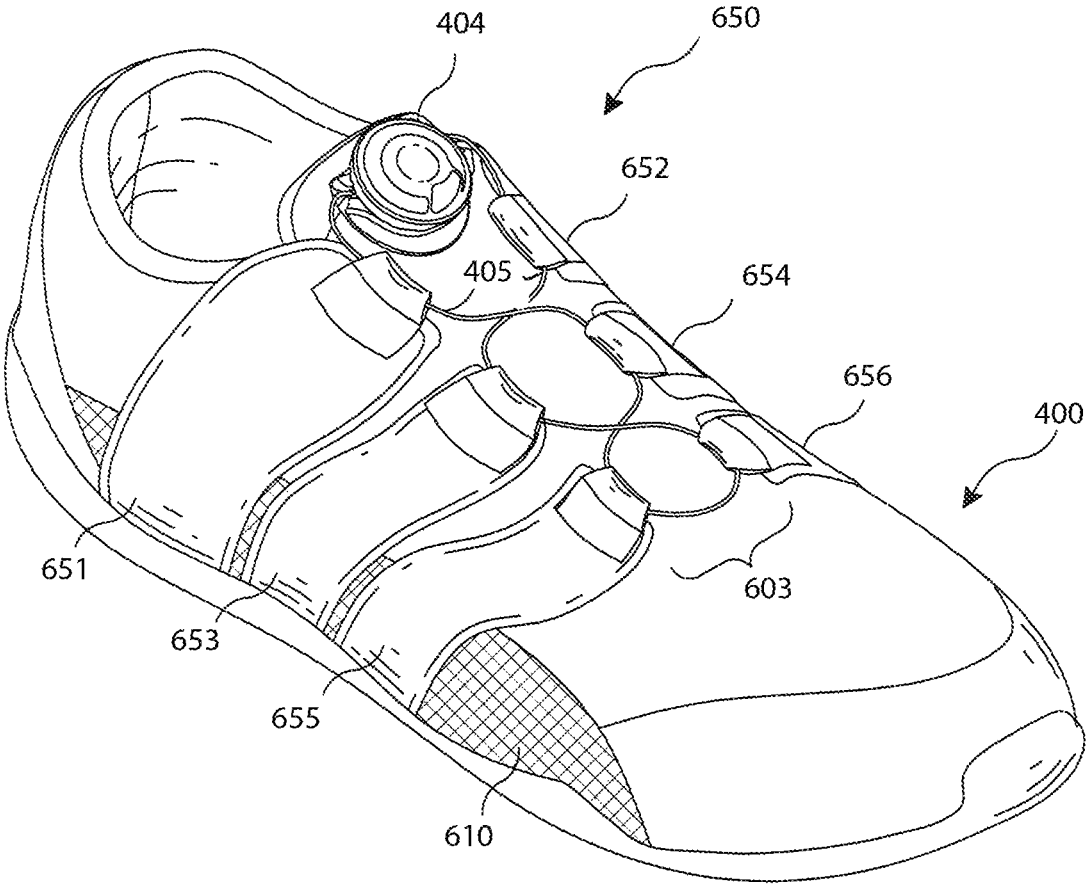

FIGS. 24A-B illustrate a similar tensioning panel 650 except that the tensioning panel 650 includes six separate and individual panel members. Specifically, the tensioning panel 650 includes a first member 651, a third member 653, and a fifth member 655 that are positioned on one side of the gap 603 and the shoe 400 and also include a second member 652, a fourth member 654, and a sixth member 656 that are positioned on an opposite side of the gap 603 and the shoe 400. In one embodiment, each of the members (651-656) include the fastening material or component 612 that is able to attach or couple with the outer material 610 of the shoe 400 and as such, each of the members (651-656) may be moved independently from one another along the shoe 400 between the heel and toe and coupled with the outer material 610. Thus, the tensioning panel 650 of FIGS. 24A-B provides an even greater latitude or freedom in attaching the tensioning panel 650 to the shoe 400 in comparison with the tensioning panels of FIGS. 22A-23C. In other embodiments, one or more of the members (651-656) may be fixedly attached to the shoe 400 while the other members are able to be moved and repositioned about the outer material 610 and shoe 400.

FIGS. 24A-B also illustrate that the position of the reel based closure device 404 may be varied. Specifically, in FIG. 24A the reel based closure device 404 is positioned on the first member 651 whereas in FIG. 24B the reel based closure device 404 is attached to the shoe's tongue. The reel based closure device 404 may likewise be positioned elsewhere on the shoe 400, such as on the heel of the shoe 400, as desired. The differing placement of the reel based closure device 404 (e.g., tongue or heel placement) may similarly be employed in the tensioning panels of FIGS. 22A-23C as desired.

Figure 25A:
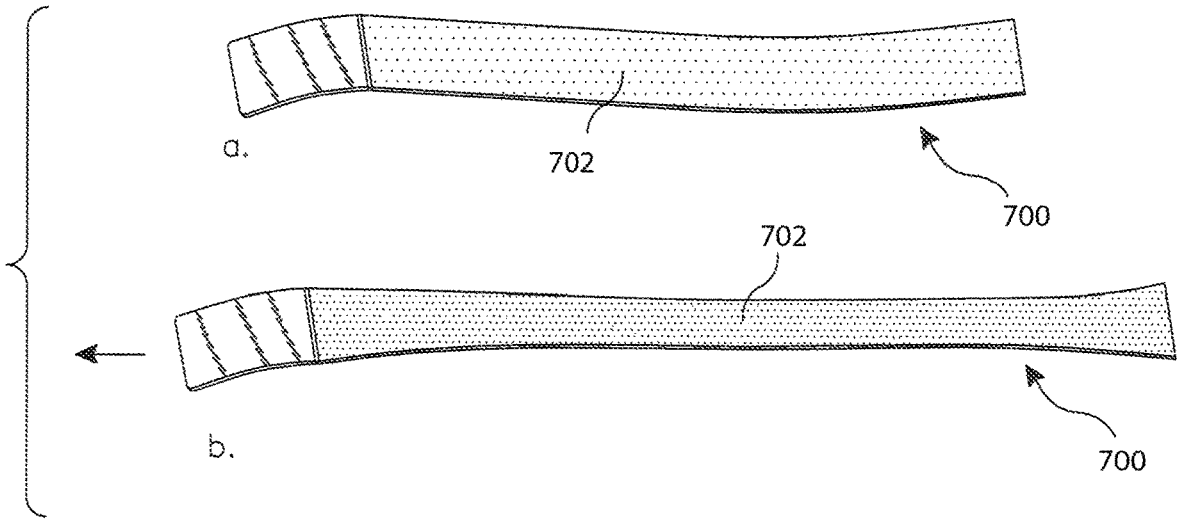
FIGS. 25A-B illustrate embodiments of straps that may be employed to visually indicate a level of tension that is imposed on the strap due to operation of a tensioning mechanism.
Figure 25B:
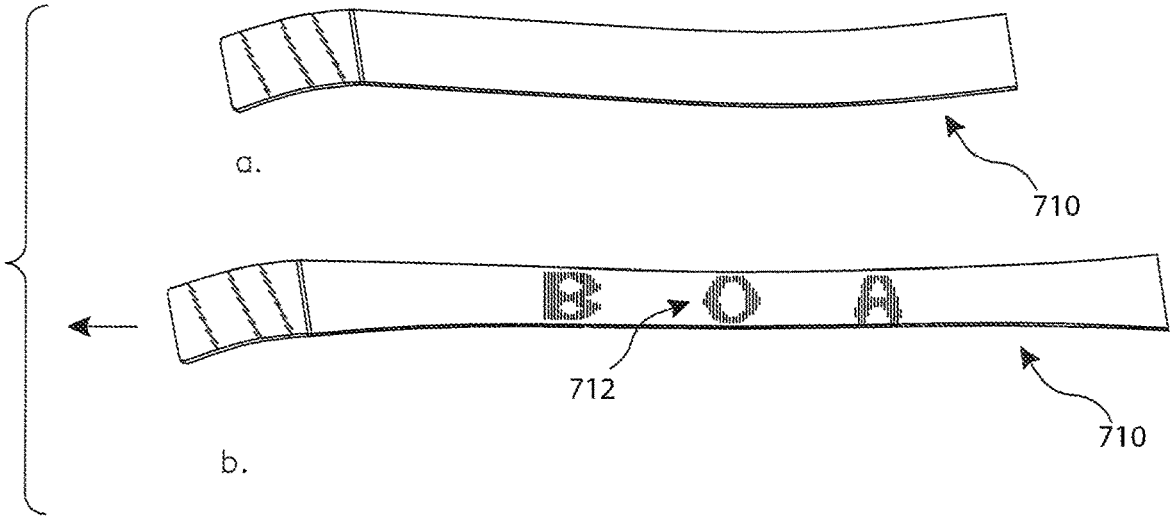

FIGS. 25A-B illustrate embodiments of straps that may be employed to visually indicate a level of tension that is imposed on the strap due to operation of the reel based closure device 404, or some other lace tensioning mechanism. The straps of FIGS. 25A-B may be used with any of the embodiments described or contemplated herein, or may be used with any other products or articles that require closure and/or tightening.

In FIG. 25A, the strap 700 is illustrated in an un-tensioned or relaxed state (i.e., image "a") and in a tensioned state (i.e., image "b"). The strap 700 includes indicia 702, such as a plurality of relatively evenly spaced dots or markings. In the un-tensioned or relaxed state, the indicia 702 is broadly spaced apart. In the tensioned state, the indicia 702 is more tightly or densely packed or spaced, which may make the strap 700 appear slightly darker in color or provide some other visual signal. The visual signal that is provided by the strap 700, such as due to the tightly or densely packed indicia 702, correlates or corresponds to the tension that is imposed on the strap 700. The visual signal may vary in accordance with the tension that is imposed on the strap 700, such as the strap 700 becoming visually darker as the tension increases. A user may learn to recognize the visual signal and may correlate that signal with a given tension in the strap 700 and/or a given fit or tightness of the shoe 400 about the foot. In this manner, the user may tension the strap 700 until a given visual signal is produced, which would indicate that a desired fit or tightness of the shoe 400 has been achieved.

In FIG. 25B, the strap 710 is also shown in an un-tensioned or relaxed state (i.e., image "a") and in a tensioned state (i.e., image "b"). The strap 710 likewise includes indicia 712, but the strap 710 is configured so that the indicia 712 is not visually apparent until the strap 710 is tensioned. For example, in the relaxed state (i.e., image "a"), the strap 710 may appear to be devoid of or otherwise lacking the indicia 712. Stated differently, the indicia 712 may be hidden from view in the relaxed state. As the strap 710 is tensioned, however, the indicia 712 may become visually apparent as illustrated in image "b". The indicia 712 may be a word, a phrase, a symbol, or any other desired object that becomes visible as the strap 710 is tensioned. The indicia 712 may be marked or etched on the strap 710 so that as the material of the strap 710 is relaxed and more tightly packed/spaced, the indicia 712 is not visible. As the material stretches and becomes less dense, the markings or etching may align and appear visible to the user. As with the strap 700 of FIG. 25A, the user may correlate the indicia with a given tension in the strap 710 and/or tightness or fit of the shoe 400.

Figure 26B:
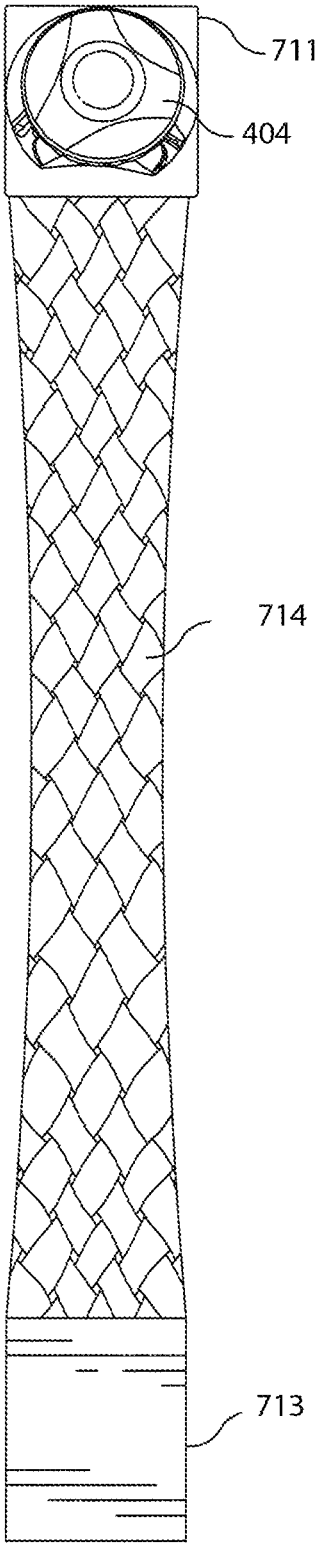
FIGS. 26A-C illustrate an embodiment of a strap that is designed to distribute a force that is imposed on an article due to tensioning of a lace or tension member.
Figure 26A:
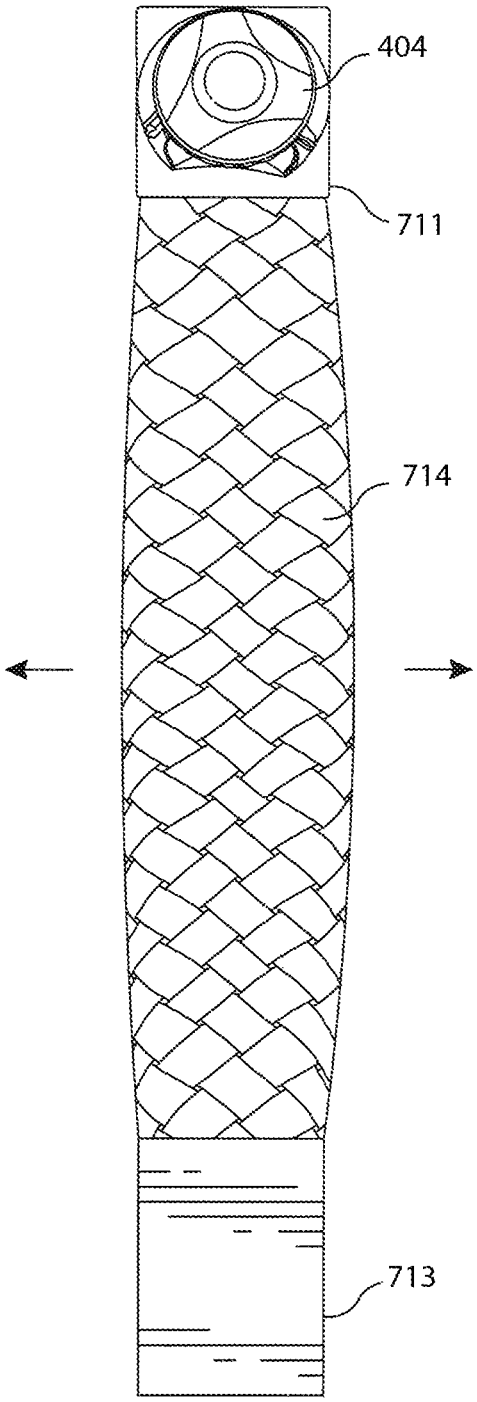
Figure 26C:
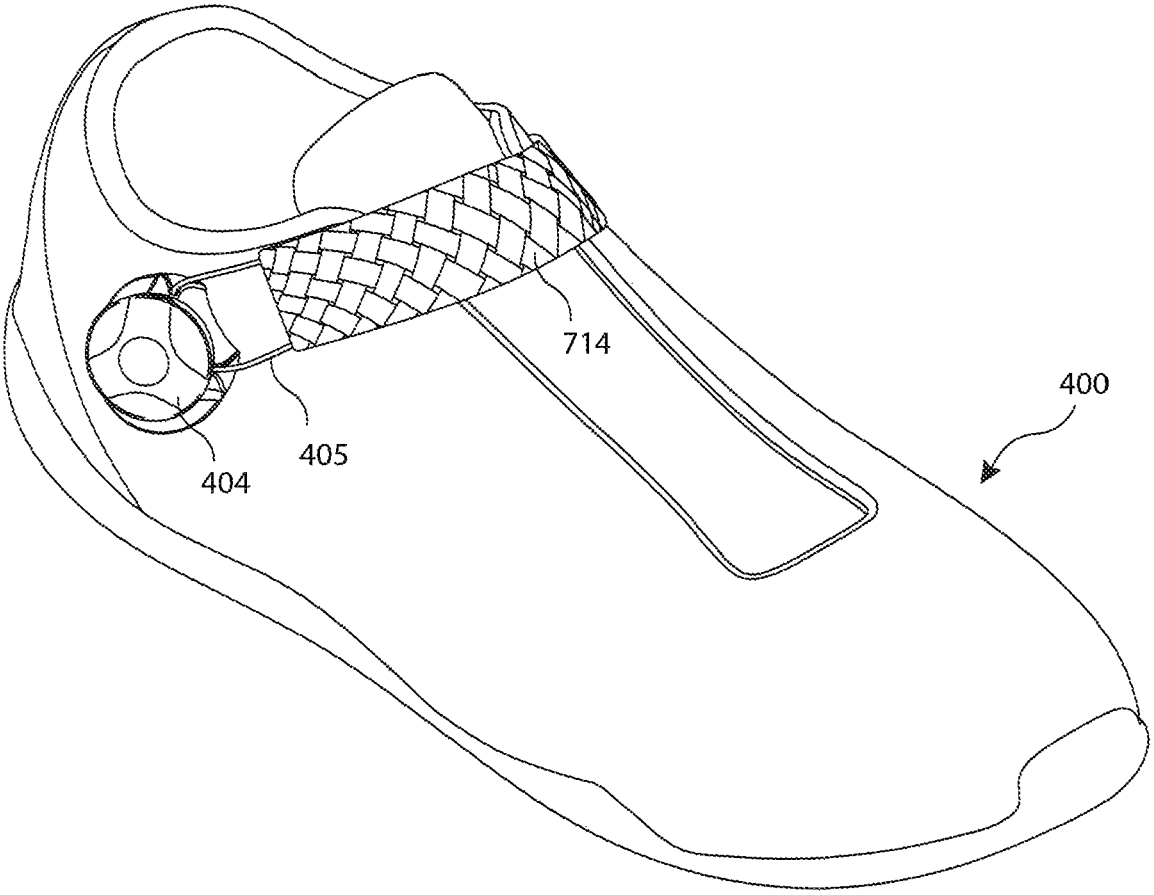

FIGS. 26A-C illustrate another embodiment of a strap that may be used with any of the embodiments described or contemplated herein, or may be used with any other products or articles that require closure and/or tightening. The strap of FIGS. 26A-C is designed to distribute a force that is imposed on the shoe 400 or other article due to tensioning the lace 405. In particular, when the lace 405 or a strap is positioned atop a shoe 400, the lace 405 or strap may impose a downward force onto the shoe, which a user may feel pressing on the top of their foot. The downward force may be relatively uncomfortable and/or irritating, especially when the lace is tensioned to a significant degree. The strap of FIGS. 26A-C helps alleviate these potential issues by distributing the force across a greater area of the shoe 400. The straps distribute the force across a greater area by flexing laterally outward as the lace 405 is tensioned.

For example, FIG. 26A illustrate the strap in which the lace 405 is in a relaxed or un-tensioned state. The strap includes a proximal end 711 and a distal end 713 with a woven material 714 that is disposed there between. The lace 405 is disposed within the woven material 714, which forms a channel or tunnel through which the lace 405 is inserted. The lace 405 is operationally coupled with the reel based closure device 404 and with the distal end 713 of the strap so that tensioning of the lace 405 causes the distal end 713 of the strap to move toward the proximal end 711. The woven material 714 is woven so that as the distal end 713 of the strap moves toward the proximal end 711, the woven material 714 flexes or moves laterally outward. FIG. 26B illustrates the strap in which the lace 405 is in a tensioned state and in which the distal end 713 of the strap has moved toward the proximal end 711. As a result of this movement, the woven material 714 is flexed or moved laterally outward so that the strap has a greater lateral width in comparison with that of FIG. 26A. In some instances, the woven material 714 may have a bulging appearance toward the center of the strap. The woven material 714 may have a helically wound braid or any other weave that results in the material flexing or moving laterally outward as the lace 405 is tensioned. The material that is used in the woven portion of the strap may be relatively rigid to resist buckling from the compressive forces that are imparted on the woven material 714 as the distal end 713 of the strap moves toward the proximal end 711.

The greater lateral width of the strap that is due to the flexing or widening of the woven material 714 results in woven material 714 having a greater surface area atop the shoe 400. As a result, any downward forces that are imposed on the shoe 400 from the strap due to tensioning of the lace 405 are distributed over a greater surface area of the shoe 400, which results in the forces being less concentrated on any given area or portion of the shoe and the underlying foot. FIG. 26C illustrates a positioning of the strap atop and across the shoe 400.

It should be noted that any of the designs described herein may be employed with other means of tightening a shoe, such as conventional shoe laces, pull cords, reel based closure systems, and the like. In such embodiments, the tension adjustment components and systems described and contemplated herein may be employed to essentially adjust or vary the fit of the shoe after a primary means (e.g., shoe lace, pull cord, reel based closure systems, etc.) of closing and tightening the shoe has been employed.

Figure 27A:
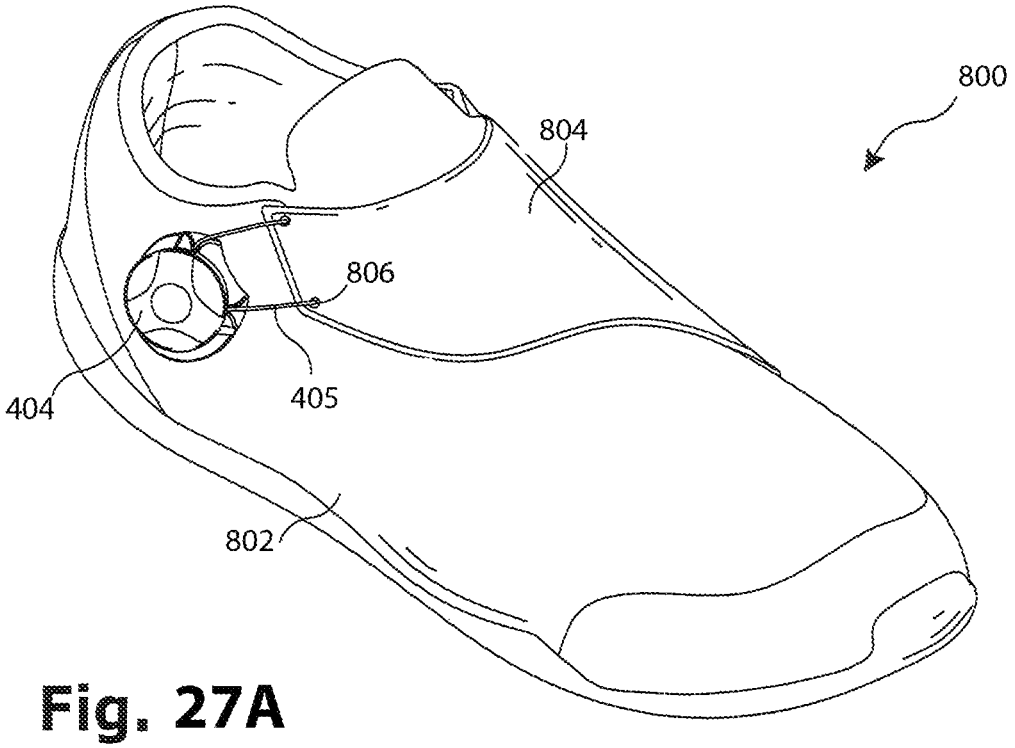
FIGS. 27A-C illustrate an embodiment of footwear that is constructed so that the means of closing and tightening the footwear, via a reel based closure device, are built or manufactured into the footwear.
Figure 27B:
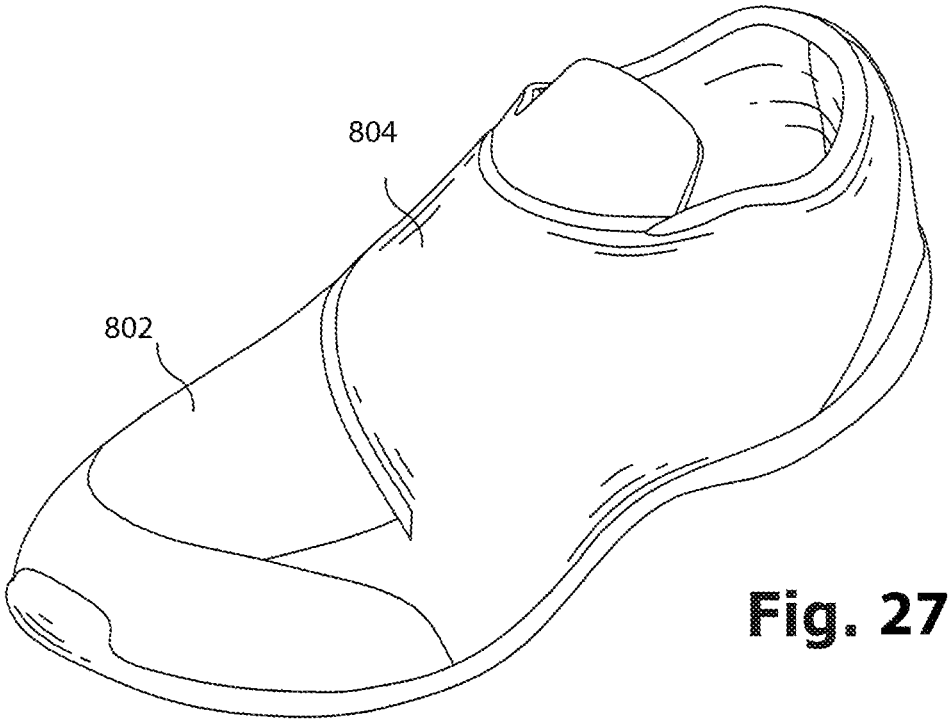

FIGS. 27A-29C illustrate shoes that are constructed so that the means of closing and tightening the shoe via a reel based closure device are built or manufactured into the shoe. The embodiments of FIGS. 27A-29C are different than conventional shoes in which separate components are attached to the shoe after manufacture in order to enable the shoe to be closed and tightened via a reel based closure device. In FIGS. 27A-C the shoe 800 includes a panel 804 that is constructed from the shoe's upper 802. Stated differently, the upper 802 is designed and formed so that the panel 804 is an integral part of the upper 802. In conventional shoes, the panel 804 would be a separate component that is stitched, adhered, welded, mechanically fastened, or otherwise attached to the upper 802 after manufacture of the shoe 800. With the panel 804 integrally formed with the upper 802, the fit of the shoe 800 about the foot may be improved and/or the process of the manufacturing the shoe 800 may be improved.

Figure 27C:
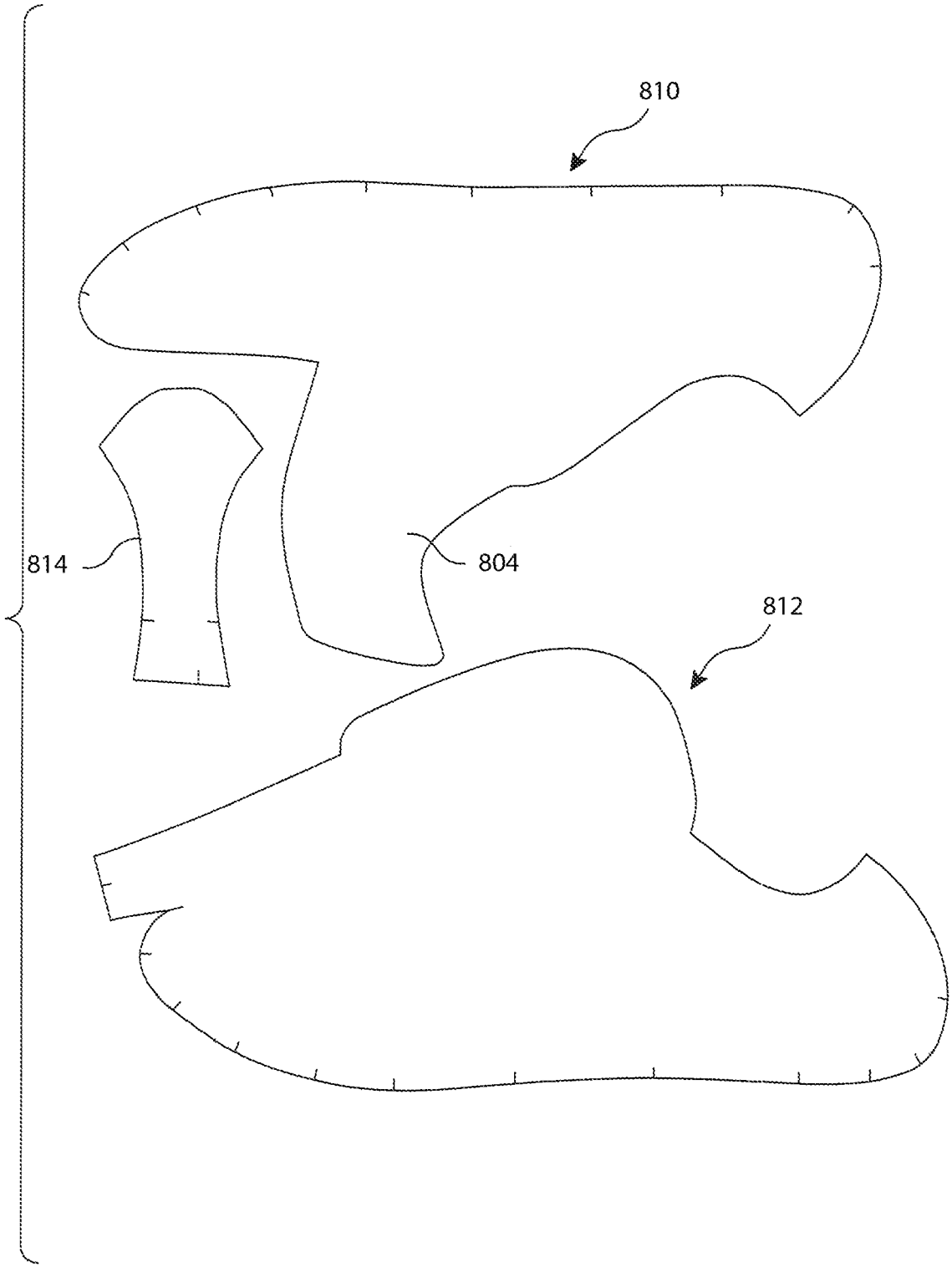

The panel 804 is operationally coupled with the reel based closure device 404 via lace 405 that extends from the reel based closure device 404 to a distal end of the panel 804. The panel 804 may include a pair of apertures 806, a channel, or any other feature that allows the distal end of the panel 804 to be attached to the lace 405. As the lace 405 is tensioned via the reel based closure device 404, the panel 804 is also tensioned, which closes and/or tightens the shoe 800 about the user's foot. FIG. 27C illustrates an exemplary pattern of the upper 802 that may be used to form the upper 802 with the integrated panel 804. The pattern includes a first material pattern 810, a second material pattern 812, and a third material pattern 814. The first material pattern 810 includes the panel 804 and may be positioned on the medial side of the foot when the pattern 810 is attached to the other patterns to form the shoe 800. The second material pattern 812 may be positioned on the lateral side of the foot when attached to the first material pattern 810 in forming the shoe 800. The third material pattern 814 attaches to the first material pattern 810 and the second material pattern 812 to form the heel of the shoe 800.

Figure 28A:
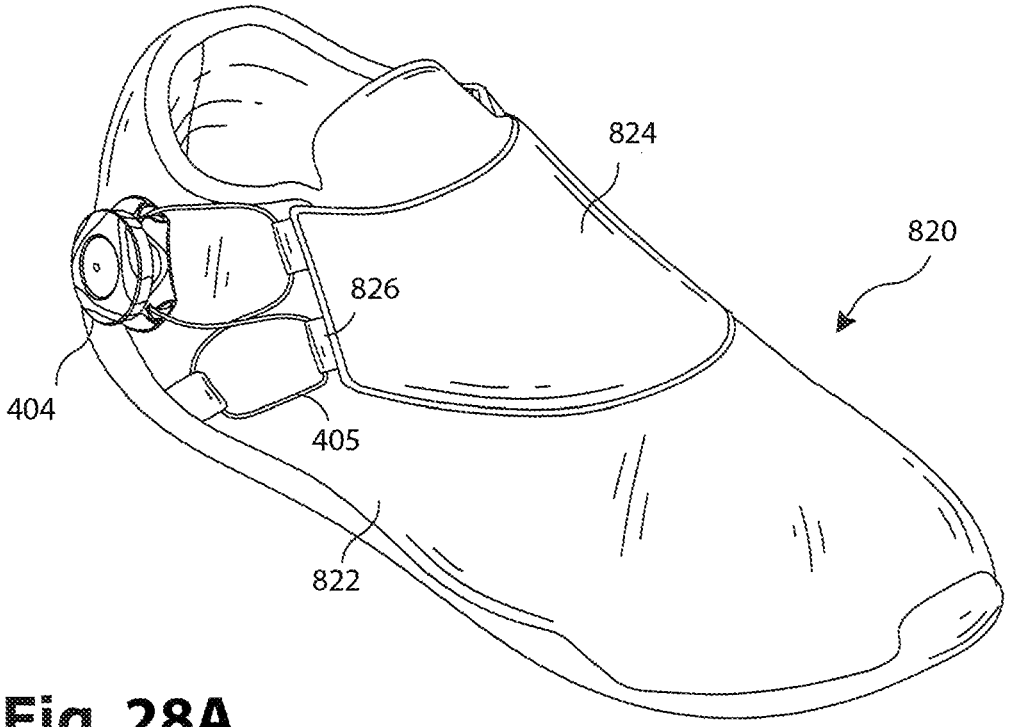
FIGS. 28A-B illustrate another embodiment of footwear that is constructed so that the means of closing and tightening the footwear, via a reel based closure device, are built or manufactured into the footwear.
Figure 28B:
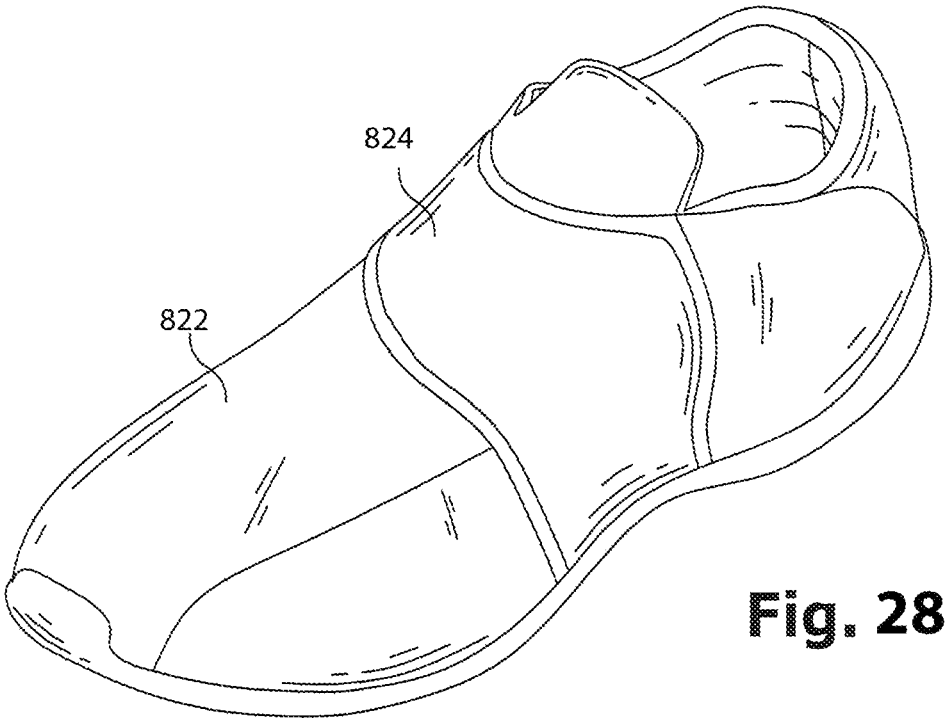

FIGS. 28A-B illustrate another shoe 820 that includes a panel 824 that is built or integrated into the upper 822. The panel 824 is positioned about the shoe 820 similar to the panel 804 of FIGS. 27A-C and similar material patterns may be used in constructing the shoe 820. The main difference in the shoe 820 of FIGS. 28A-B is that the panel 824 includes multiple guides 826 that allow the lace 405 to traverse multiple times between the shoe's sole and the distal end of the panel 824. The guides 826 may be made of soft materials, such as loops of fabric, in order to eliminate or reduce the rigid components that are positioned on the shoe, which may be uncomfortable to the user.

Figure 29A:
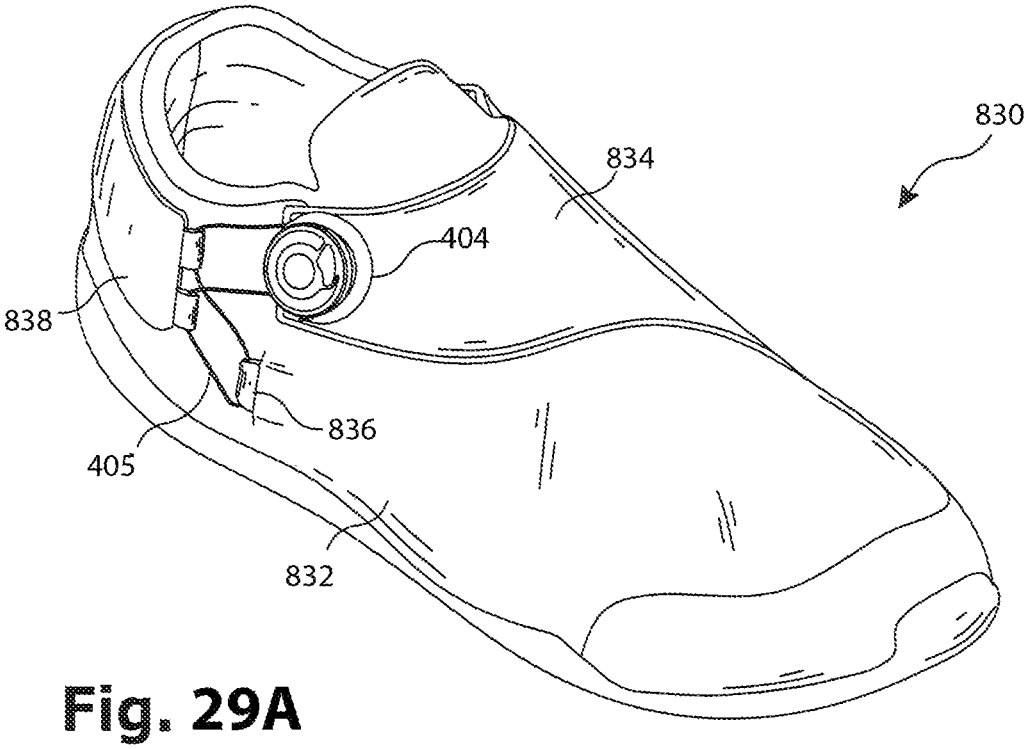
FIGS. 29A-C illustrate an embodiment of footwear that is constructed so that the means of closing and tightening the footwear, via a reel based closure device, are built or manufactured into the footwear.
Figure 29B:
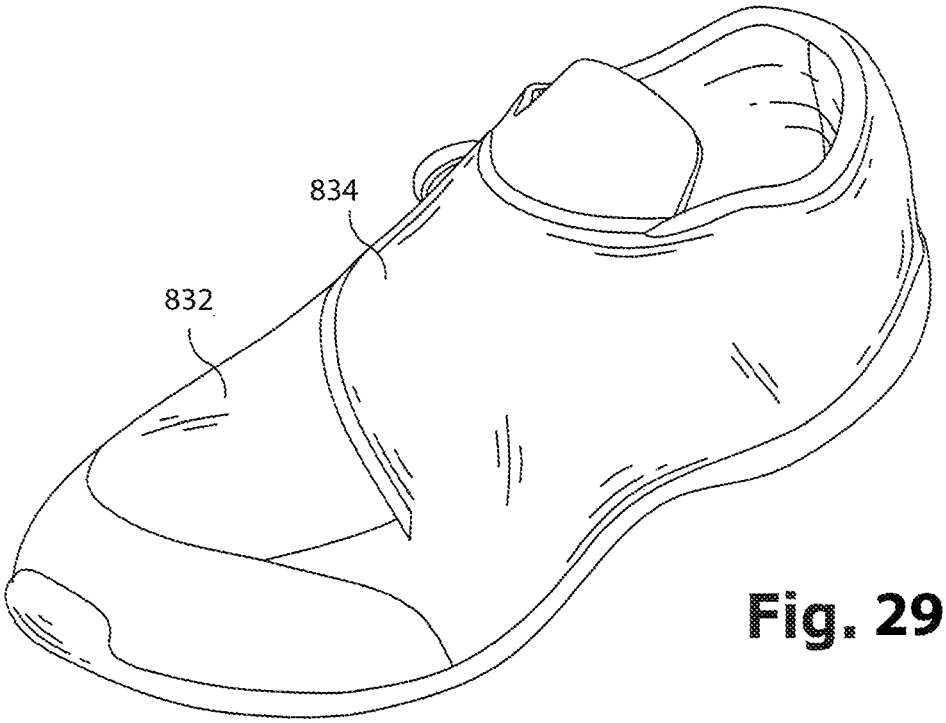
Figure 29C:
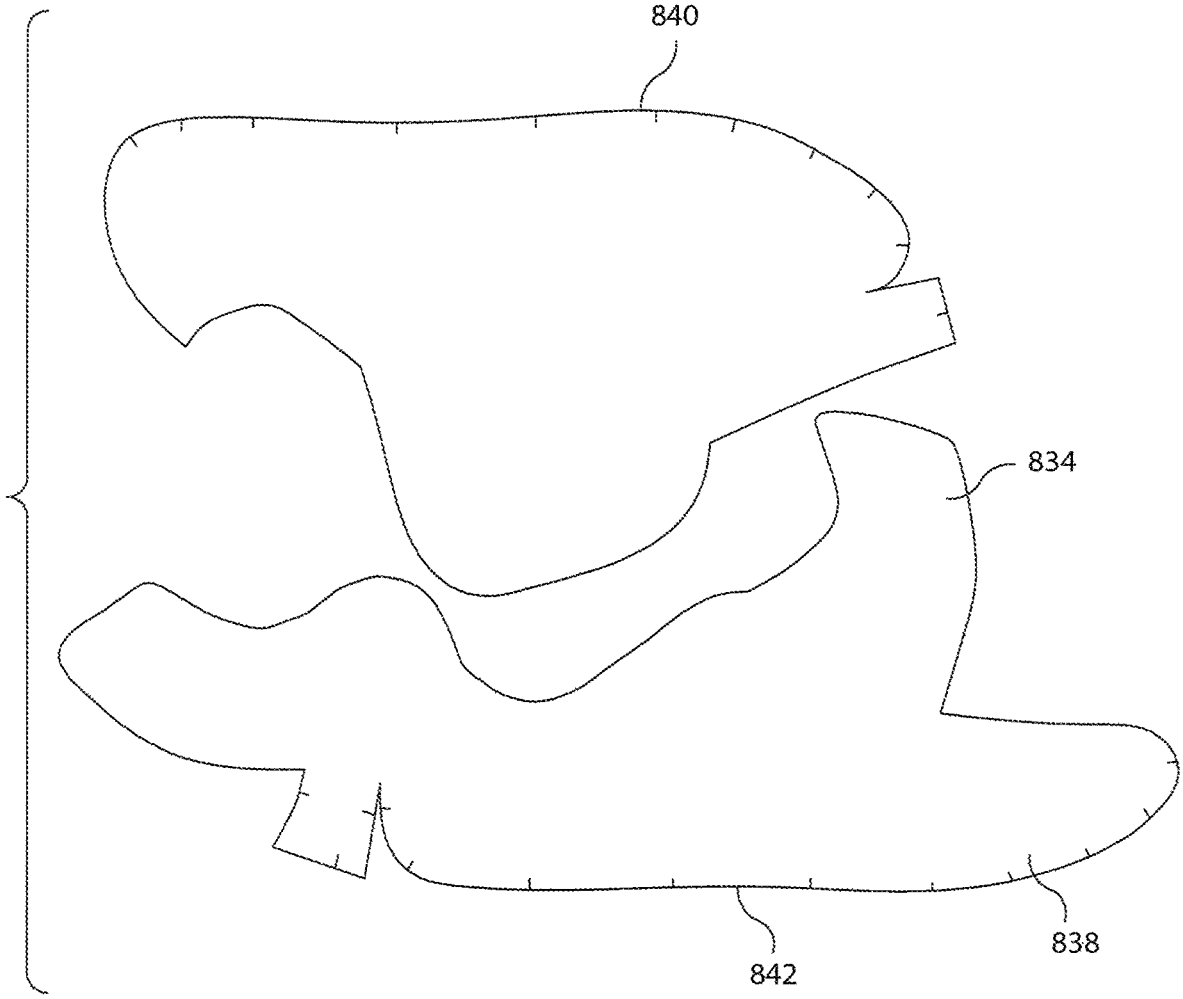

FIGS. 29A-C illustrate another shoe 830 that includes a pair of panels that are built or integrated into the upper 832. Specifically, the shoe 830 includes a first panel 834 that is integrated into the upper 832 in a manner similar to that illustrated in FIGS. 27A-C. The first panel 834 is positioned across the top of the shoe 830 and is used to close and tighten the shoe about the top of the foot. The upper 832 also includes a second panel 838 that is wrapped around the heel of the shoe 830. The second panel 838 is used to constrict the shoe 830 about the ankle. The reel based closure device 404 is illustrated as being positioned on the distal end of the first panel 834, although in other embodiments the reel based closure device 404 may be positioned elsewhere on the shoe 830. The upper 832 includes guides 836 that route or direct the lace 405 from the reel based closure device 404 to the second panel 838 and to other parts of the upper 832. Operation of the reel based closure device 404 causes the first panel 834 and the second panel 838 to constrict about the foot, thereby tightening the shoe about the foot.

FIG. 29C illustrates an exemplary pattern of the upper 832 that may be used to form the upper 832 with the integrated first and second panels, 834 and 838. The pattern includes a first material pattern 840 and a second material pattern 842. The second material pattern 842 includes the first panel 834 and the second panel 838. When coupled with the first material pattern 840, the first panel 834 is positioned atop the shoe 830 and the second panel 838 is disposed around the heel as illustrated in FIGS. 29A-B. When coupled together, the first material pattern 840 may be positioned on the medial side of the shoe 830 while the second material pattern 842 is positioned on the lateral side of the shoe 830.

Figure 30A:
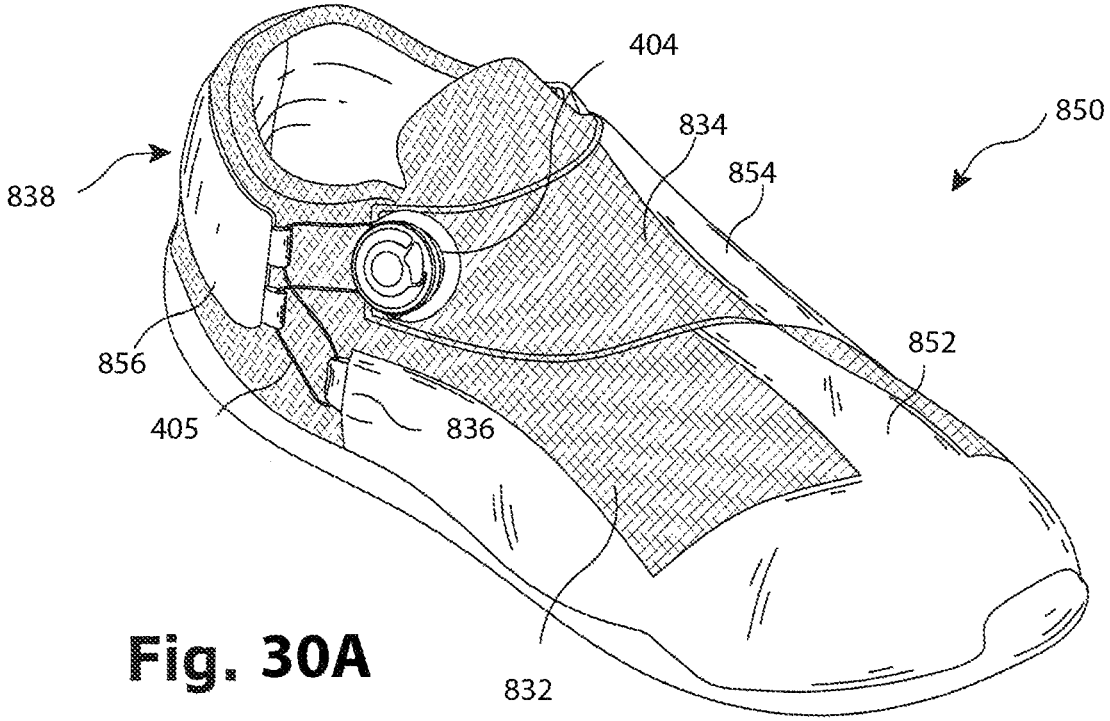
FIGS. 30A-B illustrate a means of forming panels on footwear.
Figure 30B:
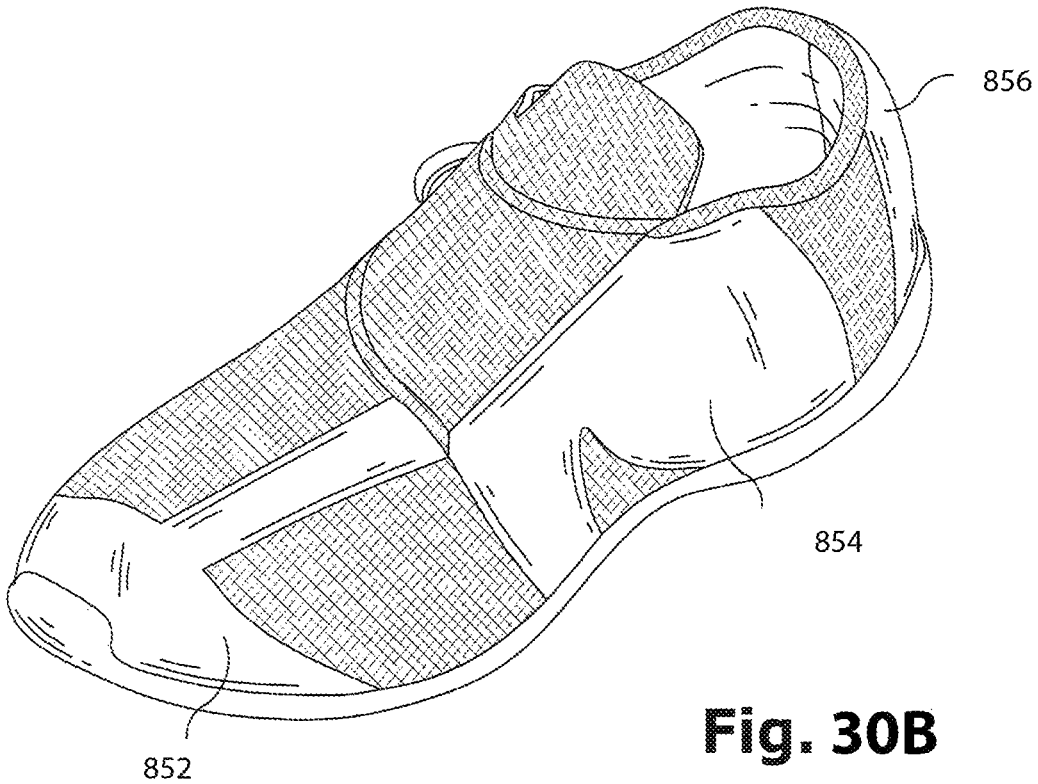

FIGS. 30A-B illustrate another means of forming panels on a shoe 850. In particular, the embodiments illustrate how portions of the shoe 850 may be rendered stiffer in comparison with other portions of the shoe to enable the stiffer portions to function more as a panel or strap that closes and/or tightens the shoe 850 about the foot. In particular, the shoe 850 may be made of a relatively soft and flexible material. The soft and flexible material may be more difficult to properly tension than a more rigid material and thus, in order to facilitate in tensioning the shoe 850, one or more portions of the shoe may be rendered more stiff or rigid.

In the illustrated embodiments, the shoe 850 has a configuration similar to that of FIGS. 29A-C in which a first panel 834 and a second panel 838 are integrated into the upper 832. Since the material is soft and flexible, however, tensioning of the first and second panels may be more difficult without increasing the stiffness of one or both of these panels. To increase the stiffness, a more rigid or less flexible material is overlaid and bonded to the upper 832. For example, to increase the stiffness of the second panel 838, a more rigid material 856 is overlaid and bonded to the second panel 838 via heat welding, adhesive bonding, and the like. The stiffer material overlay 856 allows the second panel 838 to be more easily tensioned via the lace and reel based closure device 404 than an unaltered second panel 838. The upper 832 may include additional material overlays as desired. For example, a stiffer material overlay 852 may be positioned near and/or over the toe box to increase the stiffness of this portion of the shoe. The stiffer material overlay 852 may extend to the guides 836 that route or direct the lace 405 to reinforce the coupling of the guides 836 with the shoe. An additional material overlay 854 may be attached to a portion of the first panel 834 to increase the stiffness and/or reinforce the first panel 834 as desired. More or fewer portions of the upper 832 may be stiffened via material overlays as desired.

Figure 31:
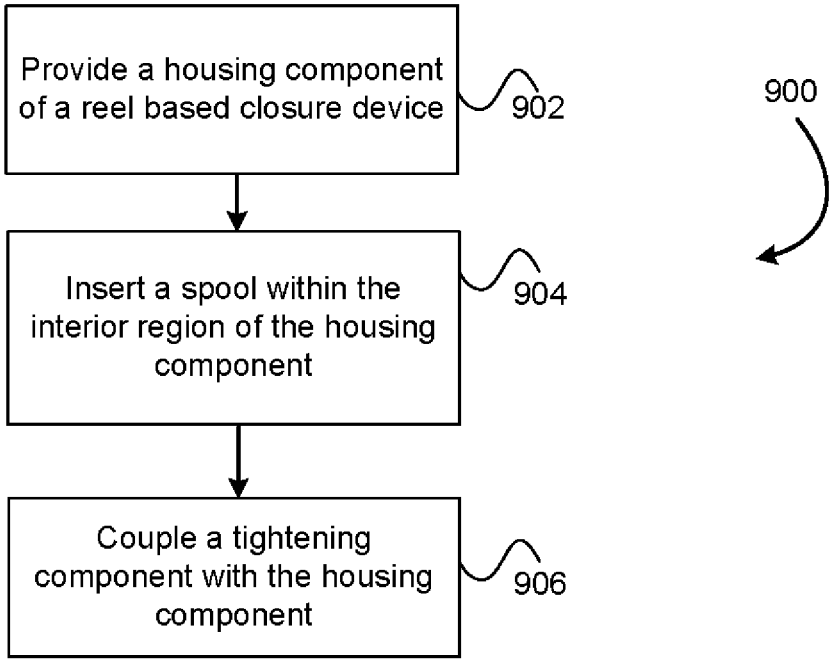
FIG. 31 illustrates a method of assembling a reel based closure device.

Referring now to FIG. 31, illustrated is a method 900 of assembling a reel based closure device. At block 902, a housing component is provided. As described herein, the reel based closure device includes a bottom member and an exterior wall that extends upward from the bottom member to define an interior region of the housing component. The bottom member typically includes a channel that is defined or formed on or within a bottom surface of the bottom member. The channel is configured so that a tension member is positionable within the channel to route the tension member axially below the interior region of the housing component. The channel may be a U-shaped channel that is defined or formed on the bottom surface of the housing component. The U-shaped channel may extend from a first side of the housing component to a second side of the housing component. Opposing sides of the U-shaped channel may have an arcuate or curved shape.

At block 904, a spool is inserted within the interior region of the housing component. The spool is configured so that the tension member is windable about the spool. At block 906, a tightening component is coupled with the housing component. The tightening component is configured so that an operation of the tightening component causes the spool to rotate within the interior region of the housing component to wind the tension member about the spool.

In some embodiments, the method also includes attaching the reel based closure device to a shoe. The method may further include coupling the housing component with a base component that is attached to a shoe to releasably coupleable the housing component with the shoe. The base component may include an aperture that is aligned with the channel of the housing component when the housing component is coupled with the base component. In such embodiments, the method may additionally include inserting the tension member through the aperture of the base component and through the channel of the housing component.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A reel based closure device comprising:

a housing component that includes:

a bottom member having a channel that is defined in a bottom surface of the bottom member; and a cylindrical wall that extends upward from the bottom member to define an interior region of the housing component;

a spool that is rotatably positioned within the interior region of the housing component, the spool being configured so that a tension member is windable about the spool; and a tightening component rotatably coupled with the housing component and operably coupled with the spool such that an operation of the tightening component causes the spool to rotate within the interior region of the housing component to wind the tension member about the spool;

wherein the channel of the bottom member is configured so that the tension member is routed from the housing component and through the channel so that tension member crosses itself within the channel; and wherein the channel is configured so that at the crossing of the tension member, the tension member is compressed between a surface of the channel and a material of an article that the reel based closure is coupled with.

2. The reel based closure device of claim 1, further comprising a base component that is releasably coupleable with the bottom member of the housing component to attach the reel based closure device with an article.

3. The reel based closure device of claim 2, wherein the base component includes an aperture that is aligned with the channel of the bottom member when the housing component is coupled with the base component, wherein the aperture enables the tension member to be routed from the housing component to the channel of the bottom member.

4. The reel based closure device of claim 1, wherein the channel of the bottom member is a U-shaped channel, and wherein the U-shaped channel extends from a first side of the bottom member to a second side of the bottom member.

5. The reel based closure device of claim 4, wherein opposing sides of the U-shaped channel have an arcuate or curved shape.

6. The reel based closure device of claim 1, wherein the channel is made of a material that frictionally engages with the tension member.

7. The reel based closure device of claim 1, wherein the reel based closure device is operable with a lace guide to route the tension member from the housing component to the channel of the bottom member.

8. A reel based closure device comprising:

a housing component that includes:

a bottom member having a channel that is defined in a bottom surface of the bottom member; and a cylindrical wall that extends upward from the bottom member to define an interior region of the housing component;

a spool that is rotatably positioned within the interior region of the housing component, the spool being configured so that a tension member is windable about the spool;

a tightening component rotatably coupled with the housing component and operably coupled with the spool such that an operation of the tightening component causes the spool to rotate within the interior region of the housing component to wind the tension member about the spool; and a base component that is releasably coupleable with the bottom member of the housing component to attach the reel based closure device with an article;

wherein the channel of the bottom member is configured so that the tension member is routed from the housing component and through the channel so that tension member crosses itself within the channel.

9. The reel based closure device of claim 8, wherein the base component includes an aperture that is aligned with the channel of the bottom member when the housing component is coupled with the base component, wherein the aperture enables the tension member to be routed from the housing component to the channel of the bottom member.

10. The reel based closure device of claim 8, wherein the channel of the bottom member is a U-shaped channel, and wherein the U-shaped channel extends from a first side of the bottom member to a second side of the bottom member.

11. The reel based closure device of claim 10, wherein opposing sides of the U-shaped channel have an arcuate or curved shape.

12. The reel based closure device of claim 8, wherein the channel is configured so that at the crossing of the tension member, the tension member is compressed between a surface of the channel and a material of an article that the reel based closure is coupled with.

13. The reel based closure device of claim 8, wherein the channel is made of a material that frictionally engages with the tension member.

14. The reel based closure device of claim 8, wherein the reel based closure device is operable with a lace guide to route the tension member from the housing component to the channel of the bottom member.

* * * * *